US007850837B2

(12) United States Patent
Matsuura et al.

(10) Patent No.: US 7,850,837 B2
(45) Date of Patent: Dec. 14, 2010

(54) ALUMINUM SUPPORT FOR LITHOGRAPHIC PRINTING PLATE, METHOD OF PREPARING THE SAME AND PRESENSITIZED PLATE USING THE SAME

(75) Inventors: Atsushi Matsuura, Shizuoka (JP); Akio Uesugi, Shizuoka (JP); Hideki Miwa, Shizuoka (JP); Atsuo Nishino, Shizuoka (JP); Hirokazu Sawada, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 300 days.

(21) Appl. No.: 11/431,551

(22) Filed: May 11, 2006

(65) Prior Publication Data

US 2006/0201819 A1 Sep. 14, 2006

Related U.S. Application Data

(62) Division of application No. 10/372,964, filed on Feb. 26, 2003, now abandoned.

(30) Foreign Application Priority Data

| | | |
|---|---|---|
| Feb. 26, 2002 | (JP) | 2002-050359 |
| Feb. 27, 2002 | (JP) | 2002-051221 |
| Feb. 28, 2002 | (JP) | 2002-053249 |
| Feb. 28, 2002 | (JP) | 2002-053250 |

(51) Int. Cl.
*C25D 11/04* (2006.01)

(52) U.S. Cl. ..... 205/214; 205/210; 205/213

(58) Field of Classification Search ..... 205/214
See application file for complete search history.

(56) References Cited

U.S. PATENT DOCUMENTS

| | | | | |
|---|---|---|---|---|
| 3,891,516 | A | 6/1975 | Chu | |
| 4,476,006 | A | 10/1984 | Ohba et al. | |
| 4,561,944 | A | 12/1985 | Sasaki et al. | |
| 4,576,686 | A | 3/1986 | Hirokazu et al. | |
| 4,824,757 | A * | 4/1989 | Aono et al. | 430/169 |
| 5,834,129 | A * | 11/1998 | Dhillon et al. | 428/654 |
| 6,764,587 | B2 | 7/2004 | Sawada et al. | |
| 2001/0036598 | A1 * | 11/2001 | Shimada et al. | 430/281.1 |

FOREIGN PATENT DOCUMENTS

| | | | |
|---|---|---|---|
| EP | 0 695 647 | * | 7/1996 |
| EP | 0 978 573 | A2 | 2/2000 |
| JP | 11-115340 | A | 4/1999 |

OTHER PUBLICATIONS

English Translation of JP 11-115340.*
European Communication dated Jun. 22, 2005.
European Communication dated Sep. 21, 2005.

* cited by examiner

*Primary Examiner*—Harry D Wilkins, III
*Assistant Examiner*—Zulmariam Mendez
(74) *Attorney, Agent, or Firm*—Sughrue Mion, PLLC

(57) ABSTRACT

The present invention provides a method for preparing an aluminum support for lithographic printing plate, the aluminum support for a lithographic printing plate obtained by the method and a presensitized plate using the same, characterized in that anodizing treatment is performed on an aluminum plate after hydrochloric acid electrolytic graining treatment if necessary, nitric acid electrolytic graining treatment are performed on the aluminum plate at a specified ratio of quantities of electricity, and with this method, a lower-purity aluminum plate could be used and a obtained support for a lithographic printing plate is excellent in press life and scum resistance when a lithographic printing plate is prepared.

7 Claims, 6 Drawing Sheets

ALUMINUM SUPPORT FOR LITHOGRAPHIC PRINTING PLATE, METHOD OF PREPARING THE SAME AND PRESENSITIZED PLATE USING THE SAME

This is a divisional of application Ser. No. 10/372,964 filed Feb. 26, 2003 now abandoned. The entire disclosure of the prior application, application Ser. No. 10/372,964, is hereby incorporated by reference.

BACKGROUND OF THE INVENTION

1. Field of the Invention

The present invention relates to an aluminum support for a lithographic printing plate (also called "a support for a lithographic printing plate" in the present invention), a method of preparing the same and a presensitized plate using the same. More particularly, the present invention relates to a method of preparing an aluminum support for a lithographic printing plate where a low-purity aluminum rolled plate (an aluminum plate containing much of alloy components or an aluminum plate with alloy components unadjusted) can be used in addition to an aluminum plate used for a conventional support for a lithographic printing plate, an processing unevenness is not generated by graining treatment and the plate can have an optimum surface shape achieving both high press life and printing performance (scum resistance performance) when a lithographic printing plate is prepared (from the aluminum support for a lithographic printing plate), the support for a lithographic printing plate obtained by the method thereof and a presensitized plate using the printing plate.

Further particularly, the present invention relates to a presensitized plate excellent in laser exposure suitability and printing performance (water receptivity, water wettability of a non-image area, press life, and scum resistance of a printing plate), a support for a lithographic printing plate which is a base material of the presensitized plate and a method of preparing the support for a lithographic printing plate.

2. Description of the Related Art

Graining treatment is generally performed on an aluminum support for a lithographic printing plate in one combination or more among mechanical graining treatment, chemical etching in aqueous acid or alkali solution, desmutting treatment in an aqueous acid solution, electrochemical graining treatment in an aqueous acid solution (electrolytic graining treatment), anodizing treatment in an aqueous acid solution, treatment for water wettability, sealing treatment or the like.

Particularly, since electrochemical graining treatment can easily obtain even profile irregularities, it has been generally used as a method of graining on an aluminum support for a lithographic printing plate. Particularly, it is general to use electrochemical graining treatment mainly in aqueous hydrochloric acid or nitric acid solution.

In electrolytic graining treatment mainly using aqueous nitric acid or hydrochloric acid solution that has been conventionally employed as it is said that even profile irregularities can be obtained, it is necessary to strictly control the alloy components of an aluminum alloy plate. In addition, since a grained shape largely changes if the composition of alloy components fluctuates, if the conditions of graining treatment are kept constant, there lies a problem that even profile irregularities can not be formed on an aluminum alloy plate composed of various aluminum materials, particularly an aluminum alloy plate containing much content of impure elements.

In addition, there lies a problem that a grained shape of even profile irregularities can not be formed, if a graining treatment under a condition in a certain range which is conventionally deemed to be optimum is performed on the aluminum alloy plate composed of various aluminum materials.

On the other hand, in recent years, it has been desirable that an aluminum rolled plate where the rolling process of an aluminum plate is simplified, a general-purpose aluminum plate, a cheap-priced aluminum plate are rolled by using an unadjusted ground metal where alloy components recycled from beverage cans or the like are used as an aluminum support for a lithographic printing plate from the viewpoints of energy saving and effective utilization of natural resources.

On the contrary, if an aluminum support for a lithographic printing plate is prepared by using an aluminum plate where the rolling process of an aluminum plate is simplified, an aluminum plate containing much of alloy components and an aluminum plate with alloy components unadjusted, processing unevenness called streak attributable to an aluminum crystal orientation is likely to be generated. In addition, in electrochemical graining treatment, there lies a problem that an even graining treatment can not be performed and a defect in external appearance (processing unevenness) takes place or printing performance (particularly, scum resistance performance) is poor.

Furthermore, although an aluminum support for a lithographic printing plate having the performance achieving both impression number (press life) and scum resistance is preferred as an aluminum support for a lithographic printing plate having an image forming layer formed by a photosensitive image forming material by infrared ray laser for a direct plate making, nevertheless, electrochemical graining treatment can not be evenly performed and it is difficult to prepare an aluminum support for a lithographic printing plate having the compatible performance achieving both press life and scum resistance if the alloy components of an aluminum alloy plate are not controlled.

In the meantime, a presensitized plate is prepared by forming an image recording layer (also called "image forming layer" in the present invention) such as photosensitive layers on the grained surface of a support for a lithographic printing plate prepared in the aforementioned step.

In recent years, a direct plate making system where exposure is performed by directly drawing a print image on a presensitized plate with a laser beam in accordance with a digital signal from a computer has become widespread fast. In addition, a direct drawing type presensitized plate which directly exposes an print image on a presensitized plate mounted on the offset cylinder of an offset printing press with a laser beam has been used.

Taken up as laser exposure type presensitized plates exposed with a laser beam for example are the presensitized plate where an aluminum support web with an anodized layer formed at density of 5 to 12 g/m$^2$ is a base material as described in JP 61-48418 B, the presensitized plate where a sol containing a silver halide and a kernel reducing the silver halide into metal silver is applied on an aluminum support web as described in JP 63-260491 A, the presensitized plate where silicate treatment is performed on the surface of an aluminum support web on which an anodized layer is formed to form aluminum silicate at density of 2 to 8 mg/mm$^2$ as described in U.S. Pat. No. 4,555,475 and the presensitized plate where silicate treatment is performed on the surface of an aluminum support web on which an anodized layer is formed, over which carbon black is further applied as described in EP 164,128 and the like.

SUMMARY OF THE INVENTION

This invention aims to provide a method of preparing an aluminum support for a lithographic printing plate where a low-purity aluminum rolled plate (an aluminum plate containing much of alloy components or an aluminum plate with alloy components unadjusted) which has not been used as an aluminum support for a lithographic printing plate can be used, processing unevenness is not produced by graining treatment and an optimum surface shape achieving both high scum resistance and printing performance (press life performance) can be obtained when a lithographic printing plate is prepared from an aluminum support for a lithographic printing plate obtained by a preparing method according to the present invention (hereinafter may be merely referred to as "when a lithographic printing plate is prepared."), a support for a lithographic printing plate obtained by the method and a presensitized plate using the support for a lithographic printing plate (The first Embodiment to the third Embodiment according to the present invention).

In addition, in a lithographic printing plate and a direct drawing type lithographic printing plate used in the direct plate making system, a relatively higher water receptivity, water wettability of a non-image area, press life, scum resistance of a plate or the like are required compared with those of a normally used lithographic printing plate. In addition, it is also required that a halation does not take place in a recording layer when a print image is drawn with a laser beam. Furthermore, it is also requested to solve a defect in inking in the solid section or the glipper edge section of a lithographic printing plate caused by depositions such as ink or tiny pieces of paper deposited on the surface of a blanket cylinder on an offset rotary printing press.

The present invention aims to provide a presensitized plate which is excellent in water receptivity, water wettability of a non-image area, press life, scum resistance of a printing plate and laser exposure suitability, and can be preferably used as a lithographic printing plate or a directly drawn lithographic printing plate of the aforementioned direct plate making system, a support for a lithographic printing plate which is a base material of the aforementioned presensitized plate and a method of preparing of the support (The fourth Embodiment according to the present invention).

On close research, the inventors have found that processing unevenness is not generated by the graining treatment and both excellent press life and printing performance (scum resistance performance) can be achieved when a lithographic printing plate is prepared, by determining the ratio of the Alternating current (hereinafter AC) quantity of electricity on the aluminum plate Qc/Qa, to be 0.9 to 1.0, where Qa is the quantity of electricity at anode time (the quantity of electricity in the anodic state in the an aluminum plate to which AC is applied) and Qc is at cathode time (the quantity of electricity in the cathodic state in the an aluminum plate to which AC is applied), for the use in electrochemical graining treatment in an aqueous hydrochloric acid solution, although the latitude of alloy component content of an aluminum plate used as an aluminum support for a lithographic printing plate is broad.

Furthermore, the inventors has found that use of an aqueous hydrochloric acid solution having a specified composition for electrochemical graining treatment in an aqueous hydrochloric acid solution and determining the ratio of the AC quantity of electricity on the aluminum plate Qc at the time of cathode (the quantity of electricity in the anodic state in the an aluminum plate to which AC is applied) to Qa at the time of anode (the quantity of electricity in the cathodic state in the an aluminum plate to which AC is applied), Qc/Qa, to be 0.9 to 1.0, for use in electrochemical graining treatment in an aqueous nitric acid solution are effective in achieving both the excellent press life and printing performance, and have found that by combining above mentioned conditions can achieve both excellent properties. The inventors completed the present invention based on the above findings.

Namely, the first Embodiment according to the present invention provides a method of preparing an aluminum support for a lithographic printing plate which is characterized in that (1) each of the following treatment is performed on an aluminum plate:

1) electrochemical graining treatment in an aqueous hydrochloric acid solution prepared by adding aluminum chloride hexahydrate at a rate of 10 to 70 g/L to an aqueous solution containing 1 to 10 g/L of hydrochloric acid to have an aluminum ion concentration of 1 to 8 g/L, under the condition that the ratio Qc/Qa of quantity of electricity Qc in the cathodic state to quantity of electricity Qa in the anodic state in the an aluminum plate to which Alternating current is applied is 0.9 to 1.0, and 2) anodizing treatment.

The second Embodiment and third Embodiment according to the present invention provide methods of preparing an aluminum support for a lithographic printing plate according to the above mentioned (1), wherein the electrochemical graining treatment is performed in an aqueous nitric acid solution under the condition that the ratio Qc/Qa of quantity of electricity Qc in the cathodic state to quantity of electricity Qa in the anodic state in the aluminum plate to which Alternating current is applied is 0.9 to 1.0, before or after the electrochemical graining treatment is performed in the aqueous hydrochloric acid solution.

Namely, the second Embodiment according to the present invention provides a method of preparing an aluminum support for a lithographic printing plate which is characterized in that (2) each of the following treatment is performed on an aluminum plate:

1) electrochemical graining treatment in an aqueous nitric acid solution under the condition that the ratio Qc/Qa of quantity of electricity Qc in the cathodic state to quantity of electricity Qa in the anodic state in the aluminum plate to which Alternating current is applied is 0.9 to 1.0, and 2) electrochemical graining treatment in an aqueous hydrochloric acid solution prepared by adding aluminum chloride hexahydrate at a rate of 10 to 70 g/L to an aqueous solution containing 1 to 10 g/L of hydrochloric acid to have an aluminum ion concentration of 1 to 8 g/L, under the condition that the ratio Qc/Qa of quantity of electricity Qc in the cathodic state to quantity of electricity Qa in the anodic state in the an aluminum plate to which Alternating current is applied is 0.9 to 1.0, and 3) anodizing treatment.

In addition, the third Embodiment according to the present invention provides a method of preparing an aluminum support for a lithographic printing plate which is characterized in that (3) each of the following treatment is performed on an aluminum plate:

1) electrochemical graining treatment in an aqueous hydrochloric acid solution prepared by adding aluminum chloride hexahydrate at a rate of 10 to 70 g/L to an aqueous solution containing 1 to 10 g/L of hydrochloric acid to have an aluminum ion concentration of 1 to 8 g/L, under the condition that the ratio Qc/Qa of quantity of electricity Qc in the cathodic state to quantity of electricity Qa in the anodic state in the an aluminum plate to which Alternating current is applied is 0.9 to 1.0, 2) electrochemical graining treatment in an aqueous nitric acid solution under the condition that the ratio Qc/Qa of quantity of electricity Qc in the cathodic state to quantity of electricity Qa in the anodic state in the aluminum plate to which Alternating current is applied is 0.9 to 1.0, and 3) anodizing treatment.

Hereunder, it is preferred that mechanical graining treatment is performed prior to performing electrochemical graining treatment.

In Addition, it is preferred that the aqueous hydrochloric acid solution contains 1 to 10 g/L of hydrochloric acid and particularly preferred is 2 to 6 g/L contained therein.

It is preferred that aluminum chloride hexahydrate to be added is 10 to 70 g/L contained, more preferred is 20 to 50 g/L and most preferred is 35 to 45 g/L.

It is preferred that the aluminum ion concentration of an aqueous hydrochloric acid solution after aluminum chloride hexahydrate added thereto is 1 to 8 g/L, more preferred is 2 to 6 g/L and most preferred is 4 to 5 g/L.

In addition, the first Embodiment to the third Embodiment according to the present invention provide a method of preparing an aluminum support for a lithographic printing plate according to any one of the above mentioned (1) to (3), which is further characterized in that (4) the quantity of the electricity to cause part in anodic reaction in the aluminum plate is 25 to 100° C./dm$^2$ in the electrochemical graining treatment in the aqueous hydrochloric acid solution.

In addition, the first Embodiment to the third Embodiment according to the present invention provide a method of preparing the aluminum support for a lithographic printing plate according to any one of the above mentioned (1) to (4), which is further characterized in that (5) chemical etching treatment in an aqueous alkali solution and desmutting treatment in an aqueous acid solution are performed before or after electrochemical graining treatment is performed in the aqueous nitric acid solution or in the aqueous hydrochloric acid solution, or both in the aqueous nitric acid solution and in the hydrochloric acid, or both before and after thereof.

The first Embodiment to the third Embodiment according to the present invention provide a method of preparing the aluminum support for a lithographic printing plate according to any one of the above mentioned (1) to (5), which is further characterized in that (6) sealing treatment or treatment of water wettability is, or both sealing treatment and treatment of water wettability are performed after the anodizing treatment is performed.

The first Embodiment to the third Embodiment according to the present invention provide a method of preparing the aluminum support for a lithographic printing plate according to any one of the above mentioned (1) to (6), which is further characterized in that (7) the wastewater of an electrolyte used for electrochemical graining treatment in the aqueous nitric acid solution and/or in the aqueous hydrochloric acid solution or wastewater of an electrolyte used for the anodizing treatment is used for the desmutting treatment.

The first Embodiment to the third Embodiment according to the present invention provide (8) the aluminum support for a lithographic printing plate obtainable by a method of preparing the aluminum support for a lithographic printing plate according to any one of the above mentioned (1) to (7).

The first Embodiment to the third Embodiment according to the present invention provide (9) a presensitized plate which is prepared by providing an image recording layer on the aluminum support for a lithographic printing plate according to the above mentioned (8).

The first Embodiment to the third Embodiment according to the present invention provide a method of development of the presensitized plate according to the above mentioned (9), which is further characterized in that (10) a developer is an aqueous alkali solution containing silicic acid.

The first Embodiment to the third Embodiment according to the present invention provide a method of development of the presensitized plate according to the above mentioned (9), which is further characterized in that (11) a developer is an aqueous alkali solution free from silicic acid and containing saccharides.

The fourth Embodiment according to the present invention relates to (12) a support for a lithographic printing plate having an aluminum plate whose at least one side is subjected to graining treatment, characterized in that the aluminum plate having an aluminum content of 99 wt % or more and having intermetallic compounds existent within the depth of 2 μm from the surface thereof at a density of 500 to 35,000 pcs/mm$^2$ is grained in a hydrochloric acid solution by starting electrochemical graining treatment within 5 seconds after soaking the aluminum plate therein.

A grained structure with small undulation of about 0.1 μm in size is evenly formed on the grained surface of the support for a lithographic printing plate by the electrolytic graining treatment in the hydrochloric acid solution. Therefore, a presensitized plate where a recording layer is formed on the grained surface of the support for a lithographic printing plate is excellent in laser exposure suitability and printing performance (water receptivity, water wettability of a non-image area, press life, and scum resistance of a printing plate), it can be preferably used as a direct drawing type presensitized plate.

The fourth Embodiment according to the present invention relates to a support for a lithographic printing plate according to the above mentioned (12), where (13) the aluminum plate is an aluminum web which runs like a stripe.

Since the support for a lithographic printing plate can be continuously prepared, it can be prepared with high productivity and with less dispersion.

The fourth Embodiment according to the present invention relates to a support for a lithographic printing plate according to the above mentioned (12) or (13), where (14) the hydrochloric acid solution is made to flow at a flow rate of 100 to 4,000 mm/sec onto the aluminum plate in the electrolytic graining treatment.

A presensitized plate where a recording layer is formed on the grained surface of the support for a lithographic printing plate is excellent in all of sensitivity, press life and mechanical strength.

The fourth Embodiment according to the present invention relates to a support for a lithographic printing plate according to any one of the above mentioned (12) to (14), where (15) the support is subject to grain by performing electrolytic graining treatment in a nitric acid solution and a subsequent alkali etching treatment prior to electrolytic graining treatment in a hydrochloric acid solution.

In the support for a lithographic printing plate, a grained structure with medium undulation with 10 to 20 μm of interval between mountains is formed, superimposed on the grained structure with small undulation on the grained surface of the aluminum plate, by the electrolytic graining treatment in the nitric acid solution.

Therefore, both water receptivity and press life are excellent when a lithographic printing plate is prepared from a presensitized plate where a recording layer is formed on the support for a lithographic printing plate.

Furthermore, an aluminum hydroxide layer generated on the surface of an aluminum plate by the electrolytic graining treatment is effectively removed by performing alkali etching treatment after electrolytic graining treatment is performed in a nitric acid solution.

The fourth Embodiment according to the present invention relates to a support for a lithographic printing plate according to the above mentioned (15), where (16) alkali etching with etching amount of 0.05 to 5 $g/m^2$ is performed on the aluminum plate.

Although the thin layer of aluminum hydroxide generated on the surface of an aluminum plate by electrolytic graining treatment is effectively removed by performing alkali etching treatment under the aforementioned conditions, the profile irregularities formed by electrolytic graining treatment remain. An obtained support for a lithographic printing plate is therefore excellent in water receptivity when a lithographic printing plate is prepared.

The fourth Embodiment according to the present invention relates to a support for a lithographic printing plate according to any one of the above mentioned (12) to (16), where (17) after electrolytic graining treatment is performed on the aluminum plate in a hydrochloric acid solution, alkali etching treatment is further performed on the aluminum plate.

Since alkali etching treatment is performed on the support for a lithographic printing plate after electrolytic graining treatment is performed thereon in the hydrochloric acid solution, an aluminum hydroxide layer generated on the surface of an aluminum plate by performing electrolytic graining treatment in the hydrochloric acid solution is effectively removed. A presensitized plate where a recording layer is formed on the support for a lithographic printing plate is therefore excellent in water receptivity in a non-image area when a lithographic printing plate is prepared.

The fourth Embodiment according to the present invention relates to a support for a lithographic printing plate according to the above mentioned (17), where (18) alkali etching treatment with etching amount of 0.05 to 5 $g/m^2$ is performed on the aluminum plate after electrolytic graining treatment is performed.

Although a thin layer of aluminum hydroxide generated on the surface of an aluminum plate by electrolytic graining treatment in a hydrochloric acid solution by performing alkali etching treatment under the aforementioned conditions is effectively removed, a grained structure with small undulation formed on the surface of an aluminum plate remains in a good condition. Therefore, an obtained support for a lithographic printing plate is particularly excellent in both water receptivity and scum resistance when a lithographic printing plate is prepared.

The fourth Embodiment according to the present invention relates to a support for a lithographic printing plate according to any one of the above mentioned (12) to (18), where (19) assuming that electrolytic graining treatment is performed in the nitric acid with the quantity of electricity $Q_1$ when the aluminum plate is anodic and the electrochemical graining treatment is performed in the hydrochloric acid solution with the quantity of electricity $Q_2$ when the aluminum plate is anodic, a rate $Q_1/Q_2$ is 1 or higher.

Since the formation of a grained structure with medium undulation and a grained structure with small undulation is well balanced on the grained surface of the support for a lithographic printing plate, a presensitized plate where the recording layer of the support for a lithographic printing plate is formed is excellent in laser exposure suitability and printing performance.

The fourth Embodiment according to the present invention relates to a support for a lithographic printing plate according to any one of the above mentioned (12) to (19), where (20) anodizing treatment is performed after graining treatment is performed on the aluminum plate and an anodized layer is formed on the grained surface formed by the graining treatment.

Since an anodized layer is formed on the surface of the support for a lithographic printing plate, a presensitized plate where an image recording layer is formed on the grained surface of the support for a lithographic printing plate is excellent in abrasive resistance in a non-image area when a lithographic printing plate is prepared.

The fourth Embodiment according to the present invention relates to (21) a presensitized plate where an image recording layer performed by exposuring with visible light or a laser beam on a grained surface in the support for a lithographic printing plate according to any one of the above mentioned (12) to (20).

The presensitized plate is excellent in sensitivity, press life performance and mechanical strength and can be preferably used as a direct drawing type presensitized plate.

The fourth Embodiment according to the present invention relates to a presensitized plate according to the above mentioned (21), where (22) the recording layer is a recording layer performed by exposuring with a laser beam.

The presensitized plate is excellent in laser exposure suitability.

The fourth Embodiment according to the present invention relates to (23) a method of preparing a support for a lithographic printing plate wherein at least one side of an aluminum plate having an aluminum content of 99 wt % or more is subjected to graining treatment to prepare the support for the lithographic printing plate having intermetallic compounds existent within the depth of 2 μm from the surface thereof at a density of 500 to 35,000 $pcs/mm^2$, and wherein aluminum plate is grained by performing electrochemical graining treatment in a hydrochloric acid solution, and the electrochemical graining treatment is started within 5 seconds after the aluminum plate is soaked in the hydrochloric acid solution.

The support for a lithographic printing plate with a grained structure with small undulation evenly formed on a grained surface can be obtained according to the method of preparing the support for a lithographic printing plate. A presensitized plate where a recording layer is formed on the grained surface of the support for a lithographic printing plate is excellent in laser exposure suitability and printing performance when a lithographic printing plate is prepared and can be preferably used as a direct drawing type presensitized plate.

DETAILED DESCRIPTION OF THE PREFERRED EMBODIMENTS

Figure 1:
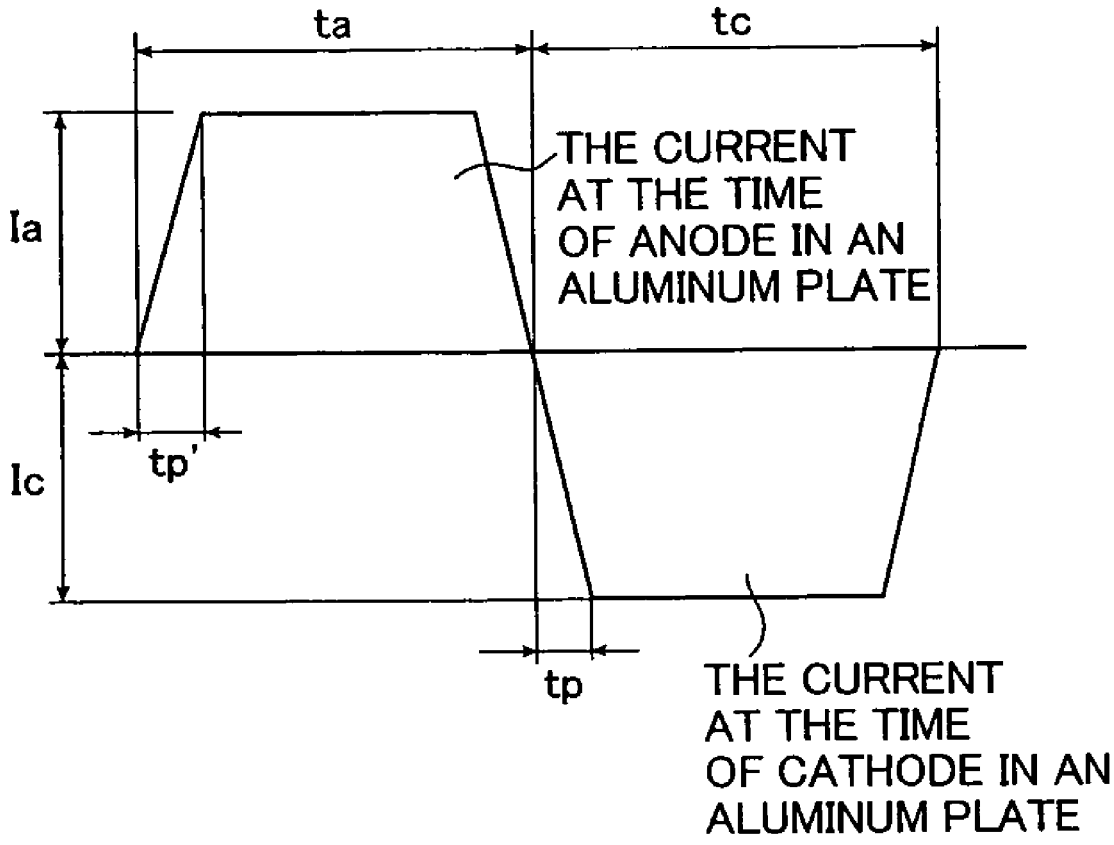
FIG. 1 is a waveform graph showing an example of a trapezoidal wave Alternating current power supply waveform used for electrochemical graining processing according to the present invention.

This invention aims to provide a method of preparing an aluminum support for a lithographic printing plate where a low-purity aluminum rolled plate (an aluminum plate containing much of alloy components or an aluminum plate with alloy components unadjusted) which has not been used as an aluminum support for a lithographic printing plate can be used, processing unevenness is not produced by graining treatment, even grain shape is formed and an optimum surface shape achieving both excellent press life and printing performance (scum resistance performance) can be obtained when a lithographic printing plate is prepared, a support for a lithographic printing plate obtained by the method and a presensitized plate using the support for a lithographic printing plate.

In addition, the present invention aims to provide a method of preparing an aluminum support for a lithographic printing plate which can be used as an offset printing master. Particularly, the present invention provides a method of preparing an aluminum support for a lithographic printing plate where any of so-called photosensitive image forming material by infrared ray laser for a direct plate making, with which a direct plate making can be performed from a digital signal of a computer or the like, and image forming layers formed by a photopolymer image forming layer and a positive image forming layer of the analog type or an image forming layer of the negative can be provided, a support for a lithographic printing plate obtained by the method and a presensitized plate using the support for a lithographic printing plate.

Furthermore, the present invention provides a presensitized plate which is excellent in water receptivity, water wettability in non-image area, press life, scum resistance of the printing plate and laser exposure suitability, and can be preferably used as a lithographic printing plate for the direct plate making system or a directly drawn lithographic printing plate, a support for the lithographic printing plate which is the base material of the presensitized plate, and a method of preparing thereof.

Hereafter, the present invention will be explained in detail concerning the method of preparing the aluminum support for the lithographic printing plate.

<Aluminum Alloy Plate (Rolled Aluminum)>

An aluminum alloy plate (hereinafter referred to as "aluminum plate" in the present invention) used for the first Embodiment to the third Embodiment according to the present invention is selected from a pure aluminum plate, an alloy plate with aluminum as the main component containing very small quantity of different elements, or a plastic film laminated with aluminum or is vapor deposited with aluminum. The trace of different elements contained in an aluminum plate are one kind or more selected from those described in the periodic table of elements, whose content is 0.001 to 1.5 wt %. Typical examples of different elements contained in the aluminum alloy are silicon, iron, nickel, manganese, copper, magnesium, chromium, zinc, bismuth, titanium, vanadium and the like. As aluminum alloy containing these different elements, publicly known materials to date as described in the 4th edition of Aluminum Hand Book (Japan Light Metal Association, 1990) can be usually used, for example, JIS A 1050 material, JIS A 3103 material, JIS A 3005 material, JIS A 1100 material, JIS A 3004 material or these materials with magnesium of 5 wt % or less added to increase tensile strength can also be used.

In addition, an aluminum plate used for the first embodiment to the third Embodiment according to the present invention can also use an aluminum plate obtained by rolling a base metal containing much of impurities from recycling scrapped beverage cans and the like. Taken up for example is an aluminum plate having a composition shown in the Table 1.

TABLE 1

| | Aluminum alloy components | | | | | | | | | |
|---|---|---|---|---|---|---|---|---|---|---|
| | Fe | Si | Cu | Ti | Mn | Mg | Zn | Cr | AI | Other elements |
| AL1 | 0.3 | 0.08 | 0.01 | 0.03 | — | — | — | — | 99.55 | Unavoidable impurities |
| AL2 | 0.25 | 0.07 | — | 0.01 | — | — | — | — | 99.62 | Ni = 0.004 V = 0.02 |
| AL3 | 0.6 | 0.235 | 0.19 | 0.03 | 1.2 | 0.9 | 0.15 | 0.02 | 96.65 | Unavoidable impurities |
| AL4 | 0.3 | 0.25 | — | 0.03 | 1 | 1 | 0.004 | 0.002 | 97.38 | Unavoidable impurities |

In the electrochemical graining treatment in an aqueous hydrochloric acid solution in the first Embodiment according to the present invention, and in the electrochemical graining treatment in an aqueous acid solution in the second and third Embodiments according to the present invention, although the above trace elements are much contained in the above aluminum plate, an even honeycomb pit is generated.

Although an Si component is much contained in the above aluminum plate, in either of the first Embodiment to the third Embodiment according to the present invention, a defect in an anodized layer is not generated and a paper is not soiled during printing when anodizing treatment is performed after graining treatment is performed. Furthermore, although a Cu component is much contained in the above aluminum plate similarly, the area of a portion in which a honeycomb pit is not generated is small, which causes no defect in external appearance.

An aluminum plate used for the methods of preparing the first Embodiment to the fourth Embodiment according to the present invention can use an aluminum plate prepared by omitting intermediate annealing processing or baking processing, or intermediate annealing processing and baking processing from DC casting method or an aluminum plate prepared by omitting intermediate annealing processing from continuous casting method.

It is preferred that the thickness of an aluminum plate used for the first Embodiment to the fourth Embodiment according to the present invention is 0.05 to 0.8 mm and more preferred is 0.1 to 0.6 mm. This thickness may be suitably changed depending upon the size of a printing press, the size of a printing plate, the request of a user or the like.

An aluminum plate used for the fourth Embodiment according to the present invention is of an aluminum content of 99 wt % or more and concretely taken up are a pure aluminum plate and the aluminum plate of an aluminum content within the above range.

If the aluminum content of an aluminum plate is within the above range, a presensitized plate excellent in each of sensitivity, press life and mechanical strength can be obtained.

The trace elements contained in this aluminum plate and those of the materials publicly known are the same descriptions as in the first Embodiment to the third Embodiment according to the present invention.

The aluminum plate contains an intermetallic compound of the density within 500 to 35,000 pcs/mm$^2$, within 2 μm from the surface of the aluminum plate.

Specifically, the density of the intermetallic compound is within the above described range in the aluminum plate surface and in any planes which are parallel sections to the aluminum plate surface within 2 μm from the aluminum plate surface.

If the density of an intermetallic compound is 500 pcs/mm$^2$ or more, a presensitized plate excellent in mechanical strength can be obtained. On the other hand, if the density of an intermetallic compound is 35,000 pcs/mm$^2$ or less, a presensitized plate excellent in sensitivity and press life can be obtained.

In addition, the planes which are parallel sections to the aluminum plate surface are formed by ordinary etching process and the like.

Taken up as intermetallic compounds for example are, two-element intermetallic compounds such as $Al_3Fe$, ternary intermetallic compounds such as AlFeSi and four-element intermetallic compounds such as AlFeXSi (X is any one of Mn, Cu, Mg, Ti, Cr and Zn).

Taken up as examples of two-element intermetallic compounds are, adding to $Al_3Fe$, $Al_6Fe$, $Mg_2Si$, $Ni_3Al$, MnAl, $TiAl_3$, $CuAl_3$ and the like. Taken as examples of ternary intermetallic compounds are α-AlFeSi, β-AlFeSi and the like. Taken up as examples of four-element intermetallic compounds are α-AlFeMnSi, β-AlFeMnSi and the like.

The kind, particle diameter and density of the intermetallic compound can be controlled by controlling an addition amount of each element of Si, Fe, Mn, Cu, Mg, Ti, Cr and Zn and changing the conditions of graining treatment for example. If a treatment temperature and the concentration of an acid in an acid solution are lowered in desmutting treatment described later for example, an extent that an intermetallic compound is removed is decreased, on the contrary, if a treatment temperature and the concentration of an acid in an acid solution are increased, an intermetallic compound is much more removed. In addition, if the density of an intermetallic compound wants to be lowered, a hydrochloric acid solution as an acid solution can be used in desmutting treatment described later.

The kind and density of an intermetallic compound may be found by observing the surface of a grained aluminum plate or sections parallel to the surface with an SEM (Scanning Electron Microscope) and counting the number of particles of an intermetallic compound in an area of 60 μm×50 μm at five places (n=5) on the surface of the aluminum plate or sections parallel to the surface and converting the counted number into the number of particles per mm$^2$, for example.

Furthermore, an EPMA (Electron Probe Micro Analyzer) can be utilized to determine the kinds of an intermetallic compound, which performs surface analyzing on the surface of a support for the lithographic printing plate or sections parallel to the surface in an area of 170 μm×170 μm, and the density can be determined by counting the number of the particles of the intermetallic compound and converting it into the number of particles per mm$^2$.

Although the form of an aluminum plate is generally an aluminum web which runs continuously like a stripe, a sheet-like aluminum plate cut in a predetermined dimension can be also used if a multi-product production in small quantities is implemented.

<Surface Treatment>

Although surface treatments containing electrochemical graining treatment under specified conditions in an aqueous acid solution is performed on the aluminum plate to obtain an aluminum support for a lithographic printing plate, this surface treatment may further include various processing. Furthermore, since alloy components of an aluminum plate used are eluted into a treatment solution used for a processing in various processing employed in the present invention, a treatment solution may contain the alloy components of an aluminum plate, and it is particularly preferred that a treatment solution is used by adding these alloy components therein to allow the solution to be a steady state before performing the treatment.

Namely, it is preferred that in the present invention, graining treatment can be performed in combination of each treatment described later and alkali etching treatment or desmutting treatment is performed before each electrochemical graining treatment is performed. In addition, it is also preferred that alkali etching treatment and desmutting treatment are performed in this order. In addition, it is preferred that alkali etching treatment or desmutting treatment is performed after each electrochemical graining treatment is performed. It is also preferred that alkali etching treatment and desmutting treatment are performed in this order. In addition, alkali etching treatment after each electrochemical graining treatment is performed can be omitted. Furthermore, acid etching treatment can be performed after alkali etching treatment is performed or in place of alkali etching treatment.

It is preferred that in the present invention, mechanical graining treatment is also performed before these treatments are performed. In addition, each electrochemical graining treatment may be performed twice or more. Furthermore, it is preferred that anodizing treatment, sealing treatment, treatment of water wettability or the like is performed after these processing are performed.

In the fourth Embodiment according to the present invention, electrochemical graining treatment in a nitric acid solution and a subsequent alkali etching treatment can be performed on an aluminum plate prior to performing electrochemical graining treatment in a hydrochloric acid solution. In addition, alkali etching treatment may be performed again following electrochemical graining treatment in a hydrochloric acid solution.

Desmutting treatment where treatment is performed on an aluminum plate in an acid solution may be performed between alkali etching treatment prior to performing electrochemical graining treatment, in a hydrochloric acid solution and performing electrochemical graining treatment in a hydrochloric acid solution, and after alkali etching treatment is performed following electrochemical graining treatment in a hydrochloric acid solution.

In addition, electrochemical graining treatment may be performed in the nitric acid solution after mechanical graining treatment, alkali etching treatment and desmutting treatment are performed.

Therefore, a support for a lithographic printing plate in the fourth Embodiment according to the present invention can be prepared by performing graining treatment on the aluminum plate in the below-mentioned steps for example.

(Step 1)

Mechanical graining treatment

Alkali etching treatment (first)

Desmutting treatment (first)

Electrochemical graining treatment in a nitric acid solution (first)

Alkali etching treatment (second)

Desmutting treatment (second)

Electrochemical graining treatment in a hydrochloric acid solution (second)

Alkali etching treatment (third)

Desmutting treatment (third)

(Step 2)

Alkali etching treatment (first)

Desmutting treatment (first)

Electrochemical graining treatment in a nitric acid solution (first)

Alkali etching treatment (second)

Desmutting treatment (second)

Electrochemical graining treatment in a hydrochloric acid solution (second)

Alkali etching treatment (third)

Desmutting treatment (third)

Detailedly described below are mechanical graining treatment, alkali etching treatment, desmutting treatment, electrochemical graining treatment, anodizing treatment, sealing treatment and treatment of water wettability.

In addition, in the present invention, when electrochemical graining treatment is performed for the first time in an aqueous acid solution, it is determined to be the first, when electrochemical graining treatment is performed in an aqueous acid solution after a different treatment is performed it is determined to be the second, and subsequently, it is determined to be the n-th.

Furthermore, for alkali etching treatment, it may be determined to be the first, the second, . . . and the n-th similarly.

Furthermore, it is preferred that desmutting treatment is performed after alkali etching treatment is performed and it may be determined to be the first, the second, and the n-th similarly.

However, these ordinal numbers are used for convenience of description, and in the present invention, each treatment can be suitably omitted and another treatment between each treatment can be performed.

<Mechanical Graining Treatment>

It is preferred that in the first Embodiment to the third Embodiment, mechanical graining treatment is performed before electrochemical graining treatment is performed. The surface area of an aluminum plate is increased by performing mechanical graining treatment.

First, in the present invention, degreasing treatment to remove a rolling oil from the surface, for example, degreasing treatment by a surfactant, an organic solvent, an aqueous alkali solution or the like is performed as required prior to performing brush graining (mechanical graining treatment) on an aluminum plate. Degreasing treatment can be, however, omitted if the adhesion of a rolling oil is little.

Subsequently, brush graining is performed with a brush of one kind or two kinds or more of different diameters of bristles while an abrasive slurry liquid is supplied to the surface of an aluminum plate.

Figure 5:
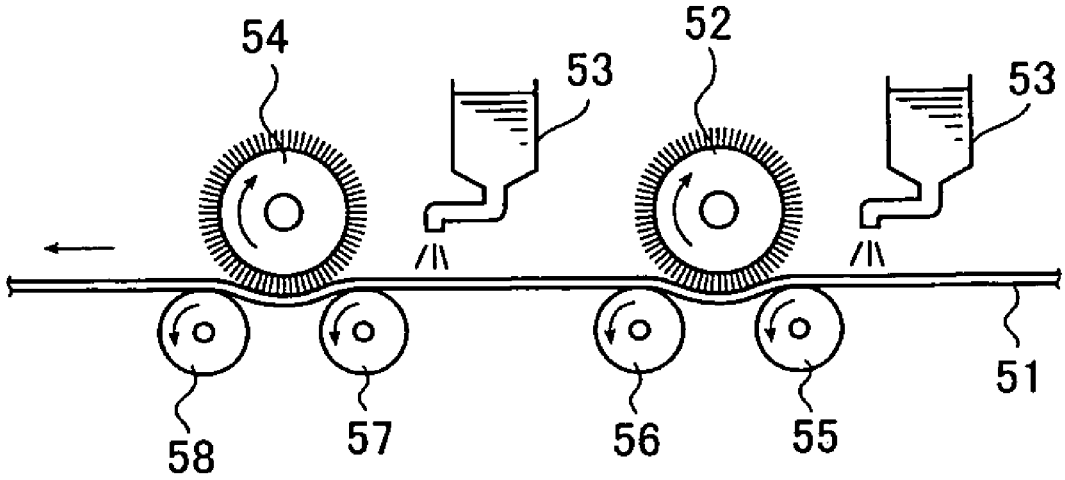
FIG. 5 is a side view showing the concept of a brush graining process used for mechanical graining treatment according to the present invention.

Mechanical graining treatment is detailedly described in JP 6-135175 A and JP 50-40047 B. In the brush graining, a brush which is first used is called the first brush and a brush which is finally used is called the second brush. FIG. 5 is a side view showing the concept of a brush graining process used for mechanical graining processing according to the present invention. In FIG. 5, 51 represents an aluminum plate, 52 and 54 represent roller-shape brushes, 53 represents an abrasive slurry liquid and 55, 56, 57 and 58 represent supporting rollers. When the graining is performed, roller-shape brushes 52 and 54 sandwiching an aluminum plate 51 and respective two supporting rollers 55, 56 and 57, 58 are disposed as shown in FIG. 5. It is preferred that two supporting rollers 55, 56 and 57, 58 are disposed so as to allow their shortest distances between the external surfaces to be shorter than the outer diameter of roller-shape brushes 52 and 54 respectively, the aluminum plate 51 is transferred at a constant speed by being pressed by the roller-shape brushes 52 and 54 and in a state of being thrust between two supporting rollers 55, 56 and 57, 58 and abrasive slurry liquid 53 is supplied to the aluminum plate to polish the surface of the aluminum plate by rotating the roller-brushes.

In the fourth Embodiment according to the present invention, brush graining by polishing with roller-shape brushes can be performed on at least one side of the aluminum plate.

In the fourth Embodiment according to the present invention, brush graining can be performed by sandwiching an aluminum plate on which graining treatment is to be performed, between roller-shape brushes disposed above and supporting rollers disposed below, while transferring the aluminum plate at a constant speed and rotating the roller-shape brush while supplying an abrasive slurry between the roller-shape brushes and the aluminum plate as detailedly described in JP 6-135175 A and JP 50-40047 B.

For the supporting rollers, two rollers per one roller-shape brush can be disposed. It is preferred that a pair of supporting rollers positioned below the roller-shape brushes are disposed so as to allow the shortest distances between the external surfaces to be smaller than the outer diameter of the roller-shape brushes.

When the brush graining is performed, it is preferred that the aluminum plate is pressed by the roller-shape brushes so as to thrust the aluminum plate between the two supporting rollers.

Preferably used as a brush in the present invention are brushes where brush materials such as nylon, polypropylene, animal hair or steel wire is implanted with even bristle length and even implantation distribution of bristles on a roller-shape block, where brush staples are implanted on a block in small holes arranged thereon or a channel roller type brush or the like.

Although it is preferred that the material of brush is nylon, and nylon 6, nylon 6.6, nylon 6.10 and the like are used, nylon 6.10 is the most preferred one from the viewpoint of tensile strength, abrasive resistance, dimensional stability due to water absorption, flexural strength, heat resistance, recovery property or the like.

The preferred length of bristle after implanted is 10 to 200 mm. It is preferred that the sectional shape of a bristle is a circle.

It is preferred that in the first Embodiment to the third Embodiment according to the present invention, the diameter of the bristle is 0.24 to 0.83 mm and further preferred is 0.295 to 0.72 mm. If the diameter of a bristle is less than 0.24 mm, scum resistance may deteriorate in a shadow area, and if larger than 0.83 mm, scum resistance may deteriorate on a blanket.

It is preferred that in the fourth Embodiment according to the present invention, the diameter of a bristle is 0.2 to 0.83 mm and particularly preferred is 0.25 to 0.8 mm. If the diameter of a bristle is 0.2 mm or more, scum resistance in a shadow area in a lithographic printing plate obtained is good and if the diameter of a bristle is 0.83 mm or less, a lithographic printing plate where scum on a blanket is hardly generated is obtained.

Furthermore, it is preferred that the implantation density when bristles are implanted on a brush roller is 30 to 1,000 pcs/cm$^2$ and further preferred is 50 to 300 pcs/cm$^2$.

It is preferred that the number of brush is one or more and ten or less and further preferred is one or more and six or less. The most preferred number of the brush in the fourth Embodiment according to the present invention is three or four.

Brush rollers with different bristle diameters may be combined with each other as described in JP 6-135175 A.

Next, it is preferred that the revolution of a brush roller is voluntarily selected in a range of 100 to 500 rpm. A brush roller having a rubber or a metallic surface and with straightness well held is used.

Although it is preferred that the rotation direction of a brush roller matches with the transfer direction of an aluminum plate (forward direction) as shown in FIG. 5, if a plurality of brush rollers are mounted, some of rollers may rotate reversely (reverse direction). It is particularly preferred that in the fourth Embodiment according to the present invention, if three roller-shape brushes described above are used, a roller-shape brush positioned on the utmost upstream side to the transfer direction of an aluminum plate is rotated matching with the transfer direction of the aluminum plate (forward direction), a roller-shape brush at the center is reversely rotated (reverse direction) and a roller-shape brush positioned on the utmost downstream side to the transfer direction of the aluminum plate is rotated matching with the transfer direction of the aluminum plate (forward direction). It is preferred that if four roller-shape brushes are used, the rotation directions of the four roller-shape brushes are forward direction, reverse direction, forward direction and forward direction in the order from the upstream side to the transfer direction of the aluminum plate (hereinafter merely referred to as the "upstream side") to the downstream side to the transfer direction of the aluminum plate (hereinafter merely referred to as the "downstream side").

It is preferred that the thrusting amount of a brush is controlled by the load of a brush rotation drive motor and is controlled so as to allow the consumption power of a rotation drive motor to be 1.0 to 15 kW, more preferably 2 to 10 kW.

In the forth Embodiment according to the present invention, a lithographic printing plate having a surface free from an processing unevenness can be obtained by oscillating the roller-shape brush at a frequency of 0.0001 to 1 Hz and amplitude of 10 to 200 mm along with the perpendicular direction to transfer direction of the aluminum plate.

It is preferred that in the present invention, a support provided with all of water wettability, water receptivity and contact characteristics with a photosensitive layer can be obtained by performing graining treatment with a thin brush after performing graining treatment with the thick brush. In this case, the water range is broad since a shadow area is not broken if a fountain solution is scarce, scum is hardly generated and further, a deterioration in contact characteristics with a photosensitive layer is not generated.

It is preferred that an abrasive slurry liquid used in the present invention is one where an abrasive of silica sand, aluminum hydroxide, alumina powder, volcanic ash, pumice stone powder, pumice stone, carborundum, emery or the like with average particle diameter of 1 to 50 μm, preferably 20 to 45 μm (in the fourth Embodiment according to the present invention, the average diameter is generally 1 to 50 μm, preferred is 5 to 45 μm and further preferred is 15 to 45 μm) is dispersed in water so as to allow the specific gravity to be in a range of 1.05 to 1.3. The average particle diameter is defined as a particle diameter where a cumulative percentage is 50% when the cumulative frequency is taken with respect to the percentage of particles with each diameter to the volume of all abrasives contained in the slurry liquid.

Furthermore, it is preferred that in the first Embodiment to the third Embodiment according to the present invention, mechanical graining treatment is performed so as to allow the center-line average roughness (Ra) after mechanical graining treatment to be 0.3 to 1.0 μm and in the fourth Embodiment, it is so performed as to allow the center-line average roughness to be 0.3 to 0.6 μm. In the fourth Embodiment, a grained structure with large undulation with an interval between mountains of about 10 to 30 μm is formed on the surface of the aluminum plate by performing the mechanical graining treatment.

Of course, as mechanical graining treatment, a method where an abrasive slurry liquid is sprayed, a method a wire brush is used, a method where the surface shape of a reduction roll with profile irregularities arranged is transferred to an aluminum plate, a roller abrasive method where graining is performed by brushing with an abrasive roller with an abrasive surface mounted on the side and the like can also be used. Other methods are described in JP 55-074898 A, JP 61-162351 A, JP 63-104889 A and the like.

It is preferred that in the brush graining, a thrusting amount, revolution speed and combination of rotation directions of roller-shape brush, number of roller-shape brushes, diameters of each roller-shape brush, density of bristles of brush, tensile force applied to aluminum plate, kinds of abrasives mixed with the abrasive slurry, average particle diameters and particle size distribution of the abrasive, and flow, direction and angle of the abrasive slurry sprayed to aluminum plate or the like are so selected as to be able to obtain the center-line average roughness (Ra) in the above range.

<Chemical Etching Treatment in Aqueous Alkali Solution (First Alkali Etching Treatment)>

It is preferred that after brush graining treatment is performed on an aluminum plate like this, chemical etching is then performed on the surface of the aluminum plate. This chemical etching treatment has a function to remove abrasives, an aluminum scrap and the like entered into the surface of the aluminum plate on which brush graining treatment has been performed, and unifies electrochemical graining treatment later performed, also enabling to result in effective achievements.

In addition, it can remove an aluminum hydroxide generated on the surface of the aluminum plate by performing electrolytic graining treatment in a nitric acid solution or in a hydrochloric acid solution.

In the first alkali etching treatment, etching is performed by allowing the aluminum plate to contact with an alkali solution. The first alkali etching treatment is performed to remove a rolling oil, dirt and a naturally oxidized layer on the surface of the aluminum plate (rolled aluminum) if mechanical graining treatment is not performed thereon, and to dissolve the edge portions of asperities generated by performing mechanical graining treatment to obtain a surface with a smooth wave if mechanical graining treatment has been already performed.

Taken up as methods of allowing an aluminum plate to contact with an alkali solution for example are a method where an aluminum plate is allowed to pass through a tank containing an alkali solution, a method where an aluminum plate is allowed to be soaked in a tank containing an alkali solution and a method where an alkali solution is sprayed to the surface of an aluminum plate.

The details of the chemical etching treatment are described in U.S. Pat. No. 3,834,398. Describing in more detail, it is a method to soak an aluminum plate in an aluminum-soluble solution, more concretely an aqueous alkali solution.

Taken up as the alkali solutions are a caustic alkali and alkali metal salt solution and the like.

Contained as the alkalis described above are sodium hydroxide, potassium hydroxide, sodium tertiary phosphate, potassium tertiary phosphate, sodium aluminate, sodium metasilicate, sodium carbonate and the like. Etching rate is higher if a base solution is used.

Taken up as the alkali metal salts described above are alkali metal silicates such as sodium metasilicate, sodium silicate, potassium metasilicate and potassium silicate, alkali metal carbonates such as sodium carbonate and potassium carbonate, alkali metal aluminates such as sodium aluminate and potassium aluminate, alkali metal aldonates such as sodium gluconate and potassium gluconate and alkali metal hydrogen phosphates such as sodium secondary phosphate, potassium secondary phosphate, sodium tertiary phosphate, potassium tertiary phosphate and the like. A caustic alkali solution and a solution containing the caustic alkali and an alkali metal aluminate are particularly preferred as the alkali solution since the etching rate is higher and they are cheap.

A sodium hydroxide solution containing the determined amount of an aluminum ion is particularly preferred as the alkali solution.

It is preferred that in chemical etching, a 0.05 to 40 wt % aqueous solution of these alkalis (20 to 30 wt % in the fourth Embodiment according to the present invention) is used and etching treatment is performed at a solution temperature of 40 to 100° C. (40 to 80° C. in the fourth Embodiment according to the present invention) for 5 to 300 sec. It is preferred that the concentration of an aqueous alkali solution is 1 to 30 wt %. Aluminum as a matter of course and an alloy component contained in an aluminum alloy may be contained by 0 to 10 wt %. An aqueous solution mainly containing caustic soda is preferred as an aqueous alkali solution. It is preferred that etching treatment is performed at a solution temperature of an ordinary temperature to 95° C. for 1 to 120 sec.

It is preferred that the amount of etching of one side (a grained surface when mechanical graining treatment is performed) of an aluminum plate in the first Embodiment to the third Embodiment according to the present invention is 0.001 to 30 g/m$^2$ as the chemical etching amount of an aluminum plate, more preferred is 1 to 15 g/m$^2$ and particularly preferred is 3 to 12 g/m$^2$.

It is preferred that in the fourth Embodiment according to the present invention, the amount of etching of an aluminum plate in the alkali etching treatment, in other words, the etching amount is in a range of 2 to 15 g/m$^2$ in the alkali etching treatment (first) following the mechanical graining treatment and particularly preferred is in a range of 3 to 10 g/m$^2$.

The alkali etching treatment can be performed with an etching equipment which is usually used to perform etching treatment on an aluminum plate. Taken up as the etching equipment are a type where a tank to store an alkali solution is provided and the aluminum plate is soaked in the tank and a type where a spraying nozzle is provided and the alkali solution is sprayed to the aluminum plate from the spraying nozzle. The etching equipment may be either a batch type or a continuous type.

It is preferred that a solution separation by a nip roller and water washing by a spray are conducted not to bring a treatment solution in the next process after etching treatment is completed.

<Acid Etching Treatment>

Acid etching treatment is a treatment where etching is chemically performed on an aluminum plate in an aqueous acid solution and it is preferred that the treatment is performed after electrochemical graining treatment later described is over. It is also preferred that acid etching treatment is performed after alkali etching treatment is over if the alkali etching treatment is performed before and/or after the electrochemical graining treatment is performed.

If the acid etching treatment is performed on the aluminum plate after the alkali etching is performed on it, an intermetallic compound containing silica or Si as a simple substance on the surface of the aluminum plate can be removed and preventing a defect in an anodized layer from producing in anodizing treatment in the subsequent steps. As a result, it can prevent a trouble that a dotted ink adheres to a non-image area, which is called a dust-like scum at the time of printing.

Taken up as aqueous acid solutions used for acid etching treatment are aqueous solutions containing phosphoric acid, nitric acid, sulfuric acid, chromic acid, hydrochloric acid or a mixed acid of two or more kinds of these acids. An aqueous sulfuric acid solution is preferred among them. It is preferred that the concentration of an aqueous acid solution is 50 to 500 g/L. An aqueous acid solution may contain the aluminum as well as alloy components contained in an aluminum plate.

It is preferred that acid etching is performed at a solution temperature of 60 to 90° C., preferably 70 to 80° C. for 1 to 10 sec. It is preferred that the amount of etching of an aluminum plate under those conditions is 0.001 to 0.2 g/m$^2$. In addition, it is preferred that the concentration of an acid, for example, the concentration of sulfuric acid and the concentration of an aluminum ion are each selected from a range of the concentration that crystallization does not take place at an ordinary temperature. The preferred concentration of an aluminum ion is 0.1 to 50 g/L and particularly preferred is 5 to 15 g/L.

In addition, although it is preferred that a solution squeegeeing by a nip roller and water washing by a spay are conducted to prevent a treatment solution from being carried in the next process after acid etching treatment is over, the solution squeegeeing and washing can be omitted if a solution of the same kind and composition as those of a solution to be used in the next process or a wastewater discharged in the next process is used as an acid solution.

<Desmutting Treatment in Aqueous Acid Solution (First Desmutting Treatment)>

Since smut is generally produced on the surface of an aluminum plate if chemical etching is performed on the aluminum plate in an aqueous alkali solution, desmutting treatment is then performed on the aluminum plate in an aqueous acid solution containing phosphoric acid, nitric acid, sulfuric acid, chromic acid, hydrochloric acid or two or more acids of these (mixed acid).

The desmutting treatment can be performed by soaking the aluminum plate in an aqueous acid solution or by allowing the aluminum plate to pass through the aqueous acid solution and can be also performed by spraying treatment that the aqueous acid solution is sprayed to the aluminum plate with a spraying nozzle. The spraying processing is preferred as the desmutting treatment.

Since alkali etching treatment is performed on the aluminum plate in an aqueous alkali solution in the fourth Embodiment according to the invention also, smut is produced on the surface of the aluminum plate. Desmutting treatment is then performed by allowing the aluminum plate to contact with an acid solution to remove smut on the surface thereof whenever the alkali etching treatment is completed.

It is preferred that the concentration of an aqueous acid solution containing the acid is 0.5 to 60 wt %. In addition, 0 to 5 wt % of alloy components contained in an aluminum alloy as well as aluminum may be dissolved in an aqueous acid solution.

In the fourth Embodiment according to the present invention, 0 to 5 wt % of aluminum ion and ions contained in the aluminum alloy which forms the aluminum plate among the trace elements may be dissolved in the acid solution. Concretely, an aqueous nitric acid solution containing 0.5 to 1.5 wt % of nitric acid is preferred as the acid solution in desmutting treatment (first) which is the desmutting treatment performed after the alkali etching treatment (first) is performed.

It is particularly preferred that a wastewater generated in electrochemical graining treatment and a wastewater generated in anodizing treatment are used as a desmutting treatment solution (an aqueous acid solution).

Concretely, since the amount of the wastewater discharged in electrolytic graining treatment (first) and anodizing treatment can be decreased, the wastewater discharged in the subsequent electrolytic graining treatment and anodizing treatment later described is preferably used as the acid solution in the desmutting treatment (first) and a desmutting treatment (second) later described, in the fourth Embodiment according to the present invention. In addition, it is also preferred that the wastewater discharged in anodizing treatment is used as the acid solution in desmutting treatment (third) later described since not only a large amount of the wastewater can be decreased but also a process can dispense with a washing equipment between a desmutting treatment equipment and an anodizing treatment equipment because a process can immediately step into anodizing treatment dispensing with washing of the aluminum plate after desmutting process (third) is performed.

The temperature of a solution is selected in a range of an ordinary temperature to 95° C. and particularly preferred is 30 to 70° C. (25 to 80° C. in the fourth Embodiment according to the present invention). It is preferred that a treatment time is 1 to 120 sec. and particularly preferred is 1 to 5 sec. (preferred is 1 to 30 sec. and particularly preferred is 1 to 5 sec. in the fourth Embodiment according to the present invention).

It is preferred that a solution squeegeeing by a nip roller and washing by a spray are conducted to prevent a treatment solution from being carried in the next process after desmutting treatment is completed. The solution squeegeeing by a nip roller and washing by a spray can be omitted when a desmutting treatment solution is the same kind or the same composition as those of a solution used in the next process.

In addition, when an auxiliary anode tank is used to prevent an electrode from being melted and to control a grained shape in an equipment used for electrochemical graining treatment, desmutting treatment performed in an aqueous acid solution before electrochemical graining treatment can be omitted if the auxiliary anode tank is positioned before a tank where electrochemical graining treatment is performed by allowing AC current to flow in an aluminum plate.

<Electrochemical Graining Treatment>

Electrochemical graining treatment in the first Embodiment according to the present invention is characterized in electrochemical graining treatment under specified conditions in an aqueous solution mainly containing hydrochloric acid.

The purpose of the present invention (first Embodiment) can be achieved by performing electrochemical graining treatment and anodizing treatment under these specified conditions, and preferably mechanical graining treatment and each surface treatment as described in the specification as required.

Electrochemical graining treatment in the second Embodiment and the third Embodiment according to the present invention is characterized by combining electrochemical graining treatment under specified conditions in an aqueous solution mainly containing nitric acid and electrochemical graining treatment under specified conditions in an aqueous solution mainly containing hydrochloric acid.

The purpose of the present invention (the second Embodiment and the third Embodiment) can be achieved by performing the electrochemical graining treatments and anodizing treatment under these specified conditions, and preferably mechanical graining treatment and each surface treatment as described in the specification as required.

In addition, electrochemical graining treatment may be performed several times and electrochemical graining treatment may be performed again in an aqueous solution mainly containing hydrochloric acid after performing electrochemical graining treatment in an aqueous solution mainly containing nitric acid.

(1) Electrochemical Graining Treatment in an Aqueous Solution Mainly Containing Nitric Acid in the Second Embodiment and the Third Embodiment According to the Invention An aqueous solution mainly containing nitric acid referred to in the second Embodiment and the third Embodiment according to the present invention can use a solution which is used for electrochemical graining treatment using an ordinarily used DC or AC and a solution where one or more of nitrates having nitrate ions such as aluminum nitrate, sodium nitrate and ammonium nitrate or hydrochlorides having chloride ions such as aluminum chloride, sodium chloride and ammonium chloride is added to an aqueous nitric acid solution of 1 to 100 g/L at 1 g/L to saturation thereof can be used. In addition, a compound forming a complex with copper can be added at a rate of 1 to 200 g/L. Metals contained in an aluminum alloy such as iron, copper, manganese, nickel, titanium, magnesium and silicon may be dissolved in an aqueous solution mainly containing nitric acid. 1 to 100 g/L of hypochlorous acid or hydrogen peroxide may be added.

It is particularly preferred that an aluminum salt (aluminum nitrate) is added to an aqueous solution containing 5 to 15 g/L of nitric acid at a solution temperature of 15 to 90° C. so as to allow an aluminum ion in the solution to be 3 to 50 g/L. An additive added to an aqueous solution mainly containing nitric acid, equipments, a power supply, a current density, a flow rate and a temperature which are used for a publicly known electrochemical graining treatment can be used. Although AC or DC power supply can be used for electrochemical graining treatment, AC power supply is particularly preferred. A total quantity of electricity which allows an aluminum plate to trigger an anodic reaction in electrochemical graining treatment in an aqueous solution mainly containing nitric acid can be selected from a range of 10 to 1,000 C/dm$^2$ at a time when electrochemical graining treatment is completed, preferred is 30 to 500 C/dm$^2$ and particularly preferred is 45 to 300 C/dm$^2$.

(2) Electrochemical Graining Treatment in an Aqueous Solution Mainly Containing Hydrochloric Acid in the First Embodiment to the Third Embodiment According to the Present Invention An aqueous solution mainly containing hydrochloric acid referred to in the first Embodiment to the third Embodiment according to the present invention can use a solution which is used for electrochemical graining treatment using an ordinarily used DC or AC and a solution where one or more of nitrates having nitrate ions such as aluminum nitrate, sodium nitrate and ammonium nitrate or hydrochlorides having chloride ions such as aluminum chloride, sodium chloride and ammonium chloride is added to an aqueous hydrochloric acid solution of 1 to 10 g/L at 1 g/L to saturation thereof can be used. In addition, a compound forming a complex with copper can be added at a rate of 1 to 200 g/L. Metals contained in an aluminum alloy such as iron, copper, manganese, nickel, titanium, magnesium and silicon may be dissolved in an aqueous solution mainly containing hydrochloric acid. 1 to 100 g/L of hypochlorous acid or hydrogen peroxide may be added.

It is particularly preferred that an aluminum salt (aluminum chloride hexahydrate, $AlCl_3.6H_2O$) is added at a rate of 10 to 70 g/L to an aqueous hydrochloric acid solution mainly containing 1 to 10 g/L of hydrochloric acid at a solution temperature of 15 to 50° C. so as to allow the concentration of an aluminum ion in the solution to be controlled in 1 to 8 g/L. If electrochemical graining treatment is performed by using such an aqueous hydrochloric acid solution, a surface shape by the graining treatment is unified, although a low-purity aluminum rolled plate (an aluminum plate containing much of an alloy component or an aluminum plate with an alloy component unadjusted) is used, processing unevenness is not generated by the graining treatment, and both excellent press life and printing performance (scum resistance) can be achieved when a lithographic printing plate is prepared.

Here, it is preferred that an aqueous hydrochloric acid solution contains 1 to 10 g/L of hydrochloric acid and particularly preferred is 2 to 6 g/L.

It is preferred that aluminum chloride hexahydrate to be added is of 10 to 70 g/L, more preferred is 20 to 50 g/L and particularly preferred is 35 to 45 g/L.

It is preferred that the concentration of an aluminum ion in an aqueous hydrochloric acid solution to which aluminum chloride hexahydrate is added is 1 to 8 g/L, more preferred is 2 to 6 g/L and particularly preferred is 4 to 5 g/L.

An additive to be added to an aqueous solution mainly containing hydrochloric acid, equipments, a power supply, a current intensity, a flow rate and a temperature which are used for a publicly known electrochemical graining treatment can be used. Although AC or DC power supply can be used for electrochemical graining treatment, AC power supply is particularly preferred. A total quantity of electricity which allows an aluminum plate to trigger an anodic reaction in electrochemical graining treatment in an aqueous solution mainly containing hydrochloric acid can be selected from a range of 25 to 100 C/dm$^2$ at a time when electrochemical graining treatment is completed, preferred is 25 to 80 C/dm$^2$ and particularly preferred is 25 to 60 C/dm$^2$. If the total quantity of electricity is selected from the ranges above, a low-purity aluminum rolled plate (an aluminum plate containing much of an alloy component or an aluminum plate with an alloy component unadjusted) can be used. Furthermore, processing unevenness is not be generated by graining treatment, and both excellent press life and printing performance (scum resistance) can be achieved when a lithographic printing plate is prepared.

In the first Embodiment according to the present invention, if the electrochemical graining treatment is performed in a specific aqueous solution mainly containing a hydrochloric acid, a low-purity aluminum plate (an aluminum plate containing much of an alloy component or an aluminum plate with an alloy component unadjusted) can be used, processing unevenness is not be generated by graining treatment, an even grained shape can be formed, and both excellent press life and printing performance (scum resistance) can be achieved when a lithographic printing plate is prepared.

In the second Embodiment according to the present invention, if electrochemical graining treatment is performed in an aqueous hydrochloric acid solution after electrochemical graining treatment is performed in an aqueous nitric acid solution to form the grained shape of a grained structure with medium undulation, although a low-purity aluminum rolled plate (an aluminum plate containing much of an alloy component or an aluminum plate with an alloy component unadjusted) is used, a grained structure with small undulation formed by electrochemical graining treatment in an aqueous hydrochloric acid solution is formed on a grained structure with medium undulation formed by electrochemical graining treatment in an aqueous nitric acid solution, an even superimposed grained shape of a grained structure with small undulation and a grained structure with medium undulation can be formed, an processing unevenness is not generated and both excellent press life and printing performance (scum resistance) can be achieved when a lithographic printing plate is prepared.

In the third Embodiment according to the present invention, if electrochemical graining treatment is performed in an aqueous nitric acid solution after electrochemical graining treatment is performed in an aqueous hydrochloric acid solution to form a grained structure with small undulation, although a grained structure with small undulation formed by electrochemical graining treatment in an aqueous hydrochloric acid solution is dissolved by performing electrochemical gaining treatment in an aqueous nitric acid solution, an even grained shape of a grained structure with medium undulation can be formed, processing unevenness is not generated and both excellent press life and printing performance (scum resistance) can be achieved when a lithographic printing plate is prepared.

(3) Electrochemical Graining Treatment

Electrochemical graining treatment is the one that graining treatment is electrochemically performed by applying DC or AC between an aluminum plate and an electrode opposite to the aluminum plate in an aqueous acid solution. An AC is particularly preferred in the present invention and, the AC may be either of single phase, two-phase, three-phase or the like. In addition, a current that AC and DC are superimposed upon each other can be used.

Any of publicly known electrolytic cells can be used and for an electrolytic cell which is used for electrochemical graining treatment, electrolytic cells used for publicly known surface treatments such as a vertical type, a flat type, a radial type or the like may be used. A plurality of electrolytic cells may be provided. In addition, electrochemical graining treatment may be repeatedly performed by alternately performing etching treatment in an aqueous acid or alkali solution, desmutting treatment in an aqueous acid solution, cathode electrolysis treatment on an aluminum plate in an aqueous acid solution or an aqueous neutral salt solution or the like.

a) Power Supply System to Aluminum Plate

A power supply system to an aluminum plate can use a direct power supply system using a conductor roll or a solution power supply system (indirect power supply system) dispensing with a conductor roll. The flowing direction of an electrolyte which passes through an electrolytic cell may be either of a parallel direction with or a counter direction to the progress of an aluminum web. One AC power supply or more can be connected to one electrolytic cell. It is preferred that when the indirect power supply system is used, the ratio of the quantity of electricity at the time of anode and the quantity of electricity at the time of cathode which are applied to an aluminum plate is controlled with the method using an auxiliary anode as described in JP 6-37716 B and JP 5-42520 B. It is particularly preferred that a current which flows in the auxiliary anode is controlled with rectifying devices such as a thyristor, diode and GTO. If the system as described in JP 6-37716 B is used, AC quantity of electricity at the time of anode and AC quantity of electricity at the time of cathode (current values) on the surface of an aluminum plate opposite to a principal carbon electrode where electrochemical graining treatment is performed can be easily controlled. In addition, it is very economically advantageous from the view point of the preparing of a power supply and a scarce affection by the anhysteretic state of a transformer.

For the controlling method of a current value when electrochemical graining treatment is performed by using sine wave, the current value is controlled by performing feedback of a current value used for electrolysis to a variable induction regulator, using in combination with a transformer, a variable induction regulator or the like. In this case, a current value can be also controlled by using in combination with a method of performing phase control with a thyristor as described in JP 55-25381 A.

If a distance between an aluminum plate and an electrode and the velocity of a solution are not kept constant in electrochemical graining treatment, the deviation of a current is likely to take place, which results in processing unevenness on the surface of an aluminum plate, thus an inappropriate material is prepared as a support for a lithographic printing plate. In order to solve the problem, a solution pool chamber is internally provided and a solution supplying nozzle provided with a 1 to 5 mm slit for blowing a solution in a width direction of an aluminum web can be arranged. In addition, it is particularly preferred that a plurality of solution pool chambers are provided and piping connected to each solution pool chamber is provided with valves and flowmeters to control solution flows discharged from each slit.

It is preferred that a distance between an aluminum web and an electrode is 5 to 100 mm and particularly preferred is 8 to 15 mm. In order to keep this distance constant, a system where an aluminum web is allowed to travel while the travelling aluminum web is pressed against a slidable plane with a static pressure as described in JP 61-30036 B is used. A method where a distance between an electrode and an aluminum plate is kept constant by using the roller of a large diameter as described in JP 8-300843 A can be also used.

It is preferred that if a direct power supply system is used, a conductor roll as described in JP 58-177441 A is used and graining treatment is electrochemically performed with equipment as described in JP 56-123400 A. Although a conductor roll may be provided on the upper side or the lower side of an aluminum web, it is preferably preferred that the conductor roll is provided on the upper side of the aluminum plate and is pressed against an aluminum plate by a nip device. It is preferred that the length by which an aluminum plate contacts with the conductor roll is 1 to 300 mm to the moving direction of the aluminum plate. It is preferred that a pass roll which sandwiches the aluminum plate and is opposite to the conductor roll is made of rubber. A pressing pressure and the hardness of rubber roll are voluntarily set under the condition that an arc spot is not generated. It can be made easy to perform the replacement and inspection of the conductor roll by mounting the conductor roll on the upper side of the aluminum plate. It is preferred that a system where a power feeding brush is energized while the feeding brush is allowed to slide around a rotor at an end of the conductor roll is used.

It is preferred that the conductor roll pressed against the aluminum plate is always cooled by an electrolyte of the same composition and temperature as those of an electrolyte used for electrochemical graining treatment in order to prevent the generation of an arc spot thereon. If a foreign matter is included in the electrolyte, it is likely to cause an arc spot. For this reason, it is preferred that countermeasures are taken where a spray used for cooling is wound with a filter cloth, a fine mesh filter is inserted into piping in the upstream of the spray pipe or the like.

b) Electrochemical Graining Treatment Using AC

Although for AC power supply waveforms used for electrochemical graining treatment, a sine wave, a rectangular wave, a trapezoidal wave, a triangular wave and the like can be used, a rectangular wave or a trapezoidal wave is preferred and particularly preferred is a trapezoidal wave. It is preferred that a frequency is 0.1 to 500 Hz, further preferred is 40 to 120 Hz and particularly preferred is 45 to 65 Hz.

It is preferred that if a trapezoidal wave is used, a time tp that a current reaches a peak from zero is 0.1 to 2 msec and particularly preferred is 0.3 to 2 msec (0.2 to 1.5 msec in the second and third Embodiments according to the present invention). If tp is less than 0.1 due to the affection of impedance in a power supply circuit, a cost for power supply facilities is higher since a larger power supply voltage is required at the start of a current waveform. If tp is larger than 2 msec, even graining is hardly performed since the surface of an aluminum plate is likely to be affected by trace components contained in an electrolyte. It is preferred that the percentage of anodic reaction time ta on an aluminum plate occupying in a frequency T of AC, ta/T (referred to as "duty" in the present invention), which is the condition of one cycle of AC used for electrochemical graining treatment, is 0.33 to 0.66, further preferred is 0.45 to 0.55 and particularly preferred is 0.5.

An oxidized layer mainly containing aluminum hydroxide is produced on the surface of the aluminum plate at the time of cathodic reaction and the oxidized layer may be further dissolved and broken. And, if the oxidized layer is dissolved or broken, an area that is dissolved or broken becomes the initiating point of pitting reaction at the time of the next anodizing reaction of the aluminum plate. Consequently, the selection of AC duty is extremely important in performing even electrochemical graining treatment.

In the first to the third Embodiments according to the present invention, for a quantity of electricity applied to an aluminum plate opposite to a principal electrode, the ratio of a quantity of electricity Qc at the time of cathodic reaction on an aluminum plate (a quantity of electricity Qc in the cathodic state in the an aluminum plate to which AC is applied) to a quantity of electricity Qa at the time of anodic reaction on the aluminum plate (a quantity of electricity Qa in the anodic state in the an aluminum plate to which AC is applied), Qc/Qa, is within a range of 0.9 to 1.0, preferred is 0.92 to 0.98 and particularly preferred is 0.94 to 0.96. If the Qc/Qa remains in this range, processing unevenness is not generated by graining treatment, the surface shape of an aluminum plate is unified and both press life and printing performance (scum resistance) can be achieved when a lithographic printing plate is prepared. In addition, if the Qc/Qa exceeds 1.0, an electrode may be melted. This ratio of quantity of electricity can be controlled by controlling voltage generated by a power supply.

If electrolytic graining treatment is performed by using AC electrolytic cell having an auxiliary electrode which shunts the anodic current of a principal electrode, the Qc/Qa can be controlled by controlling the current value of an anodic current which is shunted to an auxiliary electrode as described in JP 60-43500 A and JP 1-52098 A. In the present invention, this ratio of quantity of electricity can be controlled by controlling the shunt ratio to the auxiliary electrode.

It is preferred that for an current density at the peak value of trapezoidal wave, both anode cycle side of current Ia and cathode cycle side of current Ic are 10 to 200 A/dm$^2$. It is preferred that Ia/Ic is in a range of 0.5 to 3.

Although for an electrolytic cell used for electrochemical graining treatment using AC in the present invention, electrolytic cells used for publicly known surface treatments such as a vertical type, a flat type and a radial type may be used, particularly preferred are a radial type electrolytic cell as described in JP 5-195300 A or a flat type. It is particularly preferred that for an electrode, a principal electrode uses carbon and an auxiliary electrode uses ferrite.

In addition, electrolytic graining treatment equipment where a plurality of AC electrolytic cells are disposed in series can be suitably used.

Although an electrolytic cells having an auxiliary anode is disposed before or after an electrolytic cell having a principal electrode, it is preferred that particularly, an electrolytic cell having an auxiliary electrode used in electrochemical graining treatment mainly using hydrochloric acid is positioned before an electrolytic cell having a principal electrode since the generation of processing unevenness can be reduced.

In addition, if a distance between the inlet (solution level) of an electrolytic cell having an auxiliary electrode and the inlet (solution level) of an electrolytic cell having a principal electrode is too far, an intermetallic compound in an aluminum plate is melted to form a deep hole by the chemical melting reaction with hydrochloric acid, the photosensitive layer on that area is thickly coated, thus causing unevenness at the time of printing. For that reason, it is preferred that the moving time of an aluminum plate between the inlet (solution level) of an electrolytic cell having an auxiliary cell and that (solution level) of an electrolytic cell having a principal electrode is five seconds or less.

In one AC electrolytic cell or two AC electrolytic cells in electrolytic graining treatment, there provided is an idle period one time or more, and these principal electrodes where AC does not flow between an aluminum plate positioned between principal electrodes which are connected to power supply terminals of different polarities in one electrolytic cell and these principal electrodes, it is preferred that if the length of the idle period is set to 0.001 to 0.6 sec, a honeycomb pit can be evenly formed on entire surface of an aluminum plate. More preferred is 0.005 to 0.55 sec and further preferred is 0.01 to 0.5 sec.

If 2 or more AC electrolytic cells which are disposed in series are used, it is preferred that a period of time in which a current does not flow between one AC electrolytic cell and other AC electrolytic cell(s) is 0.001 to 20 seconds, more preferred is 0.1 to 15 seconds, and most preferred is 1 to 12 seconds.

Figure 2:
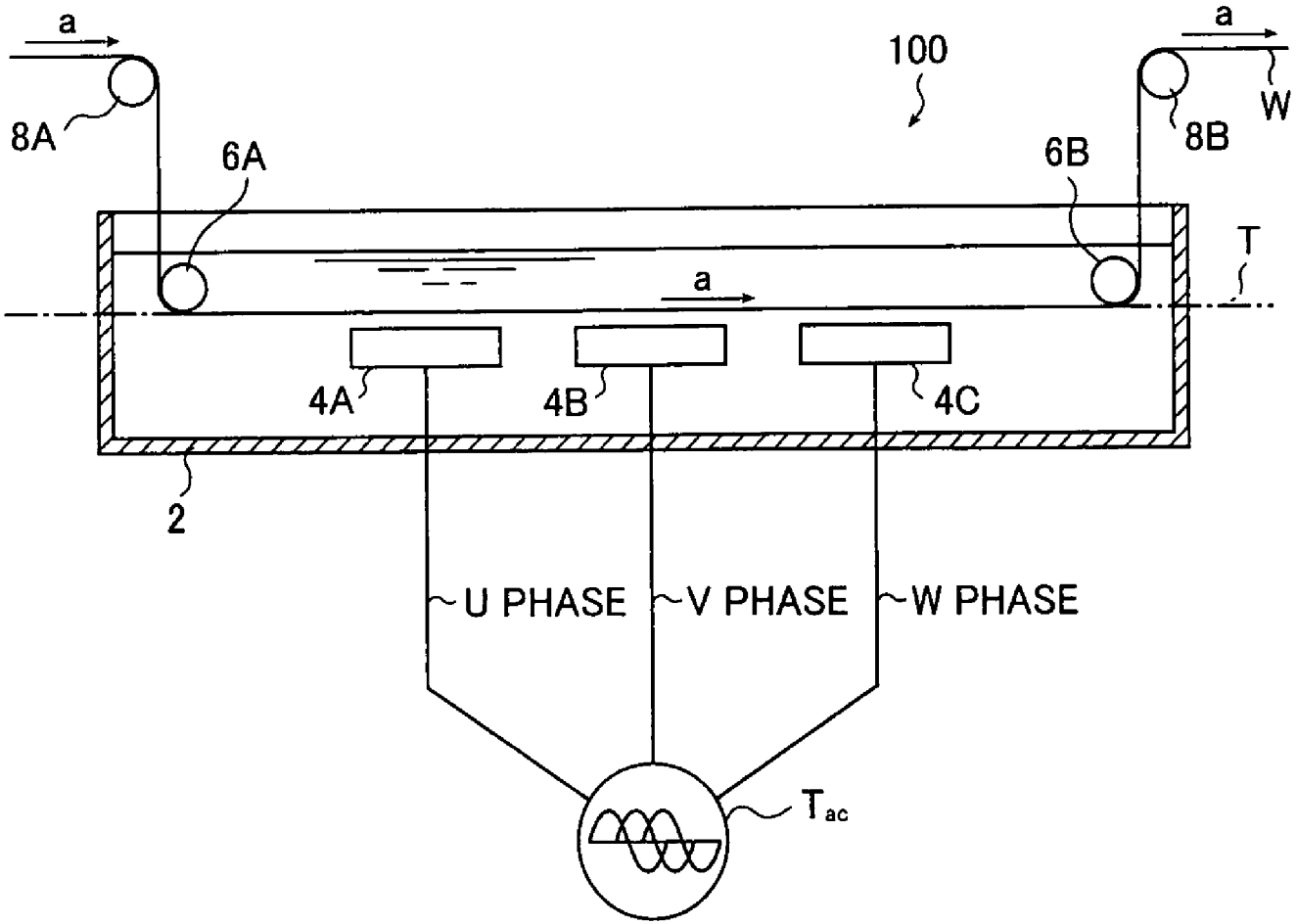
FIG. 2 is a sectional view showing an example of an electrolytic graining processing equipment provided with a flat type Alternating current electrolytic cell according to the present invention.

FIG. 2 shows a sectional mimetic diagram of one example of electrolytic graining treatment equipment provided with a flat type AC electrolytic cell suitably used in the present invention. In FIG. 2, 2 represents AC electrolytic cell, 4A, 4B and 4C represent principal electrodes, 6*a* and 6*B* represent transfer rollers, 8A represents incoming roller, 8B represents outgoing roller and 100 represents electrolytic graining treatment equipment. Electrolytic graining treatment equipment 100 is an electrolytic graining treatment equipment where electrolytic graining treatment is performed by applying three-phase AC (hereinafter referred to as "three-phase alternating current") to an aluminum web W while the aluminum web W is transferred in an almost horizontal direction.

Electrolytic graining treatment equipment 100 is provided with shallow box-like AC electrolytic cell 2 extended along a transfer direction "a" of the aluminum web W and with the upper side thereof opened, three platy principal electrodes 4A, 4B and 4C disposed in the vicinity of the bottom face of the AC electrolytic cell 2, along the transistor direction "a", and parallel to transfer plane T which is the transfer path for the aluminum web W, transfer rollers 6A and 6B which are disposed on the upstream side (hereinafter merely referred to as "upstream side") of the transfer direction "a" inside the AC electrolytic cell 2 and in the vicinity of the end of the downstream side (hereinafter merely referred to as "downstream side") to transfer direction "a" and which transfers an aluminum web W inside the AC electrolytic cell 2, incoming roller 8A which is positioned on the upstream side above the AC electrolytic cell 2 and introduces aluminum web W into the interior of AC electrolytic cell 2 and outgoing roller 8B which is positioned on the downstream side above the electrolytic cell 2 and discharges an aluminum web W which has passed through the interior of the AC electrolytic cell 2 to the outside of the AC electrolytic cell 2. The above-mentioned acid aqueous solution is stored inside the AC electrolytic cell 2.

The principal electrodes 4A, 4B and 4C are each connected to U terminal, V terminal and W terminal of an AC power supply Tac which generates three-phase current. Accordingly, a phase of AC applied to the principal electrodes 4A, 4B and 4C lags by 120' from each other.

Below described is the action of the electrolytic graining treatment equipment 100.

Aluminum web W is introduced inside the AC electrolytic cell 2 by incoming the roller 8A and is transferred at a constant speed by transfer rollers 6A and 6B along the transfer direction "a".

Inside the AC electrolytic cell 2, an aluminum web W is moved parallel to the principal electrodes 4A, 4B and 4C and AC is applied to an aluminum web W through the principal electrodes 4A, 4B and 4C. By this action, anodic reaction and cathodic reaction alternately take place in aluminum web W, when anodic reaction is taking place, a honeycomb pit is mainly produced, when cathodic reaction is taking place, an aluminum hydroxide layer is mainly produced, thereby the surface of the aluminum web is grained.

Since a phase of AC applied by the principal electrodes 4A, 4B and 4C lags by 120' from each other as described above, in the principal electrode 4B anodic reaction and cathodic reaction are repeated at a phase (V phase) which is lagged by 120' from a phase (U phase) at the principal electrode 4A and in the principal electrode 4C anodic reaction and cathodic reaction are repeated at a phase (W phase) which is lagged by 120' from a phase at the principal electrode 4B.

Accordingly, since in the aluminum web W, anodic reaction and cathodic reaction are repeated at a frequency of three times as compared to a case that the single phase alternating wave current of the same frequency is applied, a chatter mark which is a stripe in a width direction is hardly produced even if electrolytic graining treatment is performed at a higher transfer speed and current density.

Figure 3:
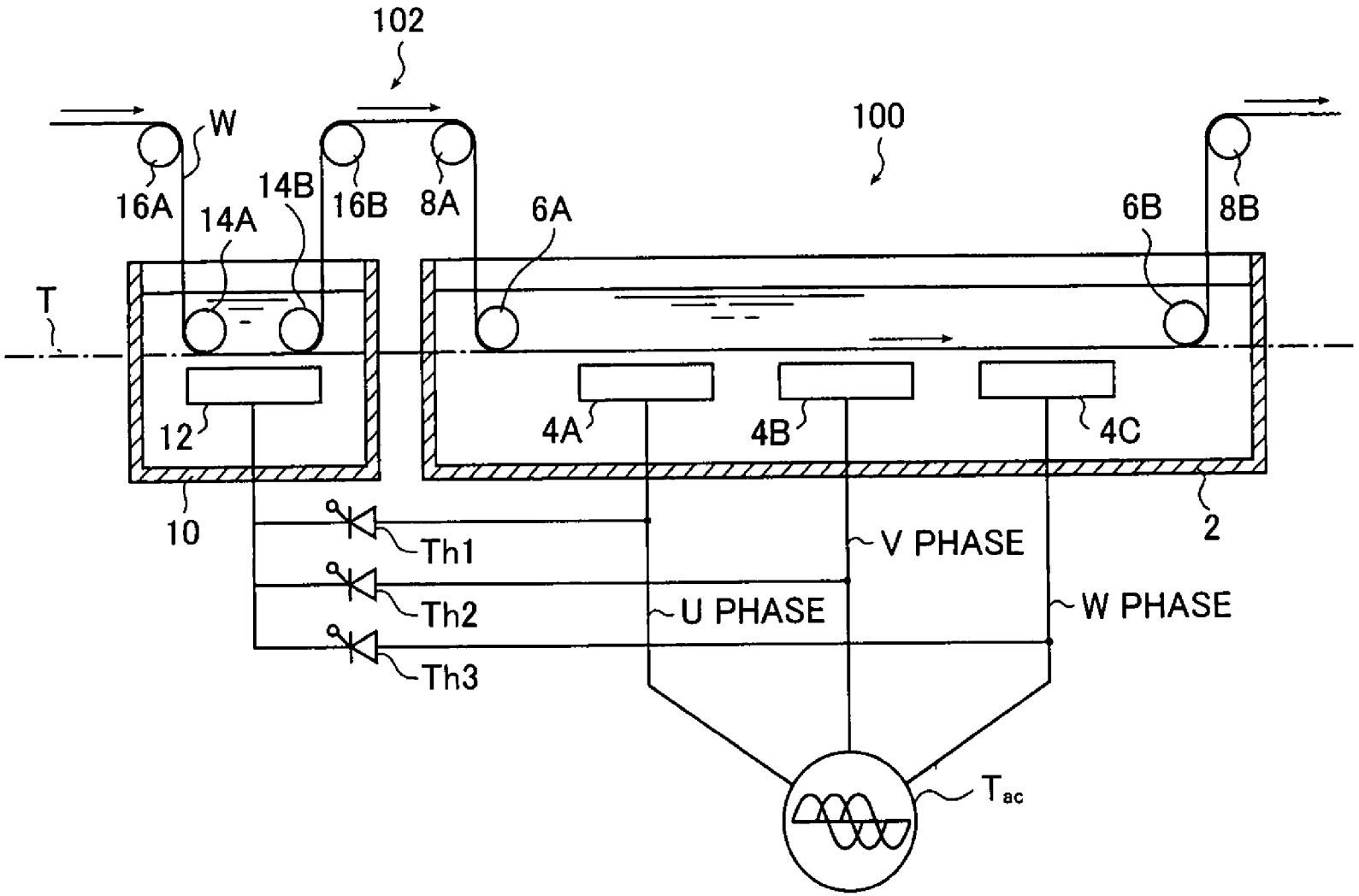
FIG. 3 is a sectional view showing another example of an electrolytic graining processing equipment provided with a flat type Alternating current electrolytic cell according to the present invention.

FIG. 3 shows a sectional mimetic diagram of another example of electrolytic graining treatment equipment provided with a flat type AC electrolytic cell suitably used in the present invention. In FIG. 3, the same symbols as in FIG. 2 show the same factors as those designated by the symbols in FIGS. 2 and 10 represents an auxiliary electrolytic cell, 12 represents an auxiliary electrode, 14A and 14B represent transfer rollers, 16A represents an incoming roller, 16B represents an outgoing roller, 102 represents an electrolytic graining treatment equipment and Th1, Th2 and Th3 represent thyristors.

The electrolytic graining treatment equipment 102 is an electrolytic graining treatment equipment where the auxiliary electrolytic cell 10 is disposed at the stage before the AC electrolytic cell 2 provided in the aforementioned electrolytic graining treatment equipment 100.

The auxiliary electrolytic cell 10 is a box type with the upper side opened and a platy auxiliary electrode 12 is provided parallel with the transfer plane T of aluminum web W in the vicinity of the bottom.

Transfer rollers 14A and 14B which transfer an aluminum web W above the auxiliary electrode 12 are disposed in the vicinity of the walls on the upstream side and the downstream side of the auxiliary electrolytic cell 10. In addition, an incoming roller 16A which introduces an aluminum web W into the interior of the auxiliary electrolytic cell 10 is provided on the upstream side above the auxiliary electrolytic cell 10 and an outgoing roller 16B which discharges an aluminum web W which has passed through the interior of the auxiliary electrolytic cell 10 to the outside is provided on the downstream above the auxiliary electrolytic cell 10. The aforementioned acid aqueous solution is stored inside the auxiliary electrolytic cell 10.

U phase, V phase and W phase of the AC power supply Tac are each connected to the auxiliary electrode 12, and thyristors Th1, Th2 and Th3 are interposed between each of the U phase, V phase and W phase and the auxiliary electrode 12. The thyristors Th1, Th2 and Th3 are so connected as to allow a current to flow from the AC power supply Tac to the auxiliary electrode 12 at the time of ignition. Even if either of thyristors Th1, Th2 and Th3 is, therefore, ignited, since an anodic current flows in the auxiliary electrode 12, the current value of an anodic current flowing in the auxiliary current 12 can be controlled by performing a phase control of the thyristors Th1, Th2 and Th3, a value of Qc/Qa can be controlled accordingly.

Figure 4:
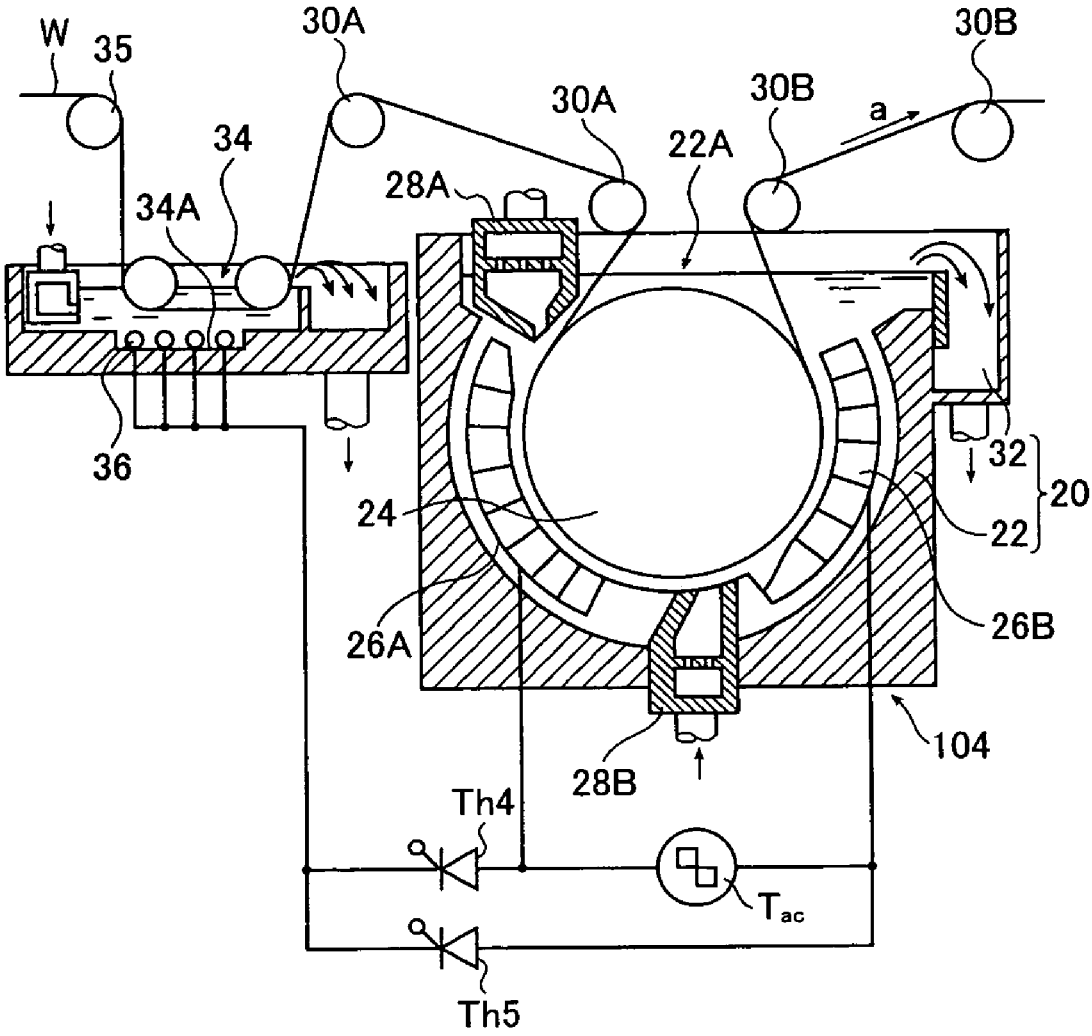
FIG. 4 is a sectional view showing an example of an electrolytic graining processing equipment provided with a radial type Alternating current electrolytic cell according to the present invention.

FIG. 4 shows a sectional mimetic diagram of one example of electrolytic graining treatment equipment provided with a radial type AC electrolytic cell suitably used in the present invention. In FIG. 4, 20 represents AC electrolytic cell, 22 represents an AC electrolytic cell body, 22A represents an aperture, 24 represents a feed roller, 26A and 26B represent principal electrodes, 28A and 28B represent solution supplying nozzles, 30A represents an upstream side guide roller, 30B represents a downstream side guide roller, 32 represents an overflow bath, 34 represents an auxiliary electrolytic cell, 34A represents a bottom of the auxiliary electrolytic cell, 35 represents an upstream side guide roller, 36 represents an auxiliary electrode, 104 represents an electrolytic graining treatment equipment and Th4 and Th5 represent thyristors.

The electrolytic graining treatment equipment 104 is provided with an AC electrolytic cell 20 having an AC electrolytic cell body 22 where an acid aqueous solution is stored and a feed roller 24 which is accommodated inside the AC electrolytic cell 22, is rotatably disposed around an axis extended in a horizontal direction and sends an aluminum web W in a transfer direction "a" from the left to the right in FIG. 4. The aforementioned acid aqueous solution is stored inside the AC electrolytic cell body 22.

The internal wall of the AC electrolytic cell body 22 is so formed in an almost cylindrical shape as to enclose the feed roller 24 and semicylindrical principal electrodes 26A and 26B which sandwich the feed roller 24 are provided on the internal wall. Principal electrodes 26A and 26B are divided into a plurality of small electrodes and insulating spacers are interposed between each electrode. A small electrode may be formed by using graphite or metal for example, and a spacer may be formed by using PVC (poly vinyl chloride resin) for example. It is preferred that the thickness of a spacer is 1 to 10 mm. In addition, small electrodes divided by spacers are each connected to the AC power supply Tac even in either principal electrode 26A and 26B although it is simply shown in FIG. 4.

An aperture 22A is formed to introduce or discharge an aluminum web W into or from the AC electrolytic cell body 22 above the AC electrolytic cell 20. A solution supplying nozzle 28A is provided to replenish an acid aqueous solution into the AC electrolytic body 22 in the vicinity of the aperture 22A in the AC electrolytic cell body 22. In addition, a solution supplying nozzle 28B is separately provided.

A group of upstream side guide rollers 30A which introduce an aluminum web W into the interior of the AC electrolytic cell 22 and a group of downstream side guide rollers 30B which discharge an aluminum web W on which electrolytic graining treatment has been performed in the AC electrolytic cell body 22 to the outside are provided in the vicinity of the aperture 22A above the AC electrolytic cell 20.

The AC electrolytic cell 20 is provided with an overflow bath 32 adjacent to the downstream of the AC electrolytic cell body 22. The aforementioned acid aqueous solution is stored inside the overflow bath 32. The overflow bath 32 has a function to temporarily store an acid aqueous solution overflowed from the AC electrolytic cell 22 and keep the level of the acid aqueous solution constant in the AC electrolytic cell body 22.

An auxiliary electrolytic cell 34 is provided on the front stage (upstream side) of the AC electrolytic cell body 22. The auxiliary electrolytic cell 34 is shallower than the AC electrolytic cell 22 and the bottom 34A is formed in a plane. And, a plurality of cylindrical auxiliary electrodes 36 is provided on the bottom 34A. The aforementioned acid aqueous solution is stored inside the auxiliary electrolytic cell 34.

The auxiliary electrodes 36 are preferably formed by using a metal with a high corrosion resistance such as platina, or a ferrite. Additionally, the auxiliary electrodes 36 may be in a plate form.

It is preferred that the auxiliary electrode 36 is connected parallel with the principal electrode 26A to the side to which the principal electrode 26A is connected at AC power supply Tac, and in the middle, a thyristor Th4 is so connected as to allow a current to flow from the side at the AC power supply Tac to the auxiliary electrode 36 at the time of ignition.

In addition, the side to which the principal electrode 26B at AC power supply Tac is connected is also connected to the auxiliary electrode 36 via thyristor Th5. The thyristor Th5 is also so connected as to allow a current to flow from the side to which the principal electrode 26B at AC power supply Tac is connected to the auxiliary electrode 36 at the time of ignition.

If either thyristor Th4 or Th5 is ignited, an anodic current flows in the auxiliary electrode 36. Accordingly, the current value of an anodic current which flows in the auxiliary electrode 36 can be controlled by performing phase control of the thyristors Th4 and Th5 and a value of Qc/Qa can be also controlled.

Below described is the action of the electrolytic graining treatment equipment 104.

In FIG. 4, from the left hand, an aluminum plate W is first guided by the upstream side guide roller 35 into the interior of the auxiliary electrolytic cell 34 and is next guided by the upstream side roller 30A to the AC electrolytic cell body 22, is then transferred by the feed roller 24 from the left hand to the right hand in FIG. 4 and is discharged by the downstream side guide roller 30B.

In the AC electrolytic cell body 22 and auxiliary electrolytic cell 34, graining treatment is performed on the surface of an aluminum web W, which faces the principal electrodes 26A and 26B to form an almost even honeycomb pit by AC applied to the principal electrodes 26A and 26B and an anodic current applied to the auxiliary electrode 36.

Next, described are the different points of electrochemical graining treatment in the fourth Embodiment according to the present invention from the first Embodiment to the third Embodiment according to the present invention.

For electrochemical graining treatment in the fourth Embodiment according to the present invention, electrolytic graining is performed on the aluminum plate in hydrochloric acid. Applying a current is started within five seconds after the aluminum plate is soaked into a hydrochloric solution in the above electrolytic graining treatment. Therefore, electrolytic graining treatment may be started just after the aluminum plate is soaked into the hydrochloric acid solution. If a time from soaking the aluminum plate into a hydrochloric acid solution to starting electrolytic graining treatment is within five seconds, a formation of uneven profile irregularities caused by dropping of intermetallic compounds from the surface of the aluminum plate can be prevented since its surface is not excessively eroded in the hydrochloric acid solution.

If electrolytic graining treatment is performed by using an aluminum web as the aluminum plate while the aluminum web is continuously transferred, a time from soaking of the aluminum web into a hydrochloric acid solution to starting performing electrolytic graining treatment on it can be set within five seconds by setting a distance between the level of a hydrochloric acid solution stored in the electrolytic cell later described and a principal electrode provided in the electrolytic cell along the transfer direction of the aluminum web so as to allow the aluminum web to be transferred within five seconds.

It is desirable that in an electrolytic cell, the travelling path of an aluminum plate and a principal electrode are so disposed as to allow a distance between an aluminum plate transferred therein and the principal electrode to be 5 to 100 mm, preferably 8 to 15 mm. It is preferred that the principal electrode is formed of carbon.

It is preferred that an average relative flow velocity of an aluminum plate transferred in an electrolytic cell and a hydrochloric acid solution flowing in the electrolytic cell is in a range of 100 to 4,000 mm/sec and particularly preferred is a range of 15 to 300 mm/sec. As long as the above average relative flow velocity is within the above range, the flowing direction of the nitric acid aqueous solution or a hydrochloric acid aqueous solution may be the same direction as the transfer direction of the aluminum plate or the reverse direction to that of the aluminum plate.

In addition, it is desirable that a distance between the travelling path of the aluminum plate and the principal electrode, and the flow rates of the nitric acid aqueous solution and a hydrochloric acid solution are kept constant to perform even electrolytic graining treatment.

In flat type and vertical type electrolytic cells, the above distance can be kept constant by providing a plane so formed inside the electrolytic cell as to allow a traveling aluminum plate to be able to slide and by allowing the aluminum plate to travel while pressing it by using a static pressure, as described in JP 61-30036 B.

On the other hand, in a radial type electrolytic cell, a distance between the principal electrode and the aluminum plate can be kept constant by providing a roller with a large diameter which transfers the aluminum plate inside the electrolytic cell and by disposing a plurality of electrodes on the circumference of the roller so as to enclose the roller, as described in JP 8-300843 A.

In addition, the flow rates of the nitric acid aqueous solution and hydrochloric acid aqueous solution may be kept constant by providing a solution receiving chamber inside an electrolytic cell and by supplying the nitric acid aqueous solution and hydrochloric acid aqueous solution using a solution feed nozzle provided with a slit with a width of 1 to 5 mm for blowing a solution along the width direction of an aluminum plate traveling inside. In addition, a solution amount blown from each slit of the feed nozzle may be controlled by providing a plurality of solution receiving chambers and connecting each solution receiving chamber with a pipe line provided with a valve and a flowmeter.

As a power supply system to an aluminum plate traveling inside the electrolytic cell, for example, there are a direct power supply system using a conductor roller and a solution type power supply system dispensing with the conductor roller, in other words, an indirect power supply system.

In the electrolytic cell, a current value can be controlled by using a transformer, a variable induction regulator and the like if an indirect power supply system is adopted.

The ratio of quantity of electricity, $Q_c/Q_a$ can be controlled by providing an auxiliary electrode which applies DC besides the principal electrode inside an electrolytic cell and controlling the intensity of DC flowing in the auxiliary electrode. The auxiliary electrode can be formed of ferrite or the like.

Taken up as methods for controlling a current flowing in an auxiliary electrode are a phase control by controlled rectifiers such as a thyristor and GTO and control by a diode and variable resistor and the like as described in JP 6-37716 B and JP 5-42520 B. An influence by the anhysteretic state of a transformer can be reduced if a current flowing in the auxiliary electrode is controlled and it is very economical since a power supply can be prepared at a cheap price.

Figure 6:
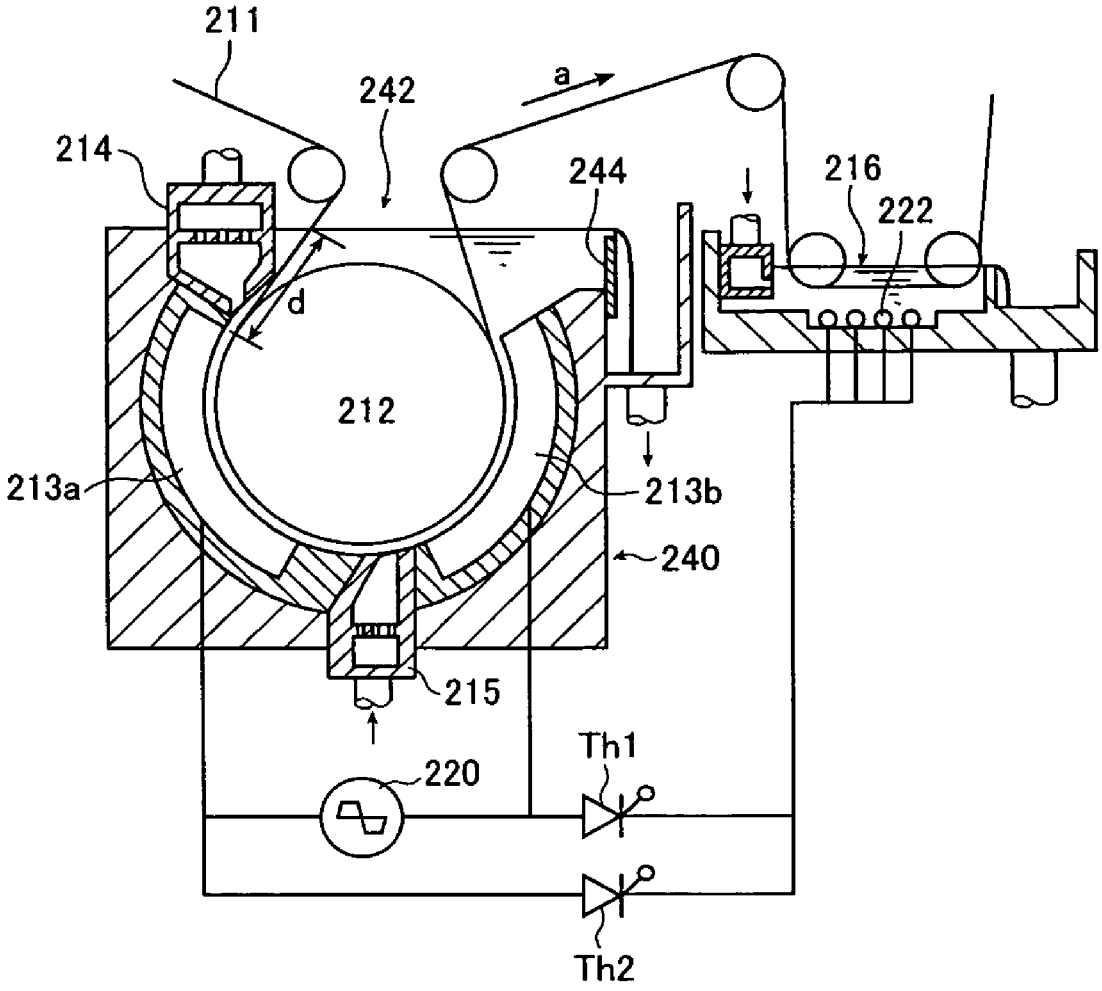
FIG. 6 is a sectional view showing an example of a radial type electrolytic cell used in the method for preparing a support for a lithographic printing plate according to the present invention.

FIG. 6 shows a sectional view of one example of a radial electrolytic cell used in a preparing method of a support for a lithographic printing plate according to the present invention.

In FIG. 6, 220 represents an AC power supply, 211 represents an aluminum web, 212 represents a transfer drum, 213*a* and 213*b* represent principal electrodes, 214 and 215 represent electrolyte supplying nozzles, 216 represents an auxiliary electrolytic cell, 222 represents an auxiliary electrode, 240 represents an electrolytic cell, 242 represents an aperture and 244 represents weir.

The electrolytic cell 240 has an aperture at the upper section 242 which introduces/discharges an aluminum web 211 into/from and accommodates a transfer drum 212 which transfers the aluminum web 211 introduced through the aperture 242 in a direction of an arrow mark "a" therein as shown in FIG. 6.

A pair of principal electrodes 213*a* and 213*b* is so disposed as to enclose the transfer drum 212 on the internal wall of the electrolytic cell. The principal electrode 213*a* is so disposed as to allow the aluminum web 211 to pass through a distance "d" between the level of a hydrochloric acid solution stored in the electrolytic cell 240 and the upper end of the principal 213*a*, along the transfer direction of the aluminum web 211 within five seconds. Both principal electrodes 213*a* and 213*b* are connected to an AC power supply 220.

An electrolyte supplying nozzle 214 which supplies a hydrochloric acid solution to the electrolytic cell 240 adjacent to the upper section of the principal electrode 213*a* is provided and an electrolyte supplying nozzle 215 to similarly supply a hydrochloric acid solution between the principal electrodes 213*a* and 213*b* and the bottom of the electrolytic cell 240 is provided. A hydrochloric acid solution supplied among the electrolyte supplying nozzle 214 and electrolyte supplying nozzle 215 overflows from a weir 244 provided on the downstream side of the aperture 242 to the downstream side of the electrolytic cell 240.

An auxiliary electrolytic cell 216, which is adjacent to the downstream side of the electrolytic cell 240 and applies DC voltage to the aluminum web 211, is provided.

The aluminum web 211 that has passed through the electrolytic cell 240 is transferred along the bottom plane of the auxiliary electrolytic cell 216.

A bar auxiliary electrode 222 extended along the width direction of a transfer plane which is a transfer path of the aluminum web 211 is provided on the bottom plane of the auxiliary electrolytic cell 216. The auxiliary electrode 222 is connected to a pair of thyristors Th1 and Th2 which are connected to the AC power supply 220 and DC on which phase control is performed by the thyristors Th1 and Th2 is applied thereto.

If a direct power supply system is used, a conductor roller which is cast using an industrial aluminum where Al—Fe system crystallization on a surface area thereof is changed to a single layer $Al_3Fe$ by performing a high-temperature homogenization processing to improve corrosion resistance can be used as described in 58-177441 A. In addition, an electrolytic cell where the above-described conductor roller is disposed at the incoming section of an aluminum plate in a flat or vertical type electrolytic cell or at both the incoming section and the outgoing section of the aluminum plate can be also used as described in JP 56-123400 A.

Although in the electrolytic cell, a conductor roller may be so provided as to contact with the upper side or lower side of an aluminum plate, it is preferred that the conductor roller is so provided as to contact with the upper side and particularly preferred is pressing it against an aluminum plate by a nip device. It is preferred that the length where an aluminum plate contacts with a conductor roller is 1 to 300 mm to the forwarding direction of an aluminum plate. It is preferred that a pass roller which sandwiches an aluminum plate and is opposite to a conductor roller is a rubber roller which has a barrel made of rubber. The pressing pressure of the conductor roller and the hardness of the barrel of the rubber roller can be voluntarily set under the conditions that an arc spot is not generated at a place where the conductor roller contacts with the aluminum plate. It is easier to replace and inspect a conductor roller by allowing a conductor roller to contact with the upper side of an aluminum plate. It is preferred that a system to supply power while allowing a power supplying brush to slide on a rotary unit is used for the end of a conductor roller.

It is preferred that the conductor roller is always cooled by the hydrochloric acid aqueous solution to prevent the generation of an arc spot.

It is preferred that in the fourth Embodiment according to the present invention, a current is so applied as to allow the ratio $Q_1/Q_2$ of anodizing quantity of electricity $Q_1$ which is an quantity of electricity at the time of anode on an aluminum plate in electrolytic graining treatment in a nitric acid aqueous solution and anodizing quantity of electricity $Q_2$ which is an quantity of electricity at the time of anode on an aluminum plate in electrolytic graining treatment in the hydrochloric acid aqueous solution to be 1 or more.

Concretely, it is preferred that a current is so applied as to allow the anodizing quantity of electricity $Q_1$ to be 40 to 400 $C/dm^2$.

(4) Recycling of Wastewater in Graining Treatment

It is preferred that a solution (a wastewater) used for each graining treatment is recycled as much as possible.

With a caustic soda aqueous solution where an aluminum ion is dissolved, aluminum and caustic soda can be separated by crystallization method. With respect to a sulfuric acid aqueous solution, a nitric acid aqueous solution or a hydrochloric acid aqueous solution where an aluminum ion is dissolved, sulfuric acid, nitric acid and hydrochloric acid can be recovered by electrodialysis or an ion exchange resin.

With a hydrochloric acid aqueous solution where an aluminum ion is dissolved, a recovery by evaporation as described in JP 2000-282272 A may be also performed.

It is preferred that in the present invention, the wastewater of an electrolyte used in electrochemical graining treatment is used for desmutting treatment (the first, second and third desmutting treatments).

In addition, it is preferred that electrochemical graining treatment or desmutting treatment which is performed before anodizing treatment uses the same kind solution as in graining treatment or anodizing treatment which is performed after desmutting treatment and particularly preferred is using the same composition solution as in the treatments. This treatment can dispense with a water washing treatment which is provided between desmutting treatment and the next process, thereby enabling to simplify facilities and reduce a wastewater quantity.

<Chemical Etching Treatment in Alkali Aqueous Solution (Second and Third Alkali Etching Treatments)>

It is preferred that in the first Embodiment according to the invention, the second alkali etching treatment is performed before anodizing treatment after electrochemical graining treatment. With this processing, a lithographic printing plate where the surface shape of an aluminum plate is even and is excellent in press life and printing performance can be obtained.

It is preferred that in the second embodiment to the fourth Embodiment according to the present invention, the second alkali etching treatment is performed before the second electrochemical graining treatment after the first electrochemical graining treatment. The second electrochemical graining treatment can be evenly performed by this treatment and a lithographic printing plate where the surface shape of an aluminum plate is even and is excellent in press life and printing performance can be obtained. In addition, the third alkali etching treatment is performed before anodizing treatment and after the second electrochemical graining treatment. This treatment can remove a smut component (the main component is aluminum hydroxide) produced in the second electrochemical graining treatment and a lithographic printing plate where the surface shape of an aluminum plate is even and is excellent in press life and printing performance can be obtained.

For the second and third alkali etching treatments, etching is performed by allowing the aluminum plate to contact with an alkali aqueous solution. The kind of alkali, method for allowing an aluminum plate to contact with an alkali aqueous solution and equipment used therefor, which are the same as those in the first alkali etching can be taken up.

Taken up as alkalis used for alkali aqueous solutions are the same ones as those used in the first alkali etching.

Although the concentration of an alkali solution can be determined in accordance with an amount of etching, preferred is 0.01 to 80 wt %. It is preferred that the temperature of an alkali solution is 20 to 90° C. It is preferred that a treatment time is 1 to 60 seconds.

It is preferred that in the second alkali etching treatment in the first Embodiment according to the present invention, the amount of etching of an aluminum plate (a surface on which electrolytic graining treatment is performed) is 0.001 to 30 $g/m^2$, more preferred is 0.1 to 2 $g/m^2$ and particularly preferred is 0.1 to 0.6 $g/m^2$.

It is preferred that in the second alkali etching treatment in the second and the third Embodiments according to the present invention, the amount of etching of an aluminum plate (a surface on which electrolytic graining treatment is performed) is 0.001 to 30 $g/m^2$, more preferred is 0.1 to 4 $g/m^2$ and particularly preferred is 0.2 to 1.5 $g/m^2$.

It is preferred that in the second alkali etching treatment (an alkali etching treatment following an electrolytic graining treatment in a nitric acid solution) in the fourth Embodiment according to the present invention, the amount of etching of aluminum plate is 0.05 to 5 $g/m^2$, more preferred is 0.05 to 4 $g/m^2$ and particularly preferred is 0.2 to 3.5 $g/m^2$.

It is preferred that in the third alkali etching treatment in the second Embodiment according to the present invention, the amount of etching of an aluminum plate (a surface on which electrolytic graining treatment is performed) is 0.001 to 30 $g/m^2$, more preferred is 0.1 to 2 $g/m^2$ and particularly preferred is 0.1 to 0.6 $g/m^2$.

It is preferred that in the third alkali etching treatment in the third Embodiment according to the present invention, the amount of etching of an aluminum plate (a surface on which electrolytic graining treatment is performed) is 0.001 to 30 $g/m^2$, more preferred is 0.1 to 4 $g/m^2$ and particularly preferred is 0.2 to 1.5 $g/m^2$.

It is preferred that in the third alkali etching treatment (an alkali etching treatment following an electrolytic graining treatment in a hydrochloric acid solution) in the fourth Embodiment according to the present invention, the amount of etching of aluminum plate is 0.05 to 5 $g/m^2$, more preferred is 0.05 to 4 $g/m^2$ and particularly preferred is 0.1 to 3 $g/m^2$.

<Desmutting Treatment in Acid Aqueous Solution (Second and Third Desmutting Treatments)>

It is preferred that the second desmutting treatment is performed after the second alkali etching treatment in the present inventions. With the treatment performing, the second electrochemical graining treatment can be more evenly performed.

In addition, it is preferred that the third desmutting treatment is performed after the third alkali etching treatment in the present inventions. This treatment can remove a hydroxide produced in the third alkali etching treatment and a lithographic printing plate with a high contact characteristics between the support and a photosensitive layer can be obtained.

The second and third desmutting treatments are performed, for example, by allowing the aluminum plate to contact with an acid aqueous solution of a concentration of 0.5 to 30 wt % (containing an aluminum ion at 0.01 to 5 wt %), such as phosphoric acid, hydrochloric acid, nitric acid and sulfuric acid. As a method for allowing an aluminum plate to contact with an acid solution, the same one as in the first desmutting treatment are taken up.

It is preferred that in the second and third desmutting treatments, the wastewater of a sulfuric acid solution discharged in an anodizing treatment later described is used as an acid solution. In addition, in place of the wastewater, a sulfuric acid solution with the concentration of sulfuric acid of 100 to 600 g/L and with the concentration of aluminum ion of 1 to 10 g/L at the solution temperature of 60 to 90° C. can be also used.

It is preferred that the temperature of a solution in the second and third desmutting treatments is 25 to 90° C. In addition, it is preferred that the treatment time of the second and third desmutting treatments is 1 to 180 seconds. Aluminum and an aluminum alloy component may be dissolved in an acid solution used for the second and third desmutting treatments.

Although in the fourth Embodiment according to the present invention, the second and third desmutting treatments are the same one as in the first desmutting treatment, it is preferred that in desmutting treatment (second) performed after the alkali etching treatment (second), a sulfuric acid solution which contains 8 to 35 wt % of sulfuric acid is used as an acid solution. It is preferred that in desmutting treatment (third) performed after the alkali etching treatment (third), a nitric acid aqueous solution which contains 0.5 to 1.5 wt % of nitric acid is used as the acid solution.

<Anodizing Treatment>

It is preferred that an anodized layer is formed by anodizing treatment on an aluminum plate after graining which is obtained by each treatment described above.

Namely, anodizing treatment is performed to increase the abrasion resistance on the surface of an aluminum plate. For an electrolyte used for anodizing treatment of an aluminum plate, any substances which forms a porous oxide can be used. Generally, sulfuric acid, phosphoric acid, oxalic acid, chromic acid or their mixtures are used.

The concentrations of these electrolytes are properly determined in accordance with the kind of an electrolyte.

Although the treatment conditions of anodizing can not be uniformly specified since they vary with an electrolyte used, it is generally suitable that the conditions are in ranges where the electrolyte concentration is 1 to 80 wt %, the temperature of electrolyte is 5 to 70° C., the current density is 1 to 60 $A/dm^2$, the voltage is 1 to 100 V and the electrolytic time is 10 to 300 seconds. Although a sulfuric acid treatment is normally performed in DC, AC can be also used.

It is proper that in the present invention, the quantity of an anodized layer is 1 to 5 $g/m^2$. If the quantity is less than 1 $g/m^2$, press life is insufficient, the non-image of a lithographic printing plate is likely to be scratched and an ink is simultaneously attached to a scarred area, so-called scar-caused scum is likely to take place. In addition, since an anodized layer is likely to concentrate on an aluminum edge area if the quantity of an anodized layer is increased, it is preferred that a difference in quantity of an anodized layer between an edge area and a central area in an aluminum plate is 1 $g/m^2$ or less.

Although anodizing treatment is normally performed by applying DC to an aluminum plate if a sulfuric acid aqueous solution is used as the acid electrolyte, anodizing treatment may be also performed by applying AC thereto.

Anodizing treatment in a sulfuric acid aqueous solution is detailedly described in JP 54-128453 A and JP 48-45303 A. It is preferred that the concentration of sulfuric acid is 10 to 300 g/L and the concentration of an aluminum ion is 1 to 25 g/L and it is particularly preferred that the concentration of an aluminum ion is set to 2 to 10 g/L by adding aluminum sulphate in 50 to 200 g/L (80 to 200 g/L in the fourth Embodiment according to the present invention) of a sulfuric acid aqueous solution.

It is preferred that the temperature of a electrolyte is 30 to 60° C. and more preferred is 30 to 55° C. in the fourth Embodiment according to the present invention.

If a DC method for performing anodizing treatment by applying DC is used, it is preferred that the current density is 1 to 60 A/dm$^2$ and particularly preferred is 5 to 40 A/dm$^2$. It is particularly preferred that if anodizing treatment is continuously performed on an aluminum sheet, anodizing treatment is first performed in a low current density of 5 to 10 A/dm$^2$ in order to prevent the concentration of a current called the burnout of an aluminum plate, setting of a current density is raised until the current density reaches 30 to 50 A/dm$^2$ or at a value over 30 to 50 A/dm$^2$ by gradually increasing the current density as it goes on later. It is preferred that the current intensity is gradually raised in 5 to 15 steps. An independent power supply is provided per each step and the current density is controlled by the current value of the power supply. It is preferred that a power supply method is a solution type power supply system dispensing with a conductor roller. One example thereof is described in JP 2001-11698 A.

It is of course suitable that a small quantity of trace elements contained in an aluminum plate is dissolved in a sulfuric acid aqueous solution. Since aluminum is eluted in a sulfuric acid aqueous solution where anodizing treatment is performed, it is necessary to control the concentrations of sulfuric acid and aluminum ion for the process control. If the concentration of aluminum ion is set at a lower value, it is necessary to frequently update a sulfuric acid aqueous solution with which anodizing treatment is performed, leading to problems that a treatment cost becomes higher and a load to the environment is also unavoidable as a wastewater is inevitably increased. In addition, if the concentration of aluminum ion is set at a higher value, it is not economical since an electrolytic voltage inevitably becomes higher and an electric power cost also increases. The following are the preferred concentrations of sulfuric acid and aluminum ion and solution temperature:

(No. 1)

Concentration of sulfuric acid: 100 to 200 g/L (further, 130 to 180 g/L)

Concentration of aluminum ion: 2 to 10 g/L (further, 3 to 7 g/L)

Temperature of solution: 30 to 40° C. (further, 33 to 38° C.)

(No. 2)

Concentration of sulfuric acid: 50 to 125 g/L (further, 80 to 120 g/L)

Concentration of aluminum ion: 2 to 10 g/L (further, 3 to 7 g/L)

Temperature of solution: 40 to 70° C. (further, 50 to 60° C.)

For power supplying system to an aluminum plate in anodizing treatment, a direct power supplying system which directly supplies an electric power to an aluminum plate and a solution type power supplying system which supplies an electric power to an aluminum plate through an electrolyte can be used.

Since the direct power supplying system is disadvantageous as there is a problem that a spark is generated between a conductor roll and an aluminum web when the process is operated at a high speed and a high current density, the direct power supplying system is often used for anodizing treatment equipment with a relatively lower speed and lower current density operated at a line speed of 30 m/min or less and the indirect power supplying system is often used for anodizing treatment equipment with a high speed and high current density operated at a line speed of over 30 m/min.

The indirect power supplying system can use a crossing-mountain type or a straight type bath layout as described on page 289 of the continuous surface treatment technology (published by Integrated Technology Center on Sep. 30, 1986).

It is particularly preferred that both the direct power supplying system and the indirect power supplying system are used in the following manner that in order to lower an energy loss caused by voltage drop in an aluminum web, an anodizing process is divided into two processes or more, DC power supply is connected to the power supplying bath through oxidation bath of each electrolytic equipment and to the conductor roll through the oxidation bath.

If the direct power supplying system is used, it is general that a conductor roll is made of aluminum. It is particularly preferred that in order to extend the service life of a roll, after casting is performed by using an industrial pure aluminum as described in JP 61-50138 B, high-temperature homogenization processing is performed on the casting, thereby Al—Fe system crystallization is converted into a single layer $Al_3Fe$, thus a corrosion resistance so improved conductor roll is used.

Since large current flows in anodizing process, Lorentz force acts on an aluminum plate due to a magnetic field caused by a current flowing in a bus bar. Since the Lorentz force-caused magnetic field triggers a problem that an aluminum web snakes, it is particularly preferred that a method as described in JP 57-51290 A is adopted.

In addition, since large current flows in an aluminum plate, Lorentz force acts toward the center in the width direction in an aluminum plate caused by the magnetic field due to the current flowing in the aluminum plate per se. Since the aluminum plate is like to be broken due to this phenomenon, it is particularly preferred that a method is taken in which a plurality of pass rollers with a diameter of 100 to 200 mm are provided at a pitch of 100 to 3,000 mm in an anodizing treatment bath and preventing the breakage by Lorentz force by lapping them at an angle of 1 to 15°.

In addition, the growth quantity of an anodized layer varies with in width direction of an aluminum plate and the quantity increases as it comes closer to the edge of an aluminum plate. As a result, there occurs a problem that an aluminum plate can not be smoothly wound by a reeler. This problem can be solved by agitating the flow of a solution in a method as described in JP 62-30275 B and JP 55-21840 B. If the problem can not be sufficiently solved by the method, it is particularly preferred that a method in which the reeler of an aluminum plate is oscillated at an amplitude of 5 to 50 mm and a frequency of 0.1 to 10 Hz in the width direction of an aluminum plate and thus winding the aluminum plate is used in combination with the agitation method.

Although the treatment is usually performed in DC in the sulfuric acid treatment, AC may be also used.

It is general that a continuous anodizing treatment uses a solution type power supplying system.

Although lead, iridium oxide, platinum, ferrite and the like are used as an anode which allows a current to flow in an aluminum plate, particularly preferred is an anode mainly containing iridium oxide. Iridium oxide coats a base material by heat treatment. Although used as base materials are titanium, tantalum, niobium, zirconium and the like, so-called bulb metals, particularly preferred is titanium or niobium. It is particularly preferred that since the bulb metals are of a relatively large electrical resistance, copper is used for a core and the core is bulb-metal clad. If a copper core is bulb-metal clad, a too much complicated shape can not be prepared. Then, it is general that after each devidedly prepared electrode part is coated with iridium oxide, they are so assembled with bolts and nuts to form a desired structure.

Since in the present invention, the solution transfer equipment and concentration controlling equipment of a desmutting treatment solution can be simplified to reduce the equipment cost, it is preferred that an acid wastewater generated in anodizing treatment is used for desmutting treatment (the first, second and third desmutting treatments).

<Treatment of Water Wettability>

Treatment of water wettability can perform a publicly known treatment of water wettability generally performed to prepare an aluminum support for a lithographic printing plate, and it is preferred that the treatment is performed with an alkali metal silicate and the details are described below.

The following treatments can be performed after water washing treatment on a support on which anodizing treatment has been performed, to suppress the dissolution of an anodized layer in a developer, remove residual layer of a photosensitive layer component, improve the strength of an anodized layer, improve the water wettability of an anodized layer, improve the contact characteristics between the supports and a photosensitive layer, and the like. Taken as one of the treatments is silicate treatment where treatment is performed by allowing an anodized layer to contact with an alkali metal silicate aqueous solution. In this case, an aluminum plate is allowed to contact with an aqueous solution in which the concentration of an alkali metal silicate is 0.1 to 30 wt %, preferred is 0.5 to 15 wt % and pH is 10 to 13.5 at 25° C., at a solution temperature of 5 to 80° C., preferred at 10 to 70° C. and more preferred at 15 to 50° C. for 0.5 to 120 seconds. A contacting method may be any of a soaking method, a spraying method or the like. If the pH of an alkali metal silicate aqueous water is less than 10, the solution is gelled, if higher than 13.5, there is a case where an anodized layer may be dissolved.

Used as alkali metal silicates in the present invention are sodium silicate, potassium silicate, lithium silicate and the like. Hydroxides used to control the pH of an alkali metal silicate aqueous solution are sodium hydroxide, potassium hydroxide, lithium hydroxide and the like. Moreover, alkali-earth metal salts or IVA group (4th group) metal salts may be blended in the treatment solution. Taken as alkali-earth metal salts are water-soluble salts such as nitrates such as calcium nitrate, strontium nitrate, magnesium nitrate and barium nitrate, or sulphates, hydrochlorides, phosphates, acetates, oxalates and borates. Taken up as IVA (4th group) group metal salts are titanium tetrachloride, titanium trichloride, potassium titanium fluoride, potassium titanium oxalate, titanium sulphate, titanium tetraiodide and zirconium oxide chloride and the like. For an alkali-earth metal or an IVA group (4th group) metal salt can be used as a single metal salt or a combination of two kinds or more. A preferred range of these metal salts are 0.01 to 10 wt % and further preferred is 0.05 to 5.0 wt %.

<Sealing Treatment>

Besides the above treatments, various sealing treatments are taken up and following methods which are generally known as sealing treatment methods on an anodized layer can be used; steam sealing, boiling water (hot water) sealing, metal salt sealing (such as chromates/dichromates and nickel acetate sealing), fat impregnation sealing, synthetic resin sealing, low temperature sealing (by potassium ferricyanide, alkali earth-metal salts and the like) and the like. Steam sealing is relatively preferred from the viewpoints of the performance of a support for a lithographic printing plate (an contact characteristics between the supports and a photosensitive layer or water wettability), high-speed treatment, low cost, low pollution and the like. Taken up as the method, for example, as also described in JP 4-176690 A is a pressurized or normal pressure steam is allowed to continuously or discontinuously contact with an anodized layer at RH 70% or higher and a steam temperature of 95° C. or higher for 2 to about 180 seconds. As another sealing treatment, there are a treatment where a support is soaked in a hot water at 80 to 100° C. or in an alkali aqueous water or these solutions are each sprayed to the support, in place of this treatment, or following the former treatment, soaking or spraying can be performed by using a nitrous acid aqueous solution. Taken up preferably as examples of nitrites contained in a nitrous acid solution for example are $LiO_2$, $NaNO_2$, $KNO_2$, $Mg(NO_2)_2$, $Ca(NO_2)_2$, $Zn(NO_3)_2$, $Al(NO_2)_3$, $Zr(NO_2)_4$, $Sn(NO_2)_3$, $Cr(NO_2)_3$, $Co(NO_2)_2$, $Mn(NO_2)_2$, $Ni(NO_2)_2$ and the like and particularly preferred is alkali metal nitrates. For nitrite, a combination of two kinds or more can be used.

Although treatment conditions can not be univocally determined since they are different from each other depending upon the conditions of a support and the kind of an alkali metal, if sodium nitrite is used for example, they may be selected from following ranges, that is, the concentration is generally 0.001 to 10 wt %, more preferred is 0.01 to 2 wt %, the bath temperature is generally from a room temperature to about 100° C., more preferred is 60 to 90° C. and the treatment time is generally 15 to 300 seconds, more preferred is 10 to 180 seconds. It is preferred that the pH of a nitrous acid aqueous solution is controlled in a range of 8.0 to 11.0, particularly preferred is being controlled in a range of 8.5 to 9.5. The pH of the nitrous acid aqueous solution can be controlled in the above range, for example, by using an alkali buffer solution. Although the alkali buffer solutions are not limited, suitably used are for example the mixed aqueous solution of sodium hydrogen carbonate and sodium hydroxide, the mixed aqueous solution of sodium carbonate and sodium hydroxide, the mixed aqueous solution of sodium carbonate and sodium hydrogen carbonate, the mixed aqueous solution of sodium chloride and sodium hydroxide, the mixed aqueous solution of hydrochloric acid and sodium carbonate, the mixed aqueous solution of sodium tetraborate and sodium hydroxide and the like. In addition, for the alkali buffer solution, alkali metal salts other than sodium salts, for example, potassium salts can be also used. After silicate treatment or sealing treatment such as the foregoing are performed, an acid aqueous solution treatment and water receptive undercoat as described in JP 5-278362 A may be performed and an organic layer as described in JP 4-282637 A and JP 07-314937 A may be provided to increase an contact characteristics between the supports and a photosensitive layer.

A method for preparing an aluminum support for a lithographic printing plate according to the present invention can also perform the below-mentioned treatments besides the foregoing treatments.

<Water Washing of Aluminum Plate>

After a treatment is performed on an aluminum plate in an acid aqueous solution or in an alkali aqueous solution or graining treatment is mechanically performed on the aluminum plate by using an abrasive, normally a washing process is provided to remove chemicals or abrasives from the surface of an aluminum plate.

It is general that a washing process is provided between treatment baths where the different kinds and compositions of chemicals are used. It is preferred that a time required to transfer an aluminum plate from a processing bath to a washing process or a time required to transfer the aluminum plate from the washing process to the bath for the next treatment is 10 seconds or less, particularly preferred is 0.1 to 10 seconds. If the time exceeds 10 seconds, there is a case where a chemical degradation on the surface of the aluminum plate is in progress and processing unevenness is likely to take place.

In addition, it is preferred that a distance between treatment baths which included a water washing process is equivalent to 15 seconds or less when the distance is converted into the passing time of an aluminum web and particularly preferred is 5 seconds or less. If the time exceeds 15 seconds, there is a case where a chemical degradation on the surface of an aluminum web is in progress and even processing is hardly performed in the next process.

When an aluminum plate is washed, it is preferred that the following methods are selected and preferred is a water washing system using a dry ice powder to reduce a wastewater.

(1) Water Washing

For a method for washing an aluminum support for a lithographic printing plate, it is a generally used method that the surface of an aluminum plate is washed by jetting water from spray chips after a solution is squeegeed from the surface thereof by a nip roller. It is preferred that water is jetted at an angle of 45 to 90° toward the downstream of the traveling direction of the aluminum plate. It is preferred that the jetting pressure of water is normally 0.5 to 5 kg/cm$^2$ at a pressure just before a jet nozzle and the solution temperature is 10 to 80° C. It is preferred that the moving speed of an aluminum plate traveling is 20 to 200 m/min. It is preferred that 0.1 to 10 L/m$^2$ of a solution is sprayed in one washing process. In one washing bath, a washing water is sprayed from at least two spraying tubes or more to the surface of an aluminum plate and also from at least two spraying tubes or more to the back side thereof. In one spraying tube, 5 to 30 spray chips are disposed at a pitch of 50 to 200 mm. It is preferred that the spraying angle of a spray chip is 10 to 150° and a distance between an aluminum plate and the spraying plane of a spray chip is 10 to 250 mm. Although for the sectional shape (spraying pattern) of spraying by a spray chip, there are circular, round, oblong, square, rectangular shapes and the like, it is preferred that the pattern is of round, oblong or square and rectangular ones. Although for a flow distribution (the water flow distribution condition of spraying water on the surface of an aluminum plate), there are a circular distribution, an even distribution, a mountain-type distribution and the like, it is preferred that the mountain-type distribution is used since an even flow distribution is easily materialized in the entire width when a plurality of spray chips are arranged on the spraying tube. A flow distribution varies with a spraying pressure and a distance between spray chips and an aluminum plate. Although the particle diameter of sprayed water varies with the structure of a spray chip, spraying pressure and spraying quantity, the preferred is 10 to 10,000 μm and particularly preferred is 100 to 1,000 μm. It is preferred that a spraying nozzle is made of a material which is of abrasive resistance to a solution flowing at a high rate. Although brass, stainless steel, ceramics and the like are used as the material, particularly preferred is a ceramic nozzle.

Although a spraying nozzle provided with spray chips can be disposed at an angle of 45 to 90° toward the forwarding direction of an aluminum plate, it is preferred that the longer center line of the center of a spray pattern is so allowed as to make a right angle with the forwarding direction of an aluminum plate.

It is preferred that a washing time during which an aluminum plate passes through a water washing process is industrially 10 seconds or less and particularly preferred is 0.5 to 5 seconds.

(2) Washing Using Dry Ice Powder

For a method for washing an aluminum plate by jetting a dry ice powder on both sides thereof, a publicly known shot-blast equipment as described in JP 10-66905 A can be used. For a jet nozzle, a plurality of publicly known jet nozzles as described in JP 10-28901 A and JP 10-28902 A can be arranged on both sides of an aluminum plate. Although jet nozzles may be aligned in a horizontal line, it is preferred that they are so disposed slantly as to allow spray patterns on the surface of an aluminum plate to be overlapped in the width direction of an aluminum plate. It is preferred that a distance between a spraying nozzle and an aluminum plate is 1 to 100 mm and particularly preferred is 10 to 50 mm.

In addition, a method for preparing a dry ice powder can use a preparing device as described in JP 7-38104 U. A gas for spraying can use GN2 gas or an air. A dry ice powder has a particle diameter of 1 to 1,000 μm and it is preferred that its average particle diameter is 10 to 100 μm. It is preferred that the supplied quantity of $LCO_2$ (liquefied carbon dioxide gas) per one spraying nozzle is 0.1 to 1 kg/min and a supplying pressure is 1 to 20 MPa. It is preferred that a washing pressure on an aluminum plate is 1 to 20 MPa.

<Material of Pass Roll>

A roll can be selected for use from a metal roll used for continuous production lines such as publicly known steel on the surfaces of which plating or lining processing is performed, plated product, electrolytic capacitor and PS board a resin roll, a rubber roll and a non-woven cloth roll.

The material and physical properties on the surface of a roll are selected, taking into account corrosion resistance, abrasion resistance, heat resistance, chemical resistance and the like depending upon chemicals or the conditions of the surface of an aluminum plate at the time of application. For a metal roll, a hard chrome plated roll is generally used. Rubber rolls can use natural rubber, isoprene rubber, styrene butadiene rubber, butadiene rubber, butyl rubber, chloroprene rubber, chlorosulfonated polyethylene rubber, nitrile rubber, acryl rubber, epichlorohydrin rubber, urethane rubber, polysulfide rubber, fluorocarbon rubber and the like as a matter of course, and rubbers to which a trace additive is added. It is particularly preferred that the hardness of a rubber roll is 60 to 90.

In accordance with a method for preparing an aluminum support for a lithographic printing plate in the first to third Embodiments according to the present invention detailedly described above, even when a low-purity aluminum plate (an aluminum plate containing much of an alloy component or an aluminum plate with an alloy component unadjusted) is used, an aluminum support for a lithographic printing plate with even profile irregularities on the surface thereof can be obtained. In addition, if a presensitized plate with a photosensitive layer provided as described later is prepared from an aluminum support for a lithographic printing plate with even profile irregularities on the surface which is obtained by a method for preparing an aluminum support for a lithographic printing plate in the first to third Embodiments according to the present invention, when a lithographic printing plate is prepared by making a plate therefrom, it is excellent in printing performance and press life.

Furthermore, in accordance with a method for preparing an aluminum support for lithographic printing plate in the first embodiment according to the present invention, an aluminum support for lithographic printing plate which can be used as an offset printing master can be obtained, and an aluminum support for lithographic printing plate which can be provided any of a photosensitive image forming material by infrared ray laser for a plate making which can be directly prepared from a digital signal from a computer or the like so-called direct plate making and image forming layers formed by a photopolymer image forming layer and an analog type positive image forming layer or a negative image forming layer can be obtained.

In accordance with a method for preparing a support for a lithographic printing plate in the fourth Embodiment according to the present invention, a support for a lithographic printing plate which is excellent in water receptivity, water wettability in a non-image area, press life, printing plate scum resistance of the printing plate and laser exposure suitability, and is the base material of a presensitized plate which can be suitably used as a lithographic printing plate for the direct plate making system and a directly drawn type lithographic printing plate, can be obtained.

Described are a presensitized plate and a lithographic printing plate using an aluminum support for a lithographic printing plate obtained according to the present invention and a method for preparing the same.

<Undercoat>

In the present invention, for example, inorganic undercoats such as water-soluble metal salts, e.g. zinc borate, or organic undercoats may be provided as required before a photosensitive layer is provided on an aluminum support for a lithographic printing plate according to the present invention thus obtained Taken up as organic compounds used for an organic undercoat for example are carboxymethylcellulose; dextrin; gum arabic; polymer or copolymer having sulfo group at side chain; polyacrylic acid; phosphonic acids having amino groups such as 2-aminoethyl phosphonic acid; organic phosphonic acids such as phenylphosphonic acid, naphthylphosphonic acid, alkylphosphonic acid, glycerophosphonic acid, methyldisuphosphonic acid and ethylenediphosphonic acid which may have a substituent; organic phosphoric acids such as; phenylphosphoric acid, naphthylphosphoric acid, alkylphosphoric acid and glycerophosphoric acid which may have a substituent; organic phosphinic acids such as phenylphosphinic acid, naphthylphosphinic acid, alkylphosphinic acid and glycerophosphinic acid which may have a substituent; amino acids such as glycine and β-alanine; amine hydrochlorides having hydroxy groups such as triethanolamine hydrochlorides; yellow dyes. For these compounds, either they may be singly used or a combination of two kinds or more may be used.

An organic undercoat is provided by dissolving the above organic compound in water or organic solvents such as methanol, ethanol, methylethylketone or their mixed solvent, applying the solvent to an aluminum plate and drying the solvent. It is preferred that the concentration of a solution dissolving the organic compound is 0.005 to 10 wt %. A coating method is not particularly limited and any of bar coater coating, rotary coating, spray coating, curtain coating and the like can be used.

It is preferred that the coated quantity after an organic undercoat is dried is 2 to 200 mg/m$^2$ and more preferred is 5 to 100 mg/m$^2$. If the coated quantity remains within the above range, press life becomes better.

[Presensitized Plate]

A support for a lithographic printing plate according to the present invention can be provided with an image recording layer to prepare a presensitized plate according to the present invention. A photosensitive composition is used for the image recording layer.

Taken up as photosensitive compositions suitably used for the present invention for example are a photosensitive composition of the thermal positive type containing an alkali-soluble high-molecular compound and a photothermal conversion agent (hereinafter referred to as "thermal positive type" with regard to this composition and an image recording layer using the same), a photosensitive composition of the thermal negative type containing a curable compound and a photothermal conversion agent (hereinafter similarly referred to as "thermal negative type"), a photosensitive composition of the photopolymerization type (hereinafter similarly referred to as "photo polymer type"), a photosensitive composition of the negative type containing diazo resin or photo cross-linkable resin (hereinafter similarly referred to as "conventional negative type"), a photosensitive composition of the positive type containing a quinonediazide compound (hereinafter similarly referred to as "conventional positive type") and a photosensitive composition dispensing with a special development (hereinafter similarly referred to as "development-dispensable type"). Below described are these suitable photosensitive compositions.

<Thermal Positive Type>

<Photosensitive Layer>

A photosensitive composition of the thermal positive type contains a water-insoluble and alkali-soluble high-molecular compound (referred to as "alkali-soluble high-molecular compound" in the present invention) and a photothermal conversion agent. In a image recording layer of the thermal positive the, a photothermal conversion agent converts the exposure energy of infrared ray laser and the like into heat, which efficiently cancels an interaction lowering the alkali-solubility of an alkali-soluble high-molecular compound.

Taken up as alkali-soluble high-molecular compound for example are a resin containing an acid group in a molecule and a mixture of two kinds or more of the resin. Particularly preferred is a resin having acid groups such as a phenolic hydroxy group, sulfonamide group (—$SO_2$NH—R (where, R represents a hydrocarbon group)), active imino group (—$SO_2$NHCOR, —$SO_2$NH$SO_2$R—CONH$SO_2$R (where, R has the similar meaning to the above.)) from the view point of the solubility of the resin to an alkali developer.

Above all, the one having the phenolic hydroxy group is preferable since it is excellent in image-forming capability in the exposure by an infrared ray laser or the like. For example, novolac resin such as phenol-formaldehyde resin, m-cresol-formaldehyde resin, p-cresol-formaldehyde resin, m-/p-mixed cresol-formaldehyde resin and phenol/cresol (any of m-, p- and m-/p-mixed may be allowed)-mixed-formaldehyde resin (phenolcresolformaldehyde cocondensation resin), are preferably cited. More specifically, the polymers described in JP 2001-305722 A (particularly, [0023] to [0042]), polymers containing a repeating unit expressed by a general formula (1) as described in JP 2001-215693 A and polymer as described in JP 2002-311570 A (particularly, [0107]) are preferably used.

The photothermal conversion agent converts exposure energy into heat to enable efficient release execution of an interaction in an exposed region of the thermosensitive layer. From a viewpoint of a recording sensitivity, pigment or dye, which has a light absorbing band in the infrared band ranging from 700 to 1200 nm in wavelength, is preferable. Concretely cited as the dye are azo dye, azo dye in the form of metallic complex salt, pyrazolone azo dye, naphthoquinone dye, anthraquinone dye, phthalocyanine dye, carbonium dye, quinonimine dye, methine dye, cyanine dye, squarylium dyestuff, pyrylium salt, metal thiolate complex (for example, nickel thiolate complex) and the like. Particularly, the cyanine dye is preferable and, for example, the cyanine dye represented by the general formula (I) in JP 2001-305722 A is cited.

A dissolution inhibitor can be contained in a photosensitive composition of the thermal positive type. Suitably taken up as a dissolution inhibitor is one as described in [0053] to [0055] of JP 2001-305722 A.

In addition, it is preferred that a sensitivity regulator, a printing agent to obtain an visible image just after heated by exposure, compounds such as dyes as colorant and a surfactant to improve coating property and treatment stability are contained in a photosensitive composition of the thermal positive type as additives. Compounds as described in [0056] to [0060] of JP 2001-305722 A are preferred for these compounds.

Besides the foregoing aspects, suitably used are photosensitive compositions as described in 2001-305722 A.

In addition, an image recording layer of the thermal positive type may be either a single layer or a two-layer structure.

Suitably taken up as the image recording layer of a two-layer structure (image recording layer of superimposed-type) is a type where a lower layer (hereinafter referred to as "A layer") excellent in press life and solvent resistance is provided on the side closer to a support and a layer (hereinafter referred to as "B layer") excellent in an image-forming capability of positive type is provided on the A layer. This type is of high sensitivity and can realize a broader development latitude. The B layer generally contains a photothermal conversion agent. The above-mentioned dyes are suitably taken up as photothermal conversion agents.

Suitably taken up as resins used for the A layer is a polymer which includes a monomer having sulfonamide group, active imino group, phenolic hydroxy group and the like as a copolymerization component since the polymer is excellent in press life and solvent resistance. Suitably taken up as resins used for the B layer is an alkali-soluble resin having a phenolic hydroxy group.

Various additives can be contained in compositions used for the A and B layers as required besides the aforementioned resins. Concretely, suitably used are various additives as described in [0062] to [0085] of JP 2002-3233769 A. In addition, also suitably used are additives as described in [0053] to [0060] of JP 2001-305722 A as aforementioned.

It is preferred that for each component and its content included in the A layer or the B layer, what is described in JP 11-218914 A is followed.

<Intermediate Layer>

It is preferred that an intermediate layer is provided between an image recording layer of the thermal positive type and a support. Suitably taken up as components contained in the intermediate layer are various organic compounds as described in [0068] of JP 2001-305722 A.

<Others>

A method for preparing an image recording layer of the thermal positive type and a method for making a plate can use a method as detailedly described in JP 2001-305722 A.

<Thermal Negative Type>

A photosensitive composition of the thermal negative type contains a curable compound and a photothermal conversion agent. An image recording layer of the thermal negative type is a photosensitive layer of the negative type where an area irradiated by an infrared ray laser or the like is cured to form image areas.

<Polymerization Layer>

A image recording layer of the polymerizable-type (polymerizable layer) is suitably taken up as a image recording layer of the thermal negative type. A polymerizable layer contains a photothermal conversion agent, a radical generator, a radical polymerizable compound which is a curing compound and a binder polymer. In the polymerizable layer, the infrared rays absorbed by a photothermal conversion agent are converted into heat, which decomposes a radical generator to generate radicals, which allows a radical polymerizable compound to continuously polymerize and a radical polymerizable compound is cures.

Taken up as a photothermal conversion agent for example is a photothermal conversion contained in the aforementioned the thermal positive type. Taken up as a concrete example of cyanine dye stuff which is particularly preferred are those as described in [0017] to [0019] of JP 2001-133969 A.

Onium salts are suitably taken up as radical generators. Particularly preferred are onium salts as described in [0030] to [0033] of JP 2001-133969 A.

Taken up as a radical polymerizable compound is a compound having at least one, and preferably two or more of the endethylenic unsaturated bondings.

A linear organic compound is suitably taken up as a binder polymer. Suitably taken up is a polymer which is soluble or swellable in water or alkalescent aqueous water. Among them, a (meth)acryl resin having unsaturated groups such as aryl group and acryloyl group or benzyl group, and carboxy group at side chain is suitable since the resin is excellent in a balance of layer strength, sensitivity and development property.

For a radical polymerizable compound and a binder polymer, those as detailedly described in [0036] to [0060] of JP 2001-133969 A can be used.

It is preferred that additives (for example, a surfactant to improve coating property) as described in [0061] to [0068] of JP 2001-133969 A is contained in a photosensitive composition of the thermal negative type.

For a method for preparing a polymerization layer and a method for making a plate, the methods as detailedly described in JP 2001-133969 A can be used.

<Acid Cross-Linkable Layer>

An image recording layer of acid cross-linkable type (acid cross-linkable layer) is suitable taken up also as one of image recording layers of the thermal negative type. The acid cross-linkable layer contains a photothermal conversion agent, compound generating acid by heat (hereinafter, referred to as an "acid generator"), a compound which is crosslinked by an acid that is a curable compound (cross-linking agent) and an alkali-soluble high-molecular compound which may react with a cross-linking agent under the presence of an acid. In the acid cross-linkable layer, infrared rays absorbed by a photothermal conversion agent are converted into heat, which decomposes an acid generator to generate an acid, which allows a cross-linking agent to react with and an alkali-soluble high-molecular compound is cures.

The same photothermal conversion agent as used in a polymerizatable layer are taken up at this stage.

Taken up as acid generator for example are decomposable compounds by heat such as initiator for the photopolymerization, a color-turning agent (i.e., dye stuff) and an acid generator for use in micro resist and the like.

Taken up as cross-linking agents for example are aromatics compound substituted with hydroxymethyl group or alkoxymethyl group; compounds having a N-hydroxymethyl group, a N-alkoxymethyl group or a N-acyloxymethyl group; expoxy compound.

Taken up as an alkali-soluble high-molecular compound for example are novolak resin and polymer having hydroxyaryl group at side chain.

<Photopolymer Type>

A photosensitive composition of the photopolymerization type contains an addition polymerizable compound, a photopolymerization initiator and a high-molecular binding agent.

Suitably taken up as an addition polymerizable compound is compound containing ethylenic unsaturated bonding capable of addition polymerization. A compound containing ethylenic unsaturated bonding is a compound having an end-ethylenic unsaturated bonding. Concretely, it has a chemical form of monomer, prepolymer, mixtures of these or the like for example. Taken up as examples of the monomer are the ester of an unsaturated carboxylic acid (for example, acrylic acid, methacrylic acid, itaconic acid, maleic acid) and an aliphatic polyalcohol compound and the amide of an unsaturated carboxylic acid and an aliphatic polyamine compound.

In addition, a urethane addition polymerizable compound is suitably taken up also as an addition polymerizable compound.

As the photopolymerization initiator contained in the photopolymerizable composition, a variety of photopolymerization initiators or combined systems of two or more photopolymerization initiators (photo initiation systems) can be appropriately selected for use. For example, initiation systems described in [0021] to [0023] of JP 2001-22079 A are preferable.

Since the high-molecular binding agent needs not only to function as a coating layer forming agent for the photopolymerizable composition but also to dissolve the photosensitive layer in an alkali developer, an organic high-molecular polymer that is soluble or swellable in an aqueous solution of alkali is used. As the above-described high-molecular binding agent, the agent described in [0036] to [0063] of JP 2001-22079 A are orefered.

It is preferable to add the additive described in [0079] to [0088] of JP 2001-22079 A (for example, a surfactant for improving the coating property, a colorant, a plasticizer, and a thermal polymerization inhibitor) to the photopolymerizable composition.

Moreover, it is also preferable to provide an oxygen-shieldable protective layer on the above-described photosensitive layer for preventing the polymerization inhibiting action of oxygen. Poly(vinyl alcohol) and a copolymer thereof are cited as a polymer contained in the oxygen-shieldable protective layer.

Furthermore, it is also preferable that an adhesive layer or intermediate layer as described in [0124] to [0165] of JP 2001-228608 A is provided.

<Conventional Negative Type>

As a photosensitive composition used suitably for the photosensitive layer of the conventional negative type, a composition containing diazo resin or photo closs-linkable resin. Among them, a composition containing diazo resin or and a high-molecular compound that is alkali-soluble or alkali-swellable (hereinafter, referred to as a "binding agent") is cited.

Cited as such diazo resin is, for example, a condensate of an aromatic diazonium salt and a compound containing an active carbonyl group such as formaldehyde, and an inorganic salt of organic solvent-soluble diazo resin, which is a reaction product of a condensate of p-diazo phenyl amines group and formaldehyde with hexafluorophosphate or tetrafluoroborate. Particularly, a high-molecular-weight diazo compound containing 20 mol % or more of a hexamer or larger, which is described in JP 59-78340 A, is preferable.

For example, copolymer containing, as an essential component, acrylic acid, methacrylic acid, crotonic acid or maleic acid is cited as a suitable binding agent. Specifically, multi-copolymer of monomer such as 2-hydroxyethyl(meth)acrylate, (meth)acrylonitrile and (meth)acrylic acid, which is as described in JP 50-118802 A, and multi-copolymer composed of alkylacrylate, (metha)acrylonitrile and unsaturated carboxylic acid, which is as described in JP 56-4144 A, are cited.

Furthermore, to the photosensitive composition, it is preferable to add a compound such as a printing agent, a dye, a plasticizer for imparting the flexibility of the coating layer and abrasion resistance, a development accelerator, and a surfactant for improving the coating property, which are described in [0014] and [0015] of JP 7-281425 A.

It is preferable that an intermediate layer containing a high-molecular compound having a constituent with an acid group and a constituent with an onium group, which is described in JP 2000-105462 A, is provided under the photosensitive layer of the conventional negative type.

<Conventional Positive Type>

As a photosensitive composition used suitably for the photosensitive layer of the conventional positive type, a composition containing quinonediazide compound. Among them, the composition containing an o-quinonediazide compound and alkali-soluble high-molecular compound is cited.

Cited as such an o-quinonediazide compound are, for example, the ester of 1,2-naphthoquinone-2-diazide-5-sulfonyl chloride and phenol-formaldehyde resin or cresol-formaldehyde resin, and the ester of 1,2-naphthoquinone-2-diazide-5-sulfonyl chloride and pyrogallol-acetone resin, which is described in U.S. Pat. No. 3,635,709.

Cited as such an alkali-soluble high-molecular compound are, for example, phenol-formaldehyde resin, cresol-formaldehyde resin, phenol-cresol-formaldehyde co-condensed resin, polyhydroxystyrene, copolymer of N-(4-hydroxyphenyl)methacrylamide, carboxy group-containing polymer described in JP 7-36184 A, acrylic resin containing a phenolic hydroxy group as described in JP 51-34711 A, acrylic resin containing a sulfonamide group described in JP 2-866 A, and urethane resin.

Furthermore, it is preferable that a compound such as a sensitivity regulator, a printing agent and a dye, which are described in [0024] to [0027] of JP 7-92660 A, or a surfactant for improving a coating property, which is as described in [0031] of JP 7-92660 A, is added to the photosensitive resin composition.

It is preferred that an intermediate layer which is the same layer suitably used for the conventional negative type is provided under photosensitive layer of the conventional positive type.

<Development-Dispensable Type>

Taken up as a photosensitive compositions of the development-dispensable type are a thermoplastic particle polymer type, a microcapsule type, a type containing sulfonic acid-generating polymer and the like. These are all thermosensitive types containing photothermal conversion agents. It is preferred that a photothermal conversion agent is the same dye as used for the aforementioned the thermal positive type.

A photosensitive composition of thermoplastic particle polymer type is a composition in which a hydrophobic thermowelding resin particles are dispersed in a hydrophilic polymer matrix. In an image recording layer of thermoplastic particle polymer type, a hydrophobic thermoplastic particles are welded by a heat generated by exposure and these particles are welded and adhered to each other to form a hydrophobic area, namely, an image area.

It is preferred that the particles are welded and mutually fuse by heat and more preferred the particles are one that the surface of the particles is hydrophilic and the particles can be dispersed in hydrophilic components such as fountain solution. Concretely, suitably taken up are thermoplastic particle polymers as described in Research Disclosure No. 33303 (Published in January, 1992), JP 9-123387 A, JP 9-131850 A, JP 9-171249 A, JP 9-171250 A and EP 931,647 A. Preferred are polystyrene and poly methyl methacrylate among them. Taken up as particle polymers having a hydrophilic surface for example are ones that polymers per se are hydrophilic; polymers with the surface made hydrophilic by allowing hydrophilic compounds such as poly(vinyl alcohol) and poly (ethylene glycol) to be absorbed to the surface of a particle polymer.

Preferred is a particle polymer having a reactive functional group.

As the photosensitive composition of the microcapsule type, a type described in JP 2000-118160 A and a microcapsule type containing a compound having a thermoreactive functional group as described in JP 2001-277740 A are preferably cited.

As the sulfonic acid-generating polymer for use in the type containing the sulfonic acid-generating polymer, for example, polymer having a sulfonic acid ester group, a disulfonic group or a sec- or tert-sulfonamide group in the side chain described in JP 10-282672 A is cited.

The hydrophilic resin can be contained in the thermosensitive layer of the development-dispensable type, and thus, not only the on-machine development property would be improved, but also the coating layer strength of the thermosensitive layer itself would be improved. Preferred as hydrophilic resins are, for example, resins having hydrophilic groups such as hydroxy group, carboxy group, hydroxyethyl group, hydroxypropyl group, amino group, aminoethyl group, aminopropyl group and carboxymethyl group and hydrophilic sol-gel conversion type binding resins.

A development-dispensable type image recording layer dispenses with a special development process and development processing can be performed on a printing press with the recording layer. For a method for preparing an image recording of the development-dispensable type layer and a method for making plate and printing, the methods as detailedly described in JP 2002-178655 A can be used.

Preferably taken up for example even among the aforementioned image forming layers (image recording layer) in a support for a lithographic printing plate according to the present invention are a recording layer of the visible light exposure type where exposure is performed by normal visible light and a recording layer of the laser exposure type where exposure is performed by laser beams such as infrared ray laser beams.

Among them, particularly preferred are the following:

(i) An image forming layer of the positive type where an image is directly drawn by a laser beam and a solubility to an alkali developer varies with heat generated by photothermal conversion, (ii) A photosensitive layer where an image is directly drawn by a laser beam and a solubility to an alkali developer varies with heat generated by photothermal conversion, whose A layer and B layer below-described are sequentially superimposed, and a compound which absorbs light to generate heat is contained in the B layer.

A layer: A layer containing 50 wt % or more of copolymers containing 10 mol % or more of at least one of monomers (a-1) to (a-3) as a copolymer component, and B layer: a layer containing 50 wt % or more of an alkali aqueous solution-soluble resin having phenolic hydroxy group.

Where, a monomer (a-1) in the A layer is a monomer having sulfonamide group where at least one hydrogen atom is bonded to a nitrogen atom in one molecule, a monomer (a-2) is a monomer having active imino group in one molecule and a monomer (a-3) is a monomer selected from acrylamide, methacrylamide, acrylic ester, methacrylic ester and hydroxystyrene having phenolic hydroxy group.

(iii) An image forming layer of the negative type where an image is directly drawn by a laser beam and a solubility to an alkali developer varies with heat generated by photothermal conversion, (iv) An image forming layer where an image may be directly drawn by a laser beam, making use of a radical addition polymerization reaction, (v) A photosensitive image forming layer of the positive type, and (vi) A photosensitive image forming layer of the negative type.

In addition, suitably taken up are the image forming layers in items A to F described below.

A: A layer containing, a. infrared absorbent that absorbs a laser beam to convert it into heat, b. acid generator that generates an acid by heat or the like, and c. a cross-linking agent by an acid, B: a layer containing, a. the infrared absorbent, b. the acid generator, and c. a decomposable compound which is decomposed by an acid, C: a layer containing, a. a radical generator which generates a radical if a laser beam is irradiated, b. an alkali-soluble binder polymer, and c. a radical polymerizable compound which is polymerized by a radical, D: a layer having, a. a photosensitive layer where a solubility to a developer is increased or decreased if a laser beam is irradiated, b. a layer containing silver halide which is superimposed on the photosensitive layer, E: a layer having, a. a developing core layer containing a physical developing core, b. a layer containing silver halide which is superimposed on the developing core layer, and F: a layer having, a laser removable lipophilic layer which is a lipophilic layer removed by irradiating a laser beam.

<Backcoat Layer>

On the reverse side of the presensitized plate of the present invention, which is obtained by providing various types of image recording layers on the support for the lithographic printing plate of the present invention, a backcoat layer composed of an organic high-molecular compound can be provided according to needs in order to prevent the image recording layers from being scratched in the case of stacking the presensitized plate or the like.

<Method of Producing a Presensitized Plate>

Usually, the respective layers of the image recording layer and the like can be produced by coating a coating liquid obtained by dissolving the foregoing components into a solvent on the support for the lithographic printing plate.

Cited as solvents used herein are ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate, dimethoxyethane, methyl lactate, ethyl lactate, N,N-dimethylacetamide, N,N-dimethylformamide, tetramethylurea, N-methylpyrrolidone, dimethyl sulfoxide, sulfolan, γ-butyrolactone, toluene, water and the like. However, the present invention is not limited to those. These solvents are used singly or mixedly.

It is preferable that the concentration of the foregoing components (entire solid part) in the solvent range from 1 to 50 wt %.

Various coating methods can be used. For example, bar coater coating, rotation coating, spray coating, curtain coating, dip coating, air knife coating, blade coating, roll coating and the like can be cited.

[Method of Producing a Lithographic Printing Plate]

The presensitized plate of the present invention is made into a lithographic printing plate by various treatment methods in accordance with the kind of the image recording layer.

In general, image exposure is carried out. Cited as light sources of active rays for use in the image exposure are, for example, a mercury lamp, a metal halide lamp, a xenon lamp and a chemical lamp. As laser beams, for example, helium-neon (He—Ne) laser, argon laser, krypton laser, helium-cadmium laser, KrF excimer laser, semiconductor laser, YAG laser and YAG-SHG laser are cited.

If after the exposure is performed, an image recording layer is either of the thermal positive type, the thermal negative type, the conventional negative type, the conventional positive type or the photopolymer type, it is preferred that a lithographic printing plate is obtained by performing development treatment using a developer after exposure is performed.

It is preferred that a developer is an alkali developer and more preferred is an alkaline aqueous water substantially containing no organic solvent.

In addition, also preferred is a developer substantially containing no an alkali metal silicate. For a method for performing development treatment using a developer substantially containing no an alkali metal silicate, the method as detailedly described in JP 11-109637 A can be used.

In addition, a developer containing an alkali metal silicate can be also used.

EXAMPLE

Although the first to fourth Embodiments according to the present invention are sequentially described by concretely showing examples below, the present invention is not limited to these examples only.

First to Third Embodiments According to the Present Invention

1. Preparation of Aluminum Support for a Lithographic Printing Plates

Examples 1-1 to 1-16, 2-1 to 2-17, 3-1 to 3-17 and Comparative Examples 1-1 to 1-2, 2-1 to 2-3, 3-1 to 3-3

Each aluminum support for a lithographic printing plate was obtained by performing each graining treatment described below on each aluminum plate with the compositions as shown in Table 1 in combination of each graining treatment as shown in Table 2 (graining treatment continuously performed from the left to the right in Table 2). Each surface treatment is mechanical graining treatment, first alkali etching treatment, first desmutting treatment, first electrochemical graining treatment (nitric acid aqueous solution), second alkali etching treatment, second desmutting treatment, second electrochemical graining treatment (hydrochloric acid aqueous solution), third alkali etching treatment, third desmutting treatment, third electrochemical graining treatment (nitric acid aqueous solution), fourth alkali etching treatment, fourth desmutting treatment, anodizing treatment, sealing treatment and treatment of water wettability.

For Comparative Examples 2-3, each surface treatment was performed as shown in Table 2 except for the conditions that the second electrochemical graining treatment (a hydrochloric acid aqueous solution) is performed by using an aqueous solution with a hydrochloric acid concentration of 0.5 g/L in place of a hydrochloric acid concentration of 5 g/L in item (7) below.

Note that the ordinal numbers of each graining treatment as shown in the Examples and Comparative Examples were indicated by the serial numbers as the ordinal numbers of each graining treatment is shown to clarify the surface treatment of each Embodiment. Namely, since the third alkali etching treatment performed in the first Embodiment is the etching treatment performed in the second time, it corresponds to the second alkali etching treatment described above. It can be similarly applied to other treatments.

Described below are the details of each treatment.

Note that water washing treatment was performed after graining treatment in each process. A liquid squeegeeing was performed by a nip roller after each treatment and water washing. In a case where treatments are continuously performed by using the same kind solution, water washing was omitted between the processes.

(1) Mechanical Graining Treatment

With the equipment as shown in FIG. 5, mechanical graining treatment was carried out by a rotating roller-shape nylon brush while supplying a suspension (specific gravity: 1.12) of abrasive A (an abrasive where a pumice is crushed and is so classified to allow the average particle diameter of particles contained therein to be 40 μm) or abrasive B (an abrasive where a silica sand is used and is so classified to allow the average particle diameter of particles contained therein to be 20 μm) with water as an abrasive slurry liquid to the surface of an aluminum plate with a spray tube. In FIG. 5, 51 represents an aluminum plate, 52 and 54 represent roller-shape brushes, 53 represents an abrasive slurry liquid and 55, 56, 57 and 58 represent supporting rollers.

A No. 3 nylon brush with bristle length of 50 mm made of 6•10 nylon was used. Nylon bristles were densely implanted on a stainless steel cylinder of 300 mm diameter by arranging holes thereon. Three rotary brushes were used. Each distance between two supporting rollers (diameter: 200 mm) under the brush was 300 mm. The load of a drive motor which rotates the brush was controlled to the load of the drive motor before pressing a brush roller to an aluminum plate and the brush rollers were so pressed as to allow the average surface roughness of the aluminum plate after graining treatment is performed to be 0.45 to 0.55 μm. The rotation direction of each brush was the same as the moving direction of an aluminum plate (forward direction). The number of rotations of the brush was 200 rpm.

(2) First Alkali Etching Treatment

Etching treatment was performed on an aluminum plate by spraying an aqueous solution containing 27 wt % of NaOH and 6.5 wt % of aluminum ion concentration at a solution temperature of 70° C. from a spray tube. The amount of etching on a plane on which graining treatment was electrochemically performed in the later process (a plane on which mechanical graining treatment has been performed) of an aluminum plate was as shown in Table 2.

(3) First Desmutting Treatment

Desmutting treatment was performed in either of the following methods.

Treatment A: A wastewater of hydrochloric acid used for electrochemical graining treatment (7) later described was used. The temperature of the solution was 30° C. Desmutting treatment was performed by spraying the wastewater with a spray for two seconds.

Treatment B: Desmutting treatment was performed by using a wastewater (an aqueous solution containing sulfuric acid of 170 g/L with 5 g/L of aluminum ion dissolved therein) generated in an anodizing treatment (10) later described at a solution temperature of 60° C. for two seconds.

Treatment C: Desmutting treatment was performed by using a wastewater (an aqueous solution containing sulfuric acid of 100 g/L with 5 g/L of aluminum ion dissolved therein) generated in an anodizing treatment (10) later described at a solution temperature of 35° C. for two seconds.

Treatment D: A wastewater of nitric acid used for the electrochemical graining treatment (4) in the next treatment was used. The solution temperature was 35° C. Desmutting treatment was performed by praying the wastewater with a spray for two seconds.

Treatment E: A wastewater of nitric acid used for electrochemical graining treatment (4) in the next treatment was used. The solution temperature was 30° C. Desmutting treatment was performed by praying the wastewater with a spray for two seconds.

Treatment F: Desmutting treatment was performed by using a wastewater (an aqueous solution containing sulfuric acid of 100 g/L with 5 g/L of aluminum ion dissolved therein) generated in anodizing treatment (10) later described at a solution temperature of 60° C. for two seconds.

(4) First and Third Electrochemical Graining Treatments (Alternating Current Electrolysis in Nitric Acid Aqueous Solution)

An electrolyte where the concentration of aluminum ion was controlled at 5 g/L by adding aluminum nitrate to an aqueous solution with nitric acid of the concentration 9.5 g/L at a solution temperature of 50° C. was used. Electrochemical graining treatment was performed by using a power supply that generates a trapezoidal AC. The frequency of the AC was 60 Hz, the AC waveform was like that shown in FIG. 1 and a time Tp to reach a peak from zero of the current was 0.8 msec. The duty (ta/T) of AC was 0.5. The current density at the time of anode in an aluminum plate was 60 A/dm$^2$ at the peak of AC and the ratio of the total quantity of electricity (Qc) at the time of cathode in an aluminum plate (the total quantity of electricity Qc in the cathodic state in the an aluminum plate to which AC is applied) to the total quantity of electricity (Qa) at the time of anode in an aluminum plate (the total quantity of electricity Qa in the anodic state in the an aluminum plate to which AC is applied), Qc/Qa, was 0.95 (or a value shown in Table 2). A quantity of electricity applied to an aluminum plate was the total quantity of electricity at the time of anode in the aluminum plate and was as shown in Table 2.

The electrolytic cell used two cells of the radial type as shown in FIG. 4.

(5) Second Alkali Etching Treatment

Alkali etching treatment was performed on an aluminum plate by spraying an aqueous solution containing 27 wt % of NaOH and 6.5 wt % of aluminum ion concentration at a solution temperature of 45° C. from a spray tube. The amount of etching on a plane of an aluminum plate on which the electrochemical graining treatment (4) was performed was as shown in Table 2.

(6) Second Desmutting Treatment

Desmutting treatment was performed in either of the following methods.

Treatment A: A wastewater of hydrochloric acid used for the electrochemical graining treatment (7) in the next process was used. The solution temperature was 30° C. Desmutting treatment was performed by praying a desmutting solution with a spray for two seconds.

Treatment B: A wastewater of nitric acid used for the electrochemical graining treatment (4) in the aforementioned process was used. The solution temperature was 30° C. Desmutting treatment was performed by praying a desmutting solution with a spray for two seconds.

Treatment C: Desmutting treatment was performed by using a wastewater (an aqueous solution containing sulfuric acid of 100 g/L with 5 g/L of aluminum ion dissolved therein) generated in anodizing treatment (10) later described at a solution temperature of 30° C. for two seconds.

(7) Second Electrochemical Graining Treatment (Alternating Current Electrolysis in Hydrochloric Acid Aqueous Solution)

An electrolyte where the concentration of aluminum ion was controlled at 4.5 g/L by adding aluminum chloride of 40 g/L to an aqueous solution with the concentration of hydrochloric acid of 5 g/L at a solution temperature of 35° C. was used. Electrochemical graining treatment was performed by using a power supply that generates a trapezoidal AC. The frequency of the AC was 50 Hz, the AC waveform was like that shown in FIG. 1 and a time Tp to reach a peak from zero of the current was 0.8 msec. The duty (ta/T) of AC was 0.5. The current density at the time of anode in an aluminum plate was 50 A/dm$^2$ at the peak of AC and the ratio of the total quantity of electricity (Qc) at the time of cathode in an aluminum plate (the total quantity of electricity Qc in the cathodic state in the an aluminum plate to which AC is applied) to the total quantity of electricity (Qa) at the time of anode in an aluminum plate (the total quantity of electricity Qa in the anodic state in the an aluminum plate to which AC is applied), Qc/Qa, was 0.95 (or a value shown Table 2). A quantity of electricity applied to an aluminum plate was the total quantity of electricity at the time of anode in the aluminum plate and was as shown in Table 2. The electrolytic cell used one cell of the radial type as shown in FIG. 4. A time that an aluminum plate passed through the inlet (solution level) of the auxiliary electrolytic cell 34 to the inlet (solution level) of the AC electrolytic cell 20 was 2 seconds.

In the third Embodiment according to the present invention, Second electrochemical graining treatment was performed under following conditions. An electrolyte where the concentration of aluminum ion was controlled at 5 g/L by adding aluminum chloride to an aqueous solution with the concentration of hydrochloric acid of 3 g/L at a solution temperature of 35° C. was used. The frequency of the AC was 50 Hz and a time Tp to reach a peak from zero of the current was 0.8 msec.

(8) Second Alkali Etching Treatment

Alkali etching treatment was performed on an aluminum plate by spraying an aqueous solution containing 27 wt % of NaOH and 6.5 wt % of aluminum ion concentration at a solution temperature of 45° C. with a spray. The amount of etching of the plane of an aluminum plate on which the second electrochemical graining treatment (7) or the third electrochemical graining treatment (4) was performed was as shown in Table 2.

(9) Third and Fourth Desmutting Treatment

Desmutting treatment was performed in either of the following methods.

Treatment A: Desmutting treatment was performed by using a wastewater (an aqueous solution containing sulfuric acid of 170 g/L with 5 g/L of aluminum ion dissolved therein) generated in an anodizing treatment (10) later described at a solution temperature of 35° C. for four seconds.

Treatment B: Desmutting treatment was performed by using a wastewater (an aqueous solution containing sulfuric acid of 170 g/L with 5 g/L of aluminum ion dissolved therein) generated in an anodizing treatment (10) later described at a solution temperature of 60° C. for two seconds.

Treatment C: Desmutting treatment was performed by using a wastewater (an aqueous solution containing sulfuric acid of 100 g/L with 5 g/L of aluminum ion dissolved therein) generated in an anodizing treatment (10) later described at a solution temperature of 35° C. for four seconds.

Treatment D: Desmutting treatment was performed by using a wastewater (an aqueous solution containing sulfuric acid of 170 g/L with 5 g/L of aluminum ion dissolved therein) generated in an anodizing treatment (10) later described at a solution temperature of 70° C. for four seconds.

Treatment E: A wastewater of nitric acid used for the electrochemical graining treatment (4) in the next process was used. The solution temperature was 35° C. Desmutting treatment was performed by praying a desmutting solution with a spray for two seconds.

Treatment F: Desmutting treatment was performed by using a wastewater (an aqueous solution containing sulfuric acid of 100 g/L with 5 g/L of aluminum ion dissolved therein) generated in an anodizing treatment (10) later described at a solution temperature of 35° C. for two seconds.

(10) Anodizing Treatment

Next, anodizing treatment was performed on the aluminum plate under either of the following conditions.

Conditions A: A anodized layer of 2.4 g/m$^2$ was provided by using DC at a solution temperature of 33° C. and current density of 10 A/dm$^2$ by using an electrolyte containing 170 g/L sulfuric acid where aluminum ion was controlled at 5 g/L by adding aluminum sulphate.

Conditions B: A anodized layer of 3 g/m$^2$ was provided by using DC at a solution temperature of 50° C. and current density of 10 A/dm$^2$ by using an electrolyte containing 100 g/L sulfuric acid where aluminum ion was controlled at 5 g/L by adding aluminum sulphate.

(11) Sealing Treatment

Steam sealing treatment was performed in a saturated steam chamber at 100° C. and 1 atm for 10 seconds.

(12) Treatment of Water Wettability

Treatment of water wettability was performed in either of the following conditions.

Conditions A: The aluminum plate was soaked in an aqueous solution containing 1 wt % of sodium silicate at 25° C. for 7 seconds.

Conditions B: The aluminum plate was soaked in an aqueous solution containing 2.5 wt % of sodium silicate at 70° C. for 5 seconds.

After the treatment of water wettability was over, the aluminum plate was dried.

2. Evaluation of Surface Shape of Aluminum Support for Lithographic Printing Plate The surface of each aluminum support for a lithographic printing plate obtained in each Example and Comparative Example were observed at a magnification of 2,000 with a scanning electron microscope and the evenness of honeycomb pits generated on the surface of a support was evaluated. The results are shown in Table 2. Here, the evaluation is indicated in such a way that especially good evenness in profile irregularities on the surface is "○", good evenness thereof is "Δ" and unevenness thereof is "x".

3. Dissolution of Electrode in Electrochemical Graining Treatment

In the first electrochemical graining treatment, the second electrochemical graining treatment and the third electrochemical graining treatment, the dissolution of electrode was conformed. The results are shown in Table 2. It is indicated that in either of the electrochemical graining treatments, if none of an electrode is dissolved, it is "none" and in either of the electrochemical graining treatments, if an electrode is even a little dissolved, it is "dissolved".

TABLE 2

| Example | Aluminum plate | Mechanical graining treatment | First alkali etching treatment (amount of etching) | First desmutting treatment | Second electrolytic graining treatment (in hydrochloric acid aqueous solution) Quantity of electricity (Anode) | Qc/Qa | Third alkali etching treatment (amount of etching) | Third desmutting treatment |
|---|---|---|---|---|---|---|---|---|
| Example 1-1 | AL 1 | Abrasive A | 12 g/m$^2$ | A | 50 C/dm$^2$ | 0.95 | 0.3 g/m$^2$ | A |
| Example 1-2 | AL 1 | Abrasive B | 12 g/m$^2$ | A | 50 C/dm$^2$ | 0.95 | 0.3 g/m$^2$ | A |
| Example 1-3 | AL 1 | Abrasive A | 12 g/m$^2$ | A | 50 C/dm$^2$ | 0.95 | 0.3 g/m$^2$ | A |
| Example 1-4 | AL 1 | Abrasive A | 12 g/m$^2$ | B | 50 C/dm$^2$ | 0.95 | 0.3 g/m$^2$ | A |
| Example 1-5 | AL 1 | Abrasive A | 12 g/m$^2$ | C | 50 C/dm$^2$ | 0.95 | 0.3 g/m$^2$ | A |
| Example 1-6 | AL 1 | Abrasive A | 12 g/m$^2$ | B | 50 C/dm$^2$ | 0.95 | 0.3 g/m$^2$ | B |
| Example 1-7 | AL 1 | Abrasive A | 12 g/m$^2$ | B | 50 C/dm$^2$ | 0.95 | 0.3 g/m$^2$ | C |
| Example 1-8 | AL 1 | Abrasive A | 12 g/m$^2$ | B | 50 C/dm$^2$ | 0.95 | 0.3 g/m$^2$ | C |
| Example 1-9 | AL 1 | Abrasive A | 12 g/m$^2$ | B | 75 C/dm$^2$ | 0.95 | 0.3 g/m$^2$ | B |
| Example 1-10 | AL 1 | Abrasive A | 12 g/m$^2$ | B | 75 C/dm$^2$ | 0.95 | 0.3 g/m$^2$ | A |
| Example 1-11 | AL 1 | Abrasive A | 12 g/m$^2$ | A | 75 C/dm$^2$ | 0.95 | 0.3 g/m$^2$ | C |
| Example 1-12 | AL 1 | Abrasive A | 12 g/m$^2$ | A | 75 C/dm$^2$ | 0.95 | 0.3 g/m$^2$ | C |
| Example 1-13 | AL 2 | Abrasive A | 8 g/m$^2$ | A | 45 C/dm$^2$ | 0.95 | 0.1 g/m$^2$ | A |

TABLE 2-continued

| | | | | | | | | |
|---|---|---|---|---|---|---|---|---|
| Example 1-14 | AL 3 | Abrasive A | 8 g/m$^2$ | A | 45 C/dm$^2$ | 0.95 | 0.2 g/m$^2$ | A |
| Example 1-15 | AL 4 | Abrasive A | 8 g/m$^2$ | A | 45 C/dm$^2$ | 0.95 | 0.2 g/m$^2$ | A |
| Example 1-16 | AL 1 | Abrasive A | 8 g/m$^2$ | A | 200 C/dm$^2$ | 0.95 | 0.3 g/m$^2$ | A |
| Comparative Example 1-1 | AL 1 | Abrasive A | 8 g/m$^2$ | A | 75 C/dm$^2$ | 0.85 | 0.3 g/m$^2$ | A |
| Comparative Example 1-2 | AL 1 | Abrasive A | 8 g/m$^2$ | A | 75 C/dm$^2$ | 1.2 | 0.3 g/m$^2$ | A |

| Example | Anodizing treatment | Sealing treatment | Treatment of water wettable | Surface shape evenness | Dissolution of electrode in electrolytic graining treatment |
|---|---|---|---|---|---|
| Example 1-1 | A | Not done | A | ○ | None |
| Example 1-2 | A | Not done | A | ○ | None |
| Example 1-3 | A | Not done | A | ○ | None |
| Example 1-4 | A | Not done | A | ○ | None |
| Example 1-5 | A | Not done | A | ○ | None |
| Example 1-6 | A | Not done | A | ○ | None |
| Example 1-7 | B | Not done | A | ○ | None |
| Example 1-8 | B | Not done | A | ○ | None |
| Example 1-9 | B | Not done | A | ○ | None |
| Example 1-10 | A | Not done | B | ○ | None |
| Example 1-11 | B | Done | Not done | ○ | None |
| Example 1-12 | B | Done | A | ○ | None |
| Example 1-13 | A | Not done | A | ○ | None |
| Example 1-14 | A | Not done | A | ○ | None |
| Example 1-15 | A | Not done | A | ○ | None |
| Example 1-16 | A | Not done | A | Δ | None |
| Comparative Example 1-1 | A | Not done | A | X | None |
| Comparative Example 1-2 | A | Not done | A | ○ | Dissolved |

| | | | | | First electrolytic graining treatment (in nitric acid aqueous solution) | | Second alkali etching treatment | | Second electrolytic graining treatment (in hydrochloric acid aqueous solution) | |
|---|---|---|---|---|---|---|---|---|---|---|
| Example | Aluminum plate | Mechanical graining treatment | First alkali etching treatment (amount of etching) | First desmutting treatment | Quantity of electricity (Anode) | Qc/Qa | (amount of etching) | Second desmutting treatment | Quantity of electricity (Anode) | Qc/Qa |
| Example 2-1 | AL 1 | Abrasive A | 10 g/m$^2$ | D | 220 C/dm$^2$ | 0.95 | 0.5 g/m$^2$ | A | 30 C/dm$^2$ | 0.95 |
| Example 2-2 | AL 1 | Abrasive A | 10 g/m$^2$ | D | 220 C/dm$^2$ | 0.95 | 0.5 g/m$^2$ | A | 30 C/dm$^2$ | 0.95 |
| Example 2-3 | AL 1 | Abrasive A | 10 g/m$^2$ | C | 220 C/dm$^2$ | 0.95 | 0.5 g/m$^2$ | A | 30 C/dm$^2$ | 0.95 |
| Example 2-4 | AL 1 | Abrasive A | 10 g/m$^2$ | D | 220 C/dm$^2$ | 0.95 | 0.5 g/m$^2$ | B | 30 C/dm$^2$ | 0.95 |
| Example 2-5 | AL 1 | Abrasive A | 10 g/m$^2$ | D | 220 C/dm$^2$ | 0.95 | 0.5 g/m$^2$ | C | 30 C/dm$^2$ | 0.95 |
| Example 2-6 | AL 1 | Abrasive A | 10 g/m$^2$ | D | 220 C/dm$^2$ | 0.95 | 0.5 g/m$^2$ | B | 30 C/dm$^2$ | 0.95 |
| Example 2-7 | AL 1 | Abrasive A | 10 g/m$^2$ | D | 220 C/dm$^2$ | 0.95 | 0.5 g/m$^2$ | B | 30 C/dm$^2$ | 0.95 |
| Example 2-8 | AL 1 | Abrasive A | 10 g/m$^2$ | D | 220 C/dm$^2$ | 0.95 | 0.5 g/m$^2$ | B | 30 C/dm$^2$ | 0.95 |
| Example 2-9 | AL 1 | Abrasive A | 10 g/m$^2$ | D | 220 C/dm$^2$ | 0.95 | 0.5 g/m$^2$ | B | 50 C/dm$^2$ | 0.95 |
| Example 2-10 | AL 1 | Abrasive A | 10 g/m$^2$ | D | 220 C/dm$^2$ | 0.95 | 0.5 g/m$^2$ | B | 50 C/dm$^2$ | 0.95 |
| Example 2-11 | AL 1 | Abrasive A | 10 g/m$^2$ | D | 220 C/dm$^2$ | 0.95 | 0.5 g/m$^2$ | A | 50 C/dm$^2$ | 0.95 |
| Example 2-12 | AL 1 | Abrasive A | 10 g/m$^2$ | D | 220 C/dm$^2$ | 0.95 | 0.5 g/m$^2$ | A | 50 C/dm$^2$ | 0.95 |
| Example 2-13 | AL 1 | Not done | 6 g/m$^2$ | D | 220 C/dm$^2$ | 0.95 | 0.5 g/m$^2$ | B | 50 C/dm$^2$ | 0.95 |
| Example 2-14 | AL 1 | Not done | 6 g/m$^2$ | D | 270 C/dm$^2$ | 0.95 | 0.5 g/m$^2$ | A | 50 C/dm$^2$ | 0.95 |
| Example 2-15 | AL 2 | Abrasive A | 10 g/m$^2$ | D | 170 C/dm$^2$ | 0.95 | 0.5 g/m$^2$ | A | 50 C/dm$^2$ | 0.95 |
| Example 2-16 | AL 3 | Abrasive A | 10 g/m$^2$ | D | 220 C/dm$^2$ | 0.95 | 1 g/m$^2$ | A | 50 C/dm$^2$ | 0.95 |
| Example 2-17 | AL 4 | Abrasive A | 10 g/m$^2$ | D | 220 C/dm$^2$ | 0.95 | 1 g/m$^2$ | A | 50 C/dm$^2$ | 0.95 |
| Comparative Example 2-1 | AL 1 | Abrasive A | 10 g/m$^2$ | D | 220 C/dm$^2$ | 0.85 | 1 g/m$^2$ | A | 50 C/dm$^2$ | 0.85 |
| Comparative Example 2-2 | AL 1 | Abrasive A | 10 g/m$^2$ | D | 220 C/dm$^2$ | 1.2 | 1 g/m$^2$ | A | 50 C/dm$^2$ | 1.2 |
| Comparative Example 2-3 | AL 1 | Abrasive A | 10 g/m$^2$ | D | 220 C/dm$^2$ | 0.95 | 0.5 g/m$^2$ | A | 30 C/dm$^2$ | 0.95 |

| Example | Third alkali etching treatment (amount of etching) | Third desmutting treatment | Anodizing treatment | Sealing treatment | Treatment of water wettable | Surface shape evenness | Dissolution of electrode in electolytic graining treatment |
|---|---|---|---|---|---|---|---|
| Example 2-1 | 0.2 g/m$^2$ | A | A | Not done | A | ○ | None |
| Example 2-2 | 0.2 g/m$^2$ | A | A | Not done | A | ○ | None |
| Example 2-3 | 0.2 g/m$^2$ | A | A | Not done | A | ○ | None |
| Example 2-4 | 0.2 g/m$^2$ | A | A | Not done | A | ○ | None |
| Example 2-5 | 0.2 g/m$^2$ | A | A | Not done | A | ○ | None |

TABLE 2-continued

| | | | | | | | |
|---|---|---|---|---|---|---|---|
| Example 2-6 | 0.2 g/m$^2$ | D | A | Not done | A | ○ | None |
| Example 2-7 | 0.2 g/m$^2$ | C | B | Not done | A | ○ | None |
| Example 2-8 | 0.2 g/m$^2$ | C | B | Not done | A | ○ | None |
| Example 2-9 | 0.2 g/m$^2$ | D | B | Not done | A | ○ | None |
| Example 2-10 | 0.2 g/m$^2$ | A | A | Not done | B | ○ | None |
| Example 2-11 | 0.2 g/m$^2$ | C | B | Done | Not done | ○ | None |
| Example 2-12 | 0.2 g/m$^2$ | C | B | Done | A | ○ | None |
| Example 2-13 | 0.2 g/m$^2$ | C | B | Not done | A | ○ | None |
| Example 2-14 | 0.2 g/m$^2$ | D | B | Not done | A | ○ | None |
| Example 2-15 | 0.1 g/m$^2$ | A | A | Not done | A | ○ | None |
| Example 2-16 | 0.3 g/m$^2$ | A | A | Not done | A | ○ | None |
| Example 2-17 | 0.3 g/m$^2$ | A | A | Not done | A | ○ | None |
| Comparative Example 2-1 | 0.3 g/m$^2$ | A | A | Not done | A | X | None |
| Comparative Example 2-2 | 0.3 g/m$^2$ | A | A | Not done | A | ○ | Dissolved |
| Comparative Example 2-3 | 0.2 g/m$^2$ | A | A | Not done | A | X | None |

| Example | Aluminum plate | Mechanical graining treatment | First alkali etching treatment (amount of etching) | First desmutting treatment | Second electrolytic graining treatment (in hydrochloric acid aqueous solution) Quantity of electricity (Anode) | Qc/Qa | Third alkali etching treatment (amount of etching) | Third desmutting treatment | Third electrolytic graining treatment (in nitric acid aqueous solution) Quantity of electricity (Anode) | Qc/Qa |
|---|---|---|---|---|---|---|---|---|---|---|
| Example 3-1 | AL 1 | Abrasive A | 12 g/m$^2$ | A | 50 C/dm$^2$ | 0.95 | 0.3 g/m$^2$ | E | 180 C/dm$^2$ | 0.95 |
| Example 3-2 | AL 1 | Abrasive B | 12 g/m$^2$ | A | 50 C/dm$^2$ | 0.95 | 0.3 g/m$^2$ | E | 180 C/dm$^2$ | 0.95 |
| Example 3-3 | AL 1 | Abrasive A | 12 g/m$^2$ | A | 50 C/dm$^2$ | 0.95 | 0.3 g/m$^2$ | F | 180 C/dm$^2$ | 0.95 |
| Example 3-4 | AL 1 | Abrasive A | 12 g/m$^2$ | E | 50 C/dm$^2$ | 0.95 | 0.3 g/m$^2$ | E | 180 C/dm$^2$ | 0.95 |
| Example 3-5 | AL 1 | Abrasive A | 12 g/m$^2$ | F | 50 C/dm$^2$ | 0.95 | 0.3 g/m$^2$ | E | 180 C/dm$^2$ | 0.95 |
| Example 3-6 | AL 1 | Abrasive A | 12 g/m$^2$ | E | 50 C/dm$^2$ | 0.95 | 0.3 g/m$^2$ | E | 180 C/dm$^2$ | 0.95 |
| Example 3-7 | AL 1 | Abrasive A | 12 g/m$^2$ | E | 50 C/dm$^2$ | 0.95 | 0.3 g/m$^2$ | E | 180 C/dm$^2$ | 0.95 |
| Example 3-8 | AL 1 | Abrasive A | 12 g/m$^2$ | E | 50 C/dm$^2$ | 0.95 | 0.3 g/m$^2$ | E | 180 C/dm$^2$ | 0.95 |
| Example 3-9 | AL 1 | Abrasive A | 12 g/m$^2$ | E | 75 C/dm$^2$ | 0.95 | 0.3 g/m$^2$ | E | 180 C/dm$^2$ | 0.95 |
| Example 3-10 | AL 1 | Abrasive A | 12 g/m$^2$ | E | 75 C/dm$^2$ | 0.95 | 0.3 g/m$^2$ | E | 180 C/dm$^2$ | 0.95 |
| Example 3-11 | AL 1 | Abrasive A | 12 g/m$^2$ | A | 75 C/dm$^2$ | 0.95 | 0.3 g/m$^2$ | E | 180 C/dm$^2$ | 0.95 |
| Example 3-12 | AL 1 | Abrasive A | 12 g/m$^2$ | A | 75 C/dm$^2$ | 0.95 | 0.3 g/m$^2$ | E | 180 C/dm$^2$ | 0.95 |
| Example 3-13 | AL 1 | Not done | 6 g/m$^2$ | A | 75 C/dm$^2$ | 0.95 | 0.3 g/m$^2$ | E | 220 C/dm$^2$ | 0.95 |
| Example 3-14 | AL 1 | Not done | 6 g/m$^2$ | A | 75 C/dm$^2$ | 0.95 | 0.3 g/m$^2$ | E | 270 C/dm$^2$ | 0.95 |
| Example 3-15 | AL 2 | Abrasive A | 10 g/m$^2$ | A | 50 C/dm$^2$ | 0.95 | 0.3 g/m$^2$ | E | 170 C/dm$^2$ | 0.95 |
| Example 3-16 | AL 3 | Abrasive A | 10 g/m$^2$ | A | 50 C/dm$^2$ | 0.95 | 0.5 g/m$^2$ | E | 200 C/dm$^2$ | 0.95 |
| Example 3-17 | AL 4 | Abrasive A | 10 g/m$^2$ | A | 50 C/dm$^2$ | 0.95 | 0.5 g/m$^2$ | E | 200 C/dm$^2$ | 0.95 |
| Comparative Example 3-1 | AL 1 | Abrasive A | 10 g/m$^2$ | A | 75 C/dm$^2$ | 0.85 | 0.5 g/m$^2$ | E | 200 C/dm$^2$ | 0.85 |
| Comparative Example 3-2 | AL 1 | Abrasive A | 10 g/m$^2$ | A | 75 C/dm$^2$ | 1.2 | 0.5 g/m$^2$ | E | 200 C/dm$^2$ | 1.2 |
| Comparative Example 3-3 | AL 1 | Abrasive A | 10 g/m$^2$ | Not done | Not done | Not done | Not done | E | 200 C/dm$^2$ | 0.95 |

| Example | Fourth alkali etching treatment (amount of etching) | Fourth desmutting treatment | Anodizing treatment | Sealing treatment | Treatment of water wettable | Surface shape evenness | Dissolution of electrode in electolytic graining treatment |
|---|---|---|---|---|---|---|---|
| Example 3-1 | 0.8 g/m$^2$ | A | A | Not done | A | ○ | None |
| Example 3-2 | 0.8 g/m$^2$ | A | A | Not done | A | ○ | None |
| Example 3-3 | 0.8 g/m$^2$ | A | A | Not done | A | ○ | None |
| Example 3-4 | 0.8 g/m$^2$ | A | A | Not done | A | ○ | None |
| Example 3-5 | 0.8 g/m$^2$ | A | A | Not done | A | ○ | None |
| Example 3-6 | 0.8 g/m$^2$ | D | A | Not done | A | ○ | None |
| Example 3-7 | 0.8 g/m$^2$ | C | B | Not done | A | ○ | None |
| Example 3-8 | 0.8 g/m$^2$ | C | B | Not done | A | ○ | None |
| Example 3-9 | 0.8 g/m$^2$ | D | B | Not done | A | ○ | None |
| Example 3-10 | 0.8 g/m$^2$ | A | A | Not done | B | ○ | None |
| Example 3-11 | 0.8 g/m$^2$ | C | B | Done | Not done | ○ | None |
| Example 3-12 | 0.8 g/m$^2$ | C | B | Done | A | ○ | None |
| Example 3-13 | 0.1 g/m$^2$ | C | B | Not done | A | ○ | None |
| Example 3-14 | 0.1 g/m$^2$ | D | B | Not done | A | ○ | None |
| Example 3-15 | 0.5 g/m$^2$ | A | A | Not done | A | ○ | None |
| Example 3-16 | 0.8 g/m$^2$ | A | A | Not done | A | ○ | None |

TABLE 2-continued

| | | | | | | | |
|---|---|---|---|---|---|---|---|
| Example 3-17 | 0.8 g/m$^2$ | A | A | Not done | A | ○ | None |
| Comparative Example 3-1 | 0.8 g/m$^2$ | A | A | Not done | A | X | None |
| Comparative Example 3-2 | 0.8 g/m$^2$ | A | A | Not done | A | ○ | Dissolved |
| Comparative Example 3-3 | 0.8 g/m$^2$ | A | A | Not done | A | X | None |

4. Preparing of Lithographic Printing Plates and Evaluation of Press Life and Scum Resistance After the following photosensitive layers A to K were coated and dried by using an aluminum support for a lithographic printing plate prepared in the Examples and exposure was performed on them, development treatment was performed by using the following developers corresponding to each photosensitive layer. Printing was performed by using these lithographic printing plates. It was found that an obtained presensitized plate was excellent in press life and scum resistance when a lithographic printing plate was prepared, even where either of the supports and either of the photosensitive layers A to K were used.

<Photosensitive Layer A>

The undercoat layer coating solution with the following composition was coated on the support and dried at 80° C. for 30 seconds to form an undercoat layer. The coated amount after drying was 30 mg/m$^2$.

| <Composition of undercoat layer coating solution> | |
|---|---|
| Aminoethyl phosphonic acid | 0.10 g |
| Phenylphosphonic acid | 0.15 g |
| β-alanine | 0.10 g |
| Methanol | 40 g |
| Pure water | 60 g |

A photosensitive resin solution with the following composition is coated on the undercoat layer and is dried at 110° C. for one minute to obtain a photosensitive lithographic printing plate of the positive type. The coated quantity after drying is 2 g/m$^2$.

| <Composition of photosensitive resin solution> | |
|---|---|
| Ester of 1,2-diazonaphthoquinone-5-sulfonylchloride and pyrogallol-acetone resin (as described in Example 1 of U.S. Pat. No. 3,635,709) | 0.45 g |
| Cresol-formaldehydenovolak resin (meta/para ratio; 6/4, weight average molecular weight 3,000, number average molecular weight 1,100, containing 0.7% of unreacted cresol) | 1.1 g |
| m-cresol-formaldehydenovolak resin (weight average molecular weight 1,700, number average molecular weight 600, containing 1% of unreacted cresol) | 0.3 g |
| Poly [N-(P-aminosulfonylphenyl) acrylamide-co-normal buthylacrylate-co-diethylenegrycolmonomethylethermetacrylate] (mole ratio of each monomer is in order: 40:40:20, weight average molecular weight 40,000, number average molecular weight 20,000) | 0.2 g |
| p-normalocthylphenol-formaldehyde resin (as described in U.S. Pat. No. 4,123,279) | 0.02 g |
| naphthoquinone-1,2-diazide-4-sulfonate chloride | 0.01 g |
| tetrahydrophthalic anhydride | 0.1 g |
| Benzoic acid | 0.02 g |

-continued

| <Composition of photosensitive resin solution> | |
|---|---|
| 4-[p-N,N-bis (ethoxycarbonylmethyl) aminophenyl]-2,6-bis (trichloromethyl)-s-triazine | 0.01 g |
| 4-[p-N-(p-hydroxybenzoyl) aminophenyl]-2,6-bis(trichloromethyl)-s-triazine | 0.02 g |
| 2-trichloromethyl-5-(4-hydroxystyryl)-1,3,4-oxadiazole | 0.01 g |
| Dye prepared by setting a counter ion of Victorian pure blue BOH as 1-naphthalenesulfonic acid anion | 0.02 g |
| Fluorine-containing surfactant (Modiper F-200, made by NOF CORPORATION, 30 wt % of mixed solvent solution of methyl ethyl ketone and methyl isobutyl ketone) | 0.06 g |
| Fluorine-containing surfactant (Megaface F-177, made by Dainippon Ink And Chemicals, Incorporated, 20 wt % of solution of methyl isobutyl ketone) | 0.02 g |
| Methyl ethyl ketone | 15 g |
| 1-methoxy-2-propanol | 10 g |

A matted layer was provided on the photosensitive layer thus coated by electrostatic spraying an aqueous solution containing a copolymer of methylmetacrylate/ethylacrylate/sodium acrylate (mol ratio=68/20/12) based on the method as described in Example 1 of JP 61-28986 B.

Exposure was performed on the photosensitive presensitized plate thus prepared in a vacuum baking frame with a metal halide lamp of 3 kW from a 1 m distance through a transparent positive film for 50 seconds. Thereafter, development treatment was performed by allowing the presensitized plate to pass through automatic processor Stablon 900D made by Fuji Photo Film Co., Ltd. with an aqueous solution (pH=12.7) containing 5.26 wt % of sodium silicate with mol ratio of $SiO_2/Na_2O$: 1.74 as a developer and FR-3 (1:7) made by Fuji Photo Film Co., Ltd. as a rinse charged to obtain a lithographic printing plate.

Printing was performed on the obtained positive photosensitive lithographic printing plates. Used were a printing press, SOR-M made by Heidelberg AG, a fountain solution, EU-3 (1:100) made by Fuji Photo Film Co., Ltd., to which 10% of isopropanol was added and an ink, Mark Five New Ink made by Toyo Ink Co., Ltd.

<Photosensitive Layer B>

A photosensitive layer coating solution with the following composition was coated on each support described above to form a photosensitive layer, and the supports were dried at 110° C. for 60 seconds The coated quantity after drying was 2 g/m$^2$.

| <Composition of photosensitive layer coating solution> | |
|---|---|
| Ester of 1,2-diazonaphthoquinone-5-sulfonyl chloride and pyrogallol-acetone resin (weight average molecular weight 2,500) | 40 parts by weight |

-continued

| <Composition of photosensitive layer coating solution> | |
|---|---|
| Phenol formaldehyde resin (weight average molecular weight 10,000, 90 wt % of components having three nuclei or more) | 75 parts by weight |
| Acryl polymer I later described 1 | 35 parts by weight |
| 2-(p-butoxyphenyl)-4,6-bis(trichloromethyl)-s-triazine | 3 parts by weight |
| Blue dye (oil blue #603, made by Orient Chemical Industries, Ltd.) | 1.5 parts by weight |
| Fluorine-containing surfactant (Megaface F-176, made by Dainippon Ink And Chemicals, Incorporated) | 0.3 parts by weight |
| Methyl ethyl ketone | 1,000 parts by weight |
| Propyleneglycol monomethyl ether | 1,000 parts by weight |

Acryl polymer 1 was synthesized by the following method.

N-(p-toluenesulphonyl)methacrylamide of 60.3 g, acrylonitrile of 10.0 g, ethyl acylate of 46.0 g were dissolved in dimethylformamide of 232.6 g, 2,2'-azobis(2,4-dimethylvaleronitrile) of 0.224 g was used as a polymerization initiator under the flow of nitrogen and the solution was stirred at 65° C. for 7 hours. After the reaction solution was stored to cool, the polymer was again charged into water of 5 liters to precipitate. Acryl polymer 1 of 110.4 g (yield 95%, weight average molecular weight 52,000) was obtained by filtering and drying the deposited polymer.

A matted layer was formed on the photosensitive layer thus formed by spraying the following mat-forming resin solution to obtain a presensitized plate.

Used as a mat-forming resin solution was a 12% aqueous solution where a sodium salt was partly substituted with a copolymer of methyl methacrylate/ethyl acrylate/acrylic acid (ratio of charged quantity: 65:20:15).

Matting was performed under the conditions that the revolutions of an atomizing head in a rotary atomization electrostatic coating machine was 25,000 rpm, the supplying quantity of a resin solution is 40 mL/min, a voltage applied to the atomizing head is −90 kV, the ambient temperature at the time of coating is 25° C. and the relative humidity is 50%.

Steam was sprayed on a coated surface 2.5 seconds after coating was over to wet the surface, after steam was sprayed in 3 seconds, a mated layer was dried by spraying steam at 60° C. with the humidity of 10% for 5 seconds.

Exposure was performed on the presensitized plate thus prepared with a metal halide lamp of 3 kW from a distance of 1 m through an original film for 60 seconds.

Next, a developer of 20 liters with the following composition was supplied to the first bath in the developing baths of a commercialized automatic processor PS-900D (made by Fuji Photo Film Co., Ltd.) having dipping type developing baths and a solution was kept at 30° C., a tap water of 8 litters was supplied to the second bath and a finishing gum solution of 8 litters with the following composition where the finishing gum solution was diluted with water in a rate that the finishing gum solution water=1:1 was supplied to the third bath. The aforementioned lithographic printing plate was allowed to pass through the PS-900D thus arranged by which development treatment was performed to obtain a lithographic printing plate.

| <Developer (pH about 12.4)> | |
|---|---|
| D-saccharose | 4.8 wt % |
| Sodium hydroxide | 0.34 wt % |
| Sodium carbonate | 0.70 wt % |
| Tetrabutyl ammonium bromide | 0.03 wt % |
| Water | 94.13 wt % |
| <Finishing gum solution> | |
| Gum arabic | 1.8 wt % |
| Enzyme-denatured potato starch | 18.3 wt % |
| Enzyme-denatured onion starch | 3.7 wt % |
| Phosphate waxi - onion starch | 1.8 wt % |
| Sodium salts of dioctyl sulfosuccinate | 0.91 wt % |
| ammonium primary phosphate | 0.27 wt % |
| Phosphoric acid (85%) | 0.37 wt % |
| EDTA-tetra sodium salt | 0.27 wt % |
| Ethylene glycol | 1.8 wt % |
| Benzyl alcohol | 2.3 wt % |
| Sodium dehydroacetate | 0.04 wt % |
| Emulsion type silicon anti-foam fluid | 0.02 wt % |
| Water | 68.42 wt % |

<Photosensitive Layer C>

The copolymer with the following composition of 1 wt % of aqueous solution coated on the supports with a roll coater and was dried at 80° C. for 30 seconds to form an undercoat layer. The coated quantity after drying was 0.05 g/m$^2$.

<Composition of Undercoat Layer Coating Solution>

Copolymer of methyl methacrylate/ethyl acrylate/sodium 2-acrylamide-2-methylpropane sulfonate (mol ratio: 50:30:20, average molecular weight about 60,000)

A photosensitive layer coating solution with the following composition was coated on the undercoat layer and was dried at 120° C. for 2 minutes to obtain a photosensitive presensitized plate. The coated quantity after drying was 2.0 g/m$^2$.

<Composition of Photosensitive Layer Coating Solution>

| <Composition of photosensitive layer coating solution> | |
|---|---|
| 2-hydroxyethyl methacrylate copolymer (as described in Example 1 of U.S. Pat. No. 4,123,276) | 0.87 g |
| 2-methoxy-4-hydroxy-5-benzoyl benzene sulfonate of condensate of p-diazodiphenylamine and p-formaldehyde | 0.1 g |
| Blue dye (Oil blue #603, made by Orient chemical Industries, Ltd.) | 0.03 g |
| Methanol | 6 g |
| 2-methoxyethanol | 6 g |

A transparent negative was vacuum-contacted to the obtained presensitized plate and exposure was performed on the plate with a metal halide lamp of 3 kW from a distance of 1 m for 60 seconds. Thereafter, the plate was dipped in a developer with the following composition for one minute and development treatment was performed by slightly rubbing the surface of a photosensitive layer with a sponge and a commercialized desensitizing-to-oil treated gum solution was further coated thereon to obtain a lithographic printing plate.

| <Composition of developer> | |
|---|---|
| Sodium sulfite | 5 g |
| Benzyl alcohol | 30 g |
| Sodium carbonate | 5 g |
| Sodium isopropylnaphthalene sulfonate | 12 g |
| Pure water | 1,000 g |

<Photosensitive Layer D>

The following photosensitive layer coating solution was coated on the supports and the coated were dried at 100° C. for two minutes to obtain the photosensitive presensitized plates of the negative type. The coated quantity of photosensitive layer after drying was 2.0 g/m$^2$.

| <Composition of photosensitive layer coating solution> | |
|---|---|
| Dispersed carbon black solution later described | 10 g |
| exafluoroshosphate of condensate of 4-diazodiphynylamine and formaldehyde | 0.5 g |
| Radical copolymer of methacrylic acid/2-hydroxyethyl acrylate/benzyl methacrylate/acrylonitrile (mol ratio: 15/30/40/15, weight average molecular weight 100,000) | 5 g |
| Malic acid | 0.05 g |
| Fluorine-coating surfactant (FC-430, made by 3M, USA) | 0.05 g |
| 1-methoxy-2-propanol | 80 g |
| Ethyl lactate | 15 g |
| Water | 5 g |

<Preparation of Dispersed Carbon Black Solution>

The composite of the following composition was dispersed with glass beads for 10 minutes to obtain a dispersed carbon black solution.

| <Composition of dispersed carbon black solution> | |
|---|---|
| Carbon black | 1 part by weight |
| Copolymer of benzyl methacrylate and methacrylic acid (mol ratio: 72:28, weight average molecular weight 70,000) | 1.6 parts by weight |
| Cyclohexanone | 1.6 parts by weight |
| Methoxypropyl acetate | 3.8 parts by weight |

After exposure was performed on the photosensitive presensitized plate of the negative type with a YAG laser beeping a printing plate output of 2 W controlled, development treatment was performed by allowing the plate to pass through an automatic processor with a developer, DN-3C (1:1) made by Fuji Photo Film Co., Ltd. and a gum solution FN-2 (1:1) charged.

Printing was performed by using those lithographic printing plates with a Heidel SOR-KZ printing press.

<Photosensitive Layer E>

The undercoat layer coating solution with the following composition was coated on the supports described as above with a wire bar and dried with a hot-air type drying device 90° C. for 30 seconds to form a undercoat layer. The coated quantity after drying was 20 mg/m$^2$.

| <Composition of undercoat layer coating solution> | |
|---|---|
| Methacryloyl oxyethyl phosphonic acid | 0.2 g |
| Copolymer of methyl acrylate and sodium styrene sulfonate (mol ratio: 75/15) | 0.2 g |
| Calcium nitrate | 0.2 g |
| Methanol | 20 g |
| Ion exchanged water | 80 g |

A photosensitive layer coating solution with the following composition was coated on the undercoat layer with wire bar and dried at 120° C. for 45 seconds to form a photosensitive layer. The coated quantity of the photosensitive layer was 2.0 g/m$^2$.

Furthermore, an overcoated layer coating solution with the following composition was coated on the photosensitive layer with a slide hopper and the overcoated layer was formed by drying the layer with a hot-air type drying device at 120° C. for 75 seconds to obtain a presensitized plate. The coated quantity after drying was 2.3 g/m$^2$.

| <Composition of photosensitive layer coating solution> | |
|---|---|
| Titanocene radical generating agent (CGI-784, made by Chiba Speciality Chemicals Inc.) | 0.1 g |
| Polymerizable compound expressed by the following formula (RM-2) | 0.60 g |
| Polymerizable compound expressed by the following formula (RM-3) | 0.20 g |
| Visible radiation absorbent expressed by the following formula (VR-1) | 0.10 g |
| Polymer PB-2 described later | 1.20 g |
| Copper phthalocyanine dye | 0.04 g |
| Polymerization inhibitor (cupferron A1, made by Wako Pure chemical Industries, Ltd.) | 0.005 g |
| Fluorine-containing surfactant (Megaface KF-309, made by Dainippon Ink And Chemicals, Incorporated) | 0.03 g |
| Methyl ethyl ketone | 10 g |
| γ-butyllactone | 5 g |
| Methanol | 7 g |
| 1-methoxy-2-propanol | 5 g |

Polymerizable compound RM-2

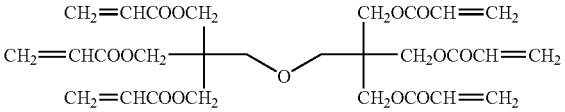

Polymerizable compound RM-3

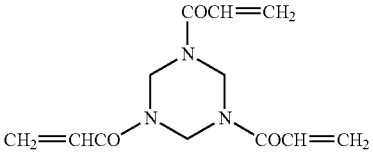

-continued

| <Composition of photosensitive layer coating solution> |
|---|

Visible radiation absorbent VR-1

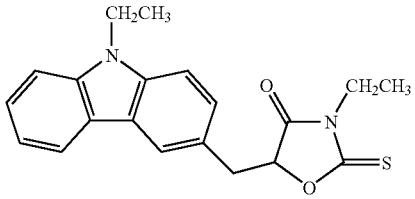

Polymer PB-2

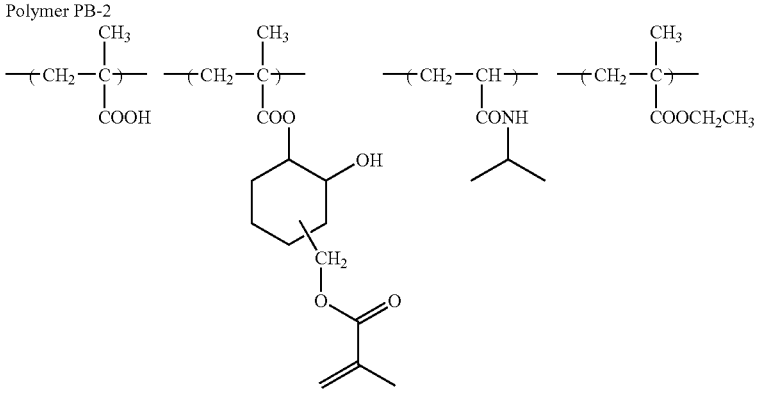

<Synthesis of Polymer PB-2>

After a copolymer of methacrylic acid, N-isopropyl acrylamide and ethyl methacrylate was synthesized, polymer PB-2 was synthesized by allowing the copolymer to react with 1,2-epoxy-3-methacryloyloxymethylcyclohexane. The mol ratio in order was 15/30/20/35 and the weight average molecular weight was 120,000.

| <Composition of overcoat layer coating solution> | |
|---|---|
| Polyvinyl alcohol (degree of saponification 98.5 mol %, degree of polymerization 500) | 3.0 g |
| Nonionic surfactant (EMAREX NP-10, made by Nihon-Emulsion Co., Ltd.) | 0.05 g |
| Ion exchanged water | 96.95 g |

Scanning exposure was performed on the 20 sheets obtained each presensitized plate (1,030×800 mm) with a semiconductor laser of 30 mW which emits purple light of wave number 405 nm under the exposure conditions that the diameter of a laser beam was 12 μm and the quantity of plate surface energy was 50 μJ/cm$^2$.

A developer (pH 8.1) with the following composition was supplied to the first bath of the development treatment baths in automatic processor (LP-850P2) made by Fuji Photo Film Co., Ltd. and the developer was kept at 30° C., a tap water was supplied to the second bath and a finishing gum solution where FP-2W (made by Fuji Photo Film Co., Ltd.) was diluted with water (PF-2W:Water=1:1) was supplied to the third bath to perform development treatment.

| <Composition of developer> | |
|---|---|
| Sodium hydrogencarbonate | 26 g |
| Sodium ethyleneglycolmononaphtylethermonosulfenate | 30 g |
| Ethyleneglycolmonododecylether | 20 g |
| Sodium sulfite | 3 g |
| Tetrasodiumethlenediaminetetraacetate | 1 g |
| Water | 920 g |

After development treatment was performed, the developer was left as it stood for three days. Thereafter, exposure was performed on a presensitized plate of one sheet with a laser beam and development treatment was similarly then performed.

Printing was performed by using the obtained lithographic printing plate with a printing press Rithron made by Komori Corporation. In this case, after starting printing, a visual evaluation was performed to evaluate the sheet number that printed matters on which ink was sufficiently coated can be obtained. In addition, at the same time, the scum condition of a non-image area was visually evaluated. As a result, good printed matters of 70,000 sheets could be obtained both using the printing plate on which processing was performed before an automatic processor had been left and using the printing plate on which processing was performed after an automatic processor had been left. Furthermore, it was not observed that a scum took place in a non-image area on the printed matters obtained.

<Photosensitive Layer F>

The undercoat layer coating solution with the following composition is coated on the supports described as above with a wire bar and dried with a hot-air drying device at 90° C. for 30 seconds to form an undercoat layer. The coated quantity after drying is 20 mg/m$^2$.

| <Composition of undercoat layer coating solution> | |
|---|---|
| Dibutylnaphthalenesulfonate of condensate of 4-diazo-3-methoxydiphenylamine and formaldehyde | 0.3 g |
| Magnesium 2-aminoethylsulfonate | 0.1 g |

-continued

| <Composition of undercoat layer coating solution> | |
|---|---|
| Calcium chloride | 0.2 g |
| Methanol | 20 g |
| Ion exchanged water | 80 g |

A photosensitive layer coating solution with the following composition is coated on the undercoat layer described as above with a wire bar and dried at 120° C. for 45 seconds to form a photosensitive layer. The coated quantity after drying is 2.0 g/m$^2$.

| <Composition of photosensitive layer coating solution> | |
|---|---|
| Onium salt expressed by the following formula (KO-1) | 0.25 g |
| Polymerizable compound expressed by the following formula (RM-1) | 0.60 g |
| Infrared absorbent expressed by the following formula (IR-1) | 0.06 g |
| Polymer PB-1 later described | 1.40 g |
| Naphthalenesulfonate of Victorian pure blue | 0.04 g |
| N-allyl stearic amide | 0.01 g |
| Polymerization inhibitor (Inganox 1010, made by Chiba Speciality Chemicals Co., Ltd.) | 0.005 g |
| Fluorine-containing surfactant (Megafac KF-309, made by Dainippon Ink And Chemicals, Incorporated) | 0.03 g |
| Methyl ethyl ketone | 10 g |
| γ-butyrolactone | 5 g |
| Methanol | 7 g |
| 1-methoxy-3-propanol | 5 g |

Onium salt KO-1

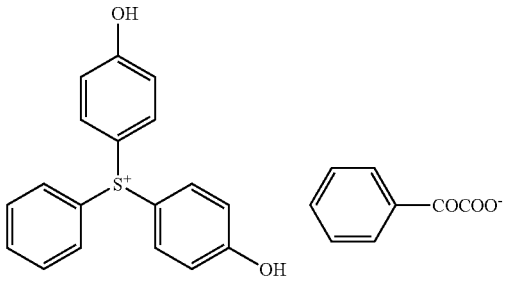

Polymerizable compound RM-1

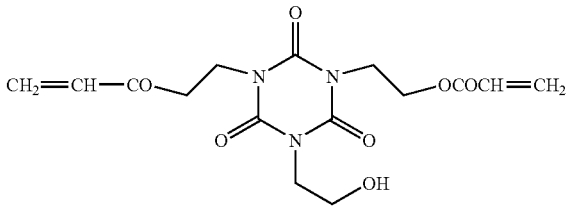

Infrared absorbent IR-1

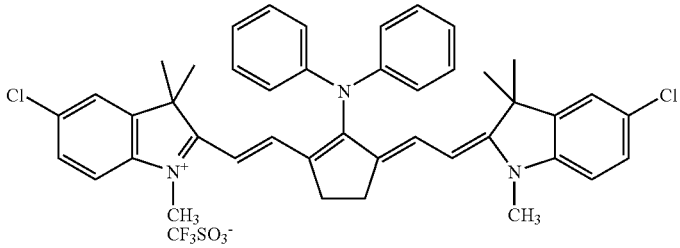

-continued

<Composition of photosensitive layer coating solution>

Polymer PB-1

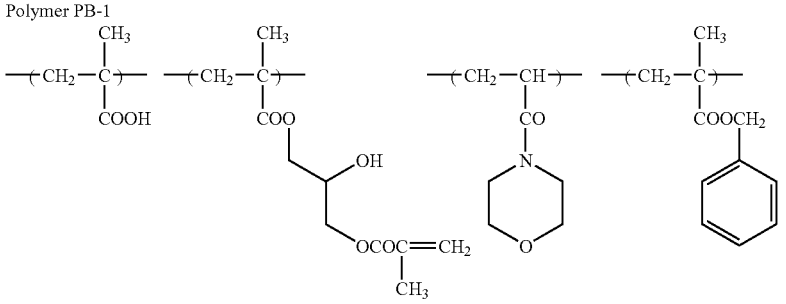

<Synthesis of Polymer PB-1>

After a copolymer of methacrylic acid, N-acryloylmorpholine and benzyl methacrylate was synthesized, polymer PB-1 was synthesized by allowing the copolymer to react in the presence of 3-chloro-2-hydroxypropyl methacrylate, a base and potassium iodide. The mol ratio was 15/30/10/45 and the weight average molecular weight was 100,000.

Exposure and development treatment were performed in the following manner by using a CTP output system made by Fuji Photo Film Co., Ltd. including a printing material supplying device (SA-L8000), an exposure device (Luxel T-9000CTP), a conveyor (T-9000 Conveyor), an automatic processor (LP-131oH) and a stocker (ST-1160).

Lithographic printing plate (1,030×800 mm) of 30 sheets were loaded on a printing plate supplying device, exposure and development treatment were continuously performed in full automation and they were discharged to a stocker. Exposure was performed on a presensitized plate with a Plate Setter, Trendsetter 3244F made by Creo Inc. under the conditions that a beam intensity was 9 W and the revolution was 150 rpm.

A developer (pH 8.0) with the following composition was supplied to the first bath of the developing baths in the automatic processor and the developer was kept at 30° C., a tap water was supplied to the second bath and a finishing gum solution where FP-2 (made by Fuji Photo Film Co., Ltd.) was diluted with water (FP-2:water=1:1) was supplied to the third bath which were used to perform developing treatment.

| <Composition of developer > | |
|---|---|
| Potassium hydrogencarbonate | 20 g |
| Sodium dibutylnaphthalene sulfonate | 30 g |
| Ethyleneglycolmononaphthylether | 20 g |
| Sodium sulfite | 3 g |
| Potassium hydroxyethanediphosphate | 2 g |
| Surfactant (silicon SA730, made by Toshiba Silicone Co., Ltd) | 0.1 g |
| Water | 924.9 g |

After development treatment was performed, the developer was left as it stood for three days. After left the developer, presensitized plate of one sheet was loaded on a printing plate supplying device, exposure and development treatment were continuously performed in full automation and the plate was discharged to a stocker.

Printing was performed on the obtained lithographic printing plate with a printing press, lithrone made by Komori Corporation. In this case, after starting printing, a visual evaluation was performed to evaluate the sheet number that printed matters on which ink was sufficiently coated could be obtained. In addition, at the same time, the scum condition of a non-image area was visually evaluated. As a result, good printed matters of 60,000 sheets could be each obtained from both using the printing plate on which processing was performed before an automatic processor had been left and the printing plate on which processing was performed after an automatic processor was left. Furthermore, it was not observed that a scum took place in a non-image area on the printed matters obtained.

<Photosensitive Layer G>

The undercoat layer coating solution with the following composition was coated on the supports described above and dried at 80° C. for 15 seconds. The coated quantity after drying was 15 mg/m$^2$.

| <Composition of undercoat layer coating solution> | |
|---|---|
| The following high-molecular compound A | 0.3 g |
| Methanol | 100 g |
| Water | 1 g |

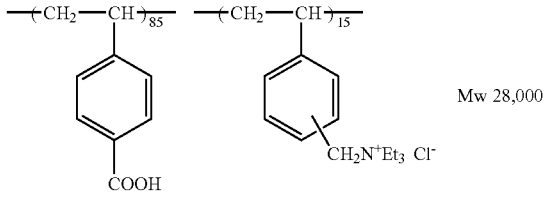

Mw 28,000

Furthermore, a photosensitive layer coating solution with the following composition was coated on the undercoat layer with a bar coater and a photosensitive layer was formed by drying the photosensitive layer with a hot-air type drying device at 140° C. for 60 seconds to obtain a presensitized plate. The coated quantity after drying was 1.0 g/m$^2$.

| <Composition of photosensitive layer coating solution> | |
|---|---|
| Capric acid | 0.03 g |
| Specified copolymer later described | 0.75 g |
| m, p-cresol novolak resin (m/p ratio = 6/4, weight average molecular weight 3,500, containing 0.5 wt % of unreacted cresol) | 0.25 |
| p-toluenesulfonic acid | 0.003 g |
| Tetrahydrophthalic anhydride | 0.03 g |
| Cyanine dye expressed by the following structural formula | 0.017 g |
| Dye prepared by setting a counter ion of Victorian pure blue BOH as 1-naphthalene-sulfonic acid anion | 0.015 g |
| Fluorin-containing surfactant (Megafac F-177, made by Dainippon Ink And Chemicals, Incorporated) | 0.05 g |
| γ-butyllactone | 10 g |
| Methyl ethyl ketone | 10 g |
| 1-methoxy-2-propanol | 1 g |

Cyanine dye

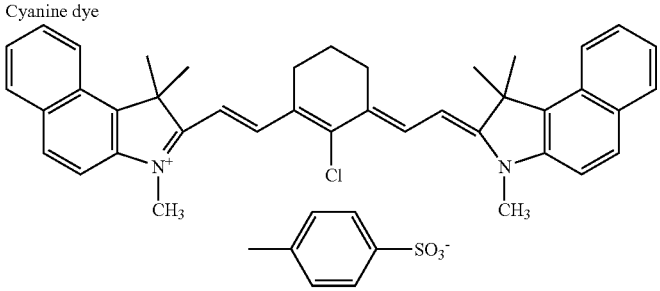

<Specified Copolymer>

Methacrylic acid of 31.0 g (0.36 mol), ethyl chloroformate of 39.1 g (0.36 mol) and acetonitrile of 200 mL were put into a three neck flask of 500 mL volume provided with a stirrer, a cooling tube and a dropping funnel and a mixture thereof was stirred while cooling the mixture with an ice water bath. Triethylamine of 36.4 g (0.36 mol) was dropped to the mixture with the dropping funnel in about one hour. After the dropping was over, the ice water bath was removed and the mixture was stirred at a room temperature for 30 minutes.

p-aminobenzenesulfonamide of 51.7 g (0.30 mol) was added to the reaction mixture and the mixture was stirred in one hour while heating the mixture with an oil bath at 70° C. After the reaction was over, the mixture was added to water of 1 liter with stirring and the resultant mixture was stirred for 30 minutes. The deposit was filtered, to which water of 500 mL was added to obtain a slurry, this slurry was then filtered, and a white solid of N-(p-aminosulfonylphenyl)methacrylamide was obtained by drying the resultant solid (yield 46.9 g).

Next, N-(p-aminosulfonylphenyl)methacrylamide of 4.61 g (0.0192 mol), ethyl methacrylate of 2.94 g (0.0258 mol), acrylonitrile of 0.80 g (0.015 mol) and N, N-dimethylacetoamide of 20 g were supplied to a three neck flask of 200 mL volume provided with a stirrer, a cooling tube and a dropping funnel, and the mixture was stirred while heating the solution at 65° C. with a warm water bath. An azo polymerization initiator "V-65" (made by Wako Pure Chemical Industries, Ltd.) expressed by the following formula of 0.15 g was added to this mixture and the mixture was stirred for two hours while it was kept at 65° C. in the gas flow of nitrogen. A mixture of N-(p-aminosulfonylpheyl)methacrylamide of 4.61 g, ethyl methacrylate of 2.94 g, acrylonitrile of 0.80 g, N, N-dimethylacetoamide and an azo polymerization initiator "V-65" expressed by the following formula of 0.15 g was further dropped to the reaction product with a dropping funnel in two hours. After the dropping was over, the resultant mixture was further stirred at 65° C. for two hours. After the reaction was over, methanol of 40 g was added to the mixture and was cooled, the resultant mixture was added to water of 2 liters with stirring, after the mixture was stirred for 30 minutes, a deposit filtered and a white solid of the specified copolymer of 15 g was obtained by drying the deposit.

As the weight average molecular weight of the resultant specified copolymer was measured with a gel permeation chromatography, it was 53,000 (in polystyrene standard).

Azo polymerization initiator V-65

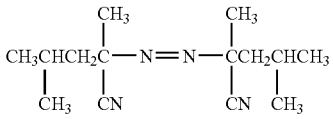

Exposure was performed on the presensitized plates obtained above at a main operation speed of 5 m/second with a semiconductor laser with output of 500 mW, wavelength of 830 nm and a beam diameter of 17 μm ($1/e^2$). After the exposure, development treatment was performed on the plate using a water-diluted solution of a PS printing plate developer DP-4 made by Fuji Photo Film Co., Ltd. (DP-4:water=1:8) for 30 seconds.

<Photosensitive Layer H>

A presensitized plate was obtained by forming the <photosensitive layer G> on the supports described above.

Exposure was performed on the obtained presensitized plates at a main operation speed of 5 m/second with a semiconductor laser with output of 500 mW, wavelength of 830 nm and a beam diameter of 17 μm ($1/e^2$). After the exposure was over, development treatment was performed by using a non-silicate developer with the following composition.

<Composition of Developer>

A solution was prepared by adding an ampholytic surfactant (Pionion C-158G, made by Takemoto Oil & Fat Co., Ltd.)

of 20 g and an anti-foam fluid, Olfine (AK-02, made by Nissin Chemical Industry Co., Ltd.) of 2.0 g to an aqueous solution of 1 liter containing a 45 wt % of potassium salt including D-sorbitol/potassium oxide ($K_2O$) where a non-reducing sugar and a base were combined. This solution which was nonuple-diluted with water (solution water=1:9) was used as a developer. The conductivity of this developer was 45 mS/cm.

<Photosensitive Layer 1>

The undercoat layer coating solution with following composition was coated on the supports described above and dried at 90° C. for one minute to form an undercoat layer. The coated quantity after drying was 10 mg/m$^2$.

| <Composition of undercoat layer coating solution> | |
|---|---|
| β-alanine | 0.5 g |
| Methanol | 95 g |
| Water | 5 g |

A photosensitive layer coating solution I-1 with the following composition was coated on the undercoat layer and dried at 100° C. for two minutes to form a I-1 layer. The coated quantity after drying was 1.4 g/m$^2$. After drying, a photosensitive layer coating solution I-2 with the following composition was coated on a I-1 layer and dried at 100° C. for two minutes to form a I-2 layer and a superimposed layer type-photosensitive layer was formed to obtain a presensitized plate. The total coated quantity of a photosensitive solution on I-1 and I-2 layers after drying was 2.0 g/m$^2$.

| <Composition of photosensitive layer coating solution I-1> | |
|---|---|
| Copolymer later described | 0.75 g |
| Cyanine dye A expressed by the aforementioned formula | 0.04 g |
| p-toluenesulfonic acid | 0.002 g |
| Tetrahydrophthalic anhydride | 0.05 g |
| Dye prepared by setting a counter ion of Victorian pure blue BOH as 1-naphthalenesulfonic acid anion | 0.015 g |
| Fluorine-containing surfactant (Megafac F-177, made by Dainippon Ink And Chemicals, Incorporated) | 0.02 g |
| γ-butyllactone | 8 g |
| Methyl ethyl ketone | 7 g |
| 1-methoxy-2-propanol | 7 g |

| <Composition of photosensitive layer coating solution I-2> | |
|---|---|
| m, p-cresol novolak resin (m/p ratio = 6/4, weight average molecular weight 4,000) | 0.25 g |
| Cyanine dye A expressed by the above described formula | 0.05 g |
| n-dodecyl stearate | 0.02 g |
| Fluorine-containing surfactant (Megafac F-177, made by Dainippon Ink And Chemicals, Incorporated) | 0.05 g |
| Methyl ethyl ketone | 7 g |
| 1-methoxy-2-propanol | 7 g |

<Synthesis of Copolymer of Photosensitive Solution I-1>

Methacrylic acid of 31.0 g (0.36 mol), ethyl chloroformate of 39.1 g (0.36 mol) and acetonitrile of 200 mL were put into a three neck flask of 500 mL volume provided with a stirrer, a cooling tube and a dropping funnel and a mixture thereof was stirred while cooling the mixture with an ice water bath. Triethylamine of 36.4 g (0.36 mol) was dropped to the mixture with the dropping funnel in about one hour. After the dropping was over, the ice water bath was removed and the mixture was stirred at a room temperature for 30 minutes.

p-aminobenzenesulfonamide of 51.7 g (0.30 mol) was added to the reaction mixture and the mixture was stirred in one hour while heating the mixture with an oil bath at 70° C. After the reaction was over, the mixture was added to water of 1 liter with stirring and the resultant mixture was stirred for 30 minutes. The deposit was filtered, to which water of 500 mL was added to obtain a slurry, this slurry was then filtered, and a white solid of N-(p-aminosulfonylphenyl)methacrylamide was obtained by drying the resultant solid (yield 46.9 g).

Next, N-(p-aminosulfonylphenyl)methacrylamide of 5.04 g (0.0210 mol), ethyl methacrylate of 2.05 g (0.0180 mol), acrylonitrile of 1.11 g (0.021 mol) and N,N-dimethylacetoamide of 20 g were put into a three neck flask of 100 mL volume provided with a stirrer, a cooling tube and a dropping funnel, and the mixture was stirred while heating the solution at 65° C. with a warm water bath. An azo polymerization initiator "v-65" (made by Wako Pure Chemical Industries, Ltd.) expressed by the above described formula of 0.15 g was added to this mixture and the mixture was stirred for two hours while it was kept at 65° C. in the gas flow of nitrogen. A mixture of N-(p-aminosulfonylpheyl)methacrylamide of 5.04 g, ethyl methacrylate of 2.05 g, acrylonitrile of 1.11 g, N,N-dimethylacetoamide and an azo polymerization initiator "V-65" expressed by the above described formula of 0.15 g was further dropped to the reaction product with a dropping funnel in two hours. After the dropping was over, the resultant mixture was further stirred at 65° C. for two hours. After the reaction was over, methanol of 40 g was added to the mixture and was cooled, the resultant mixture was added to water of 2 liters with stirring, after the mixture was stirred for 30 minutes, a deposit filtered and a white solid of the copolymer of 15 g was obtained by drying the deposit.

As the weight average molecular weight of the copolymer was measured with a gel permeation chromatography, it was 53,000 (in polystyrene standard).

Exposure was performed on the presensitized plates obtained above at a main operation speed of 5 m/second with a semiconductor laser with output of 500 mW, wavelength of 830 nm and a beam diameter of 17 μm (1/e$^2$). After the exposure, development treatment was performed on the plate using an automatic processor (PS Processor 900VR, made by Fuji Photo Film Co., Ltd.) with a water-diluted solution of a developer DP-4 made by Fuji Photo Film Co., Ltd. (DP-4: water=1:8) and a rinse solution, FR-3 (Fr-3:water=1:8) charged.

Printout was performed on a quality sheet by those printing plate on Heidelberg AG-made Heidel KOR-D machine.

<Photosensitive Layer J>

The undercoat layer coating solution with the following composition was coated on the supports described above and dried at 80° C. for 30 seconds. The coated quantity after drying was 30 mg/m$^2$.

| <Composition of undercoat layer coating solution> | |
|---|---|
| The above-mentioned high-molecular compound A | 0.3 g |
| Methanol | 100 g |
| Water | 1 g |

An lower thermosensitive layer coating solution with the following composition was coated on the undercoat layer and the lower thermosensitive layer was dried at 140° C. for 50 seconds with Wind Control set at 7 on PERFECT OVEN PH200 made by TABAI Co., Ltd. to form the lower thermosensitive layer. The coated quantity after drying was 85 g/m$^2$.

Therefore, an upper thermosensitive layer coating solution with following composition was coated on the lower thermosensitive layer and a superimposed layer type thermosensitive layer was formed by drying the upper thermosensitive layer at 120° C. for one minute to obtain a presensitized plate. The coated quantity of the upper thermosensitive layer after drying was 0.15 g/m$^2$.

| <Composition of lower thermosensitive layer coating solution> | |
|---|---|
| Copolymer of N-(4-aminosulpfonyl)methacrylamide/acrylonitrile/methyl methacrylate (mol ratio: 36/34/30, weight average molecular weight 50,000) | 1.896 g |
| Cresol novolak resin (m/p ratio = 6/4, weight average molecular weight 4,500, 0.8 wt % of residual monomer) | 0.237 g |
| Cyanine dye A expressed by the aforementioned formula | 0.109 g |
| 4,4'-bis hydroxyphenylsulfone | 0.063 g |
| Tetrahydrophthalic anhydride | 0.190 g |
| p-toluenesulfonic acid | 0.008 g |
| A compound prepared by setting a counter ion of ethyl violet as 6-hydroxynaphthalene sulfone | 0.05 g |
| Fluorine-containing surfactant (Megafac F-176, made by Dainippon Ink And Chemicals, Incorporated) | 0.035 g |
| Methyl ethyl ketone | 26.6 g |
| 1-methoxy-2-propanol | 13.6 g |
| γ-butyllactone | 13.8 g |

| <Composition of upper thermosensitive layer coating solution> | |
|---|---|
| m, p-cresol novolak resin (m/p ratio = 6/4, weight average molecular weight 4,500, containing 0.8 wt % of unreacted cresol) | 0.237 g |
| Cyanine dye A expressed by the aforementioned formula | 0.047 g |
| Dodecyl stearate | 0.060 g |
| 3-methoxy-4-diazodiphenylaminehexafluorophosphate | 0.030 g |
| Fluorine-containing surfactant (Megafac F-176, made by Dainippon Ink And Chemicals, Incorporated) | 0.120 g |
| Methyl ethyl ketone | 15.1 g |
| 1-methoxy-2-pronanol | 7.7 g |

An image-like test pattern was drawn on the obtained presensitized plates at beam intensity of 9 W and drum rotation speed of 150 rpm with Trendsetter 3244F made by Creo Inc.

Development treatment was performed on image-drawn presenstized plates with a non-silicate developer of the following composition.

<Composition of Non-Silicate Developer>

A solution was prepared by adding an ampholytic surfactant (Pionion C-158G, made by Takemoto Oil & Fat Co., Ltd.) of 20 g and an anti-foam fluid, Olfine (AK-02, made by Nissin Chemical Industry Co., Ltd.) of 2.0 g to an aqueous solution of 1 liter containing a 45 wt % of potassium salt including D-sorbitol/potassium oxide ($K_2O$) where a non-reducing sugar and a base were combined. This solution which was nonuple-diluted with water (solution: water=1:9) was used as a developer. The conductivity of this developer was 45 mS/cm.

<Photosensitive Layer K>

The undercoat layer coating solution with the following composition was coated on the supports described above and dried at 80° C. for 15 seconds. The coated quantity after drying was 15 mg/m$^2$.

| <Composition of undercoat layer coating solution> | |
|---|---|
| The aforementioned high-molecular compound A | 0.3 g |
| Methanol | 100 g |
| Water | 1 g |

A photosensitive layer coating solution with the following composition was coated on the undercoat layer and dried at 140° C. for 60 seconds to form a photosensitive layer. The coated quantity after drying was 1.8 g/m$^2$.

| <Composition of photosensitive layer coating solution> | |
|---|---|
| m, p-cresol novolak resin(m/p ratio = 6/4, weight average molecular weight 8,000, containing 0.5 wt % of unreacted cresol) | 1.0 g |
| Cyanine dye A expressed by the aforementioned formula | 0.1 g |
| Tetrahydrophthalic anhydride | 0.05 g |
| p-toluenesulfonic acid | 0.002 g |
| a compound prepared by setting a counter ion of ethyl violet as 6-hydroxy-β-naphthalenesulfonic acid | 0.02 g |
| Fluorne-containing surfactant (Megafac F-177, made by Dainippon Ink And Chemicals, Incorporated) | 0.05 g |
| Methyl ethyl ketone | 12 g |

Exposure was performed on the obtained presensitized plates under the condition of beam intensity of 9 W and drum rotation speed of 150 rpm with plate setter, Trendsetter 3244F made by Creo Inc.

After the exposure, an alkali developer (pH about 13) with the following composition of 20 L was supplied to the first bath of the development processing baths in a commercially available automatic processor LP-900H having a soaking type developing bath (made by Fuji Photo Film Co., Ltd.) and the developer was kept at 30° C., a tap water of 8 L was supplied to the second bath and a finishing gum solution of 8 L where FP-2W (made by Fuji Film Co., Ltd.) was diluted with water (FP-2W:water=1:1) was supplied to the third bath which were used to perform development processing.

| <Composition of alkali developer> | |
|---|---|
| $SiO_2 \bullet K_2O$ ($K_2O/SiO_2$ = 1.1 (mol ratio)) | 4.0 wt % |
| Citric acid | 0.5 wt % |
| Polyethyleneglycol (weight average molecular weight 1,000) | 0.5 wt % |
| Water | 95.0 wt % |

5. Evaluation of Lithographic Printing Plate

Scum resistance (resistance to scum in a non-image area) and press life resistance of the lithographic printing plates were evaluated by the following method.

(1) Scum Resistance (Resistance to Scum in a Non-Image Area)

Printing was performed with a Mitsubishi Dia printing press made by Mitsubishi Heavy Industries, Ltd. as a printing machine using GEOS (scarlet) containing varnish made by a Dainippon Ink And chemicals, Incorporated as an ink, and a IF102 made by Fuji Photo Film Co., Ltd. of 3 wt % aqueous water as a fountain solution. Relative evaluation was visually performed on the extent of ink on a blanket cylinder after 5,000 sheets were printed corresponding to the non-image area of a lithographic printing plate.

(2) Press Life

Printing was performed by using a splint printing press made by Komori Corporation as a printing press, a DIC trans black (N) made by Dainippon Ink And chemicals, Incorporated as an ink and a solution containing 10 wt % of isopropyl alcohol and a etching solution EU-3 made by Fuji Photo Film Co., Ltd. 1 wt % as a fountain solution. Press life was evaluated by the number of printed sheets at a time when it was visually observed that an ink was not attached to the solid image area of a printed matter.

In accordance with a preparing method of the first Embodiment of the present invention, if the composition of an aqueous hydrochloric acid solution was specified in electrochemical graining treatment in the aqueous hydrochloric acid solution and the ratio of quantity of electricity Qc at the time of cathode in an aluminum plate to quantity of electricity Qa at the time of anode in an aluminum plate to which Alternating current was applied used for electrochemical graining treatment in an aqueous hydrochloric acid solution, Qc/Qa was determined to be 0.9 to 1.0, an aluminum support for a lithographic printing plate where the honeycomb pits on the surface were quite even could be obtained, not depending upon an aluminum content in the aluminum plate (Example 1-1 to 1-16).

Furthermore, if quantity of electricity Qa at the time of anode in an aluminum plate to which Alternating current was applied used for electrochemical graining treatment in an aqueous hydrochloric acid solution exceeds 100, honeycomb pits obtained on the surface of an aluminum support were even (Example 1-16).

In accordance with the second Embodiment according to the present invention, if electrochemical graining treatment was performed in an aqueous hydrochloric acid solution after electrochemical graining treatment had been performed in an aqueous nitric acid solution and the aqueous hydrochloric acid solution used for electrochemical graining treatment in the aqueous hydrochloric acid solution was an aqueous hydrochloric acid solution having a specified composition and the ratio of quantity of electricity Qc at the time of cathode in an aluminum plate to quantity of electricity Qa at the time of anode in an aluminum plate to which Alternating current was applied used for electrochemical graining treatment in an aqueous nitric acid solution and in an aqueous hydrochloric acid solution, Qc/Qa was determined to be 0.9 to 1.0, an aluminum support for a lithographic printing plate where the honeycomb pits on the surface were quite even could be obtained, not depending upon an aluminum content in the aluminum plate (Examples 2-1 to 2-17).

In accordance with the third Embodiment according to the present invention, if electrochemical graining treatment was performed in an aqueous nitric acid solution after electrochemical graining treatment had been performed in an aqueous hydrochloric acid solution and the aqueous hydrochloric acid solution used for electrochemical graining treatment in the aqueous hydrochloric acid solution was an aqueous hydrochloric acid solution having a specified composition and the ratio of quantity of electricity Qc at the time of cathode in an aluminum plate to quantity of electricity Qa at the time of anode in an aluminum plate to which Alternating current was applied used for electrochemical graining treatment in an aqueous hydrochloric acid solution and in an aqueous nitric acid solution, Qc/Qa was determined to be 0.9 to 1.0, an aluminum support for a lithographic printing plate where the honeycomb pits on the surface were quite even could be obtained, not depending upon an aluminum content in the aluminum plate (Examples 3-1 to 3-17).

Accordingly, even if an aluminum plate which could be obtained by scrapping and recycling beverage cans was used (Examples 1-14, 2-16 and 3-16), an aluminum support for a lithographic printing plate where the honeycomb pits on the surface were quite even could be obtained.

In addition, an aluminum support for a lithographic printing plates which were obtained by a preparing method in the first to third embodiments according to the present invention were excellent in both press life and printing performance (scum resistance) when a lithographic printing plate was prepared if a visible light exposure type recording layer of the conventional type (photosensitive layers A to C) was provided on the support or if a laser recording layer (photosensitive layers D to K) was provided on the support.

In the meanwhile, a lithographic printing plate was prepared by providing the photosensitive layers A to K as in the first embodiment described above using the supports for a lithographic printing plates obtained in Comparative Examples 1-1 to 1-2, 2-1 to 2-3 and 3-1 to 3-3 in the first to third embodiments and performing development treatment on them. When printing was performed by using these lithographic printing plates, a satisfactory lithographic printing plate could not be obtained from the viewpoint of at least either press life or scum resistance.

Namely, in the preparation of an aluminum support for a lithographic printing plate in the first Embodiment according to the present invention, if the ratio of quantity of electricity Qc at the time of cathode in an aluminum plate to quantity of electricity Qa at the time of anode in an aluminum plate to which Alternating current was applied used for electrochemical graining treatment in an aquerous hydrochloric acid solution, Qc/Qa was less than 0.9, honeycomb pits obtained on the surface of an aluminum supports for a lithographic printing plate were uneven (Comparative Example 1-1) and if Qc/Qa exceeds 1.0, an electrode in electrochemical graining treatment was dissolved (Comparative Example 1-2).

In addition, in the preparation of an aluminum support for a lithographic printing plate in the second embodiment according to the present invention, if the ratio of quantity of electricity Qc at the time of cathode in an aluminum plate to quantity of electricity Qa at the time of anode in an aluminum plate to which Alternating current was applied used for electrochemical graining treatment in an aqueous nitric acid solution and in an aqueous hydrochloric acid solution, Qc/Qa was less than 0.9, honeycomb pits obtained on the surface of an aluminum support for a lithographic printing plate were uneven (Comparative Example 2-1) and if Qc/Qa exceeds 1.0, an electrode in electrochemical graining treatment was dissolved (Comparative Example 2-2).

In addition, if an aqueous hydrochloric acid solution used for electrochemical graining treatment in an aqueous hydrochloric acid solution was not an aqueous hydrochloric acid solution having a specified composition, honeycomb pits obtained on the surface of an aluminum support for a lithographic printing plate were uneven (Reference Example 2-3)

In addition, in the preparation of an aluminum support for a lithographic printing plate in the third embodiment according to the present invention, if the ratio of quantity of electricity Qc at the time of cathode in an aluminum plate to quantity of electricity Qa at the time of anode in an aluminum plate to which Alternating current was applied used for electrochemical graining treatment in an aqueous hydrochloric acid solution and in an aqueous nitric acid solution, Qc/Qa was less than 0.9, honeycomb pits obtained on the surface of an aluminum support for a lithographic printing plate were uneven (Comparative Example 3-1) and if Qc/Qa exceeds 1.0, an electrode in electrochemical graining treatment was dissolved (Comparative Example 3-2).

In addition, if only electrochemical graining treatment was performed on an aluminum support for a lithographic printing plate in an aqueous nitric acid solution, surface shapes thereof were uneven (Comparative Example 3-2).

Fourth Embodiment According to the Present Invention

1. Preparation of Support for a Lithographic Printing Plate

Examples 4-1 to 4-18, Comparative Examples 4-1 to 4-5

Graining treatment was performed on an aluminum web (Width of 1,100 mm and thickness of 0.24 mm) having the content of aluminum and the density of an intermetallic compound as shown in FIG. 3 in accordance with the following procedures and the conditions.

For the density of the intermetallic compound contained in the aluminum web, the grained surface of an aluminum web was observed with SEM (scanning electron microscope) and was found by counting the number of particles of an intermetallic compound in a range of 60 μm×50 μm at 5 places (n=5) on the surface of the aluminum web and converting the number of the particles into that of the particles/mm$^2$.

The results were shown in Table 3.

(1) Mechanical Graining Treatment

Mechanical graining treatment was performed with a brush roll while an abrasive slurry was supplied from a spray tube to the surface of an aluminum plate.

The abrasive slurry where a pumice stone powder with the average particle diameter of 20 μm was suspended in 7.7 wt % of water was used as the abrasive slurry.

Three No. 8 nylon brushes were used as the brush roll. Two supporting rollers were provided on the brush rolls, respectively. A diameter of the supporting roller was 200 mm and a distance between two supports was 300 mm.

The indentation of the brush rolls was controlled so as to keep constant an increase in the load of a drive motor which rotates the brush rolls to the load of the drive motor before the brush rolls were pressed and allow the average surface roughness of the aluminum plate after graining treatment performed to be 0.4 to 0.5 μm. The amplitude of the oscillation was 100 mm.

(2) Alkali Etching Treatment (First)

An alkali solution at 60° C. containing 26 wt % of NaOH was sprayed from a spray tube to the grained surface of an aluminum web after mechanical graining treatment was performed and alkali etching treatment was performed so as to allow the etching quantity to be 5 g/m$^2$.

(3) Desmutting Treatment (First)

Next, desmutting treatment was performed by spraying an aqueous nitric acid solution at 35° C. containing nitric acid of 1 wt % to the grained surface of the aluminum web for 10 seconds.

(4) Electrolytic Graining Treatment in an Aqueous Nitric Acid Solution (First Electrochemical Graining Treatment)

Electrolytic treatment was performed by applying trapezoidal wave current in frequency of 60 Hz in a nitric acid aqueous solution at a solution temperature of 50° C. containing 1 wt % of nitric acid. The current intensity was 50 A/dm$^2$ and quantity of electricity $Q_1$ at the time of anode in an aluminum web was as shown in FIG. 3. (In addition, quantity of electricity $Q_1$ was shown in the ratio with quantity of electricity $Q_2$ at the time of anode in aluminum web in electrolytic graining treatment in a hydrochloric acid aqueous).

(5) Alkali Etching Treatment (Second)

Alkali etching treatment was performed so as to allow the etching quantity to be as shown in FIG. 3 by spraying an alkali solution at a solution temperature of 60° C. containing 26 wt % of NaOH from a spray tube to the grained surface of an aluminum web after the electrolytic graining treatment was performed. In addition, the etching quantity was changed by increasing and decreasing a treatment time.

(6) Desmutting Treatment (Second)

Next, desmutting treatment was performed by spraying a sulfuric solution with the concentration of 30 wt % at a solution temperature of 35° C. to the grained surface of the aluminum web for 10 seconds.

(7) Electrolytic Graining Treatment in Hydrochloric Acid (Second Electrochemical Graining Treatment)

Electrolytic graining treatment was performed by applying a trapezoidal wave current in frequency of 60 Hz in an aqueous hydrochloric acid solution at solution temperature of 35° C. containing 1 wt % of hydrochloric acid.

The current intensity was 15 A/dm$^2$ and quantity of electricity $Q_2$ at the time of anode in an aluminum web was 50 C/dm$^2$.

In FIG. 3, each item was described as follows. A time period from soaking an aluminum plate in a hydrochloric acid to starting performing electrolytic graining treatment was "hydrochloric acid solution soaking time (second)". The average relative flow rate of an aluminum plate being transferred inside an electrolytic cell and a hydrochloric acid solution flowing inside the electrolytic cell was "hydrochloric acid solution flow rate (m/sec.).

(8) Alkali Etching Treatment (Third)

The alkali etching treatment was performed as in alkali etching treatment (second). The etching quantity was similarly changed by increasing and decreasing a treatment time.

(9) Desmutting Treatment (Third)

Desmutting treatment was performed as in desmutting treatment (second).

(10) Anodizing Treatment

Anodizing treatment was performed by applying DC to the aluminum web in an aqueous sulfuric solution at a solution temperature of 35° C. containing 15 wt % of sulfuric acid so as to allow the coated quantity of an anodizing layer to be 2 g/m$^2$.

TABLE 3

| | Content of Alminum (wt %) | Density of intermetallic compound (pcs/mm$^2$) | Hydrochloric acid solution soaking time (second) | Hydrochloric solution flow rate (m/sec) | Quantity of etching (g/mm$^2$) Alkali etching treatment (second-step) | Alkali etching treatment (third-step) | Ratio $Q_1/Q_2$ |
|---|---|---|---|---|---|---|---|
| Example 4-1 | 99.5 | 2000 | 1 | 1500 | 1.0 | 0.2 | 4 |
| Example 4-2 | 99.0 | 2000 | 1 | 1500 | 1.0 | 0.2 | 4 |
| Example 4-3 | 99.5 | 500 | 1 | 1500 | 1.0 | 0.2 | 4 |
| Example 4-4 | 99.5 | 35000 | 1 | 1500 | 1.0 | 0.2 | 4 |
| Example 4-5 | 99.5 | 2000 | 3 | 1500 | 1.0 | 0.2 | 4 |
| Example 4-6 | 99.5 | 2000 | 5 | 1500 | 1.0 | 0.2 | 4 |
| Example 4-7 | 99.5 | 2000 | 1 | 80 | 1.0 | 0.2 | 4 |
| Example 4-8 | 99.5 | 2000 | 1 | 120 | 1.0 | 0.2 | 4 |
| Example 4-9 | 99.5 | 2000 | 1 | 3800 | 1.0 | 0.2 | 4 |
| Example 4-10 | 99.5 | 2000 | 1 | 4500 | 1.0 | 0.2 | 4 |
| Example 4-11 | 99.5 | 2000 | 1 | 1500 | 0.1 | 0.2 | 4 |
| Example 4-12 | 99.5 | 2000 | 1 | 1500 | 0.05 | 0.2 | 4 |
| Example 4-13 | 99.5 | 2000 | 1 | 1500 | 3.5 | 0.2 | 4 |
| Example 4-14 | 99.5 | 2000 | 1 | 1500 | 1.0 | 0.1 | 4 |
| Example 4-15 | 99.5 | 2000 | 1 | 1500 | 1.0 | 0.05 | 4 |
| Example 4-16 | 99.5 | 2000 | 1 | 1500 | 1.0 | 0.2 | 2 |
| Example 4-17 | 99.5 | 2000 | 1 | 1500 | 1.0 | 0.2 | 1 |
| Example 4-18 | 99.5 | 2000 | 1 | 1500 | 1.0 | 0.2 | 0.8 |
| Comparative Example 4-1 | 98.0 | 2000 | 1 | 1500 | 1.0 | 0.2 | 4 |
| Comparative Example 4-2 | 99.5 | 400 | 1 | 1500 | 1.0 | 0.2 | 4 |
| Comparative Example 4-3 | 99.5 | 37000 | 1 | 1500 | 1.0 | 0.2 | 4 |
| Comparative Example 4-4 | 99.5 | 2000 | 7 | 1500 | 1.0 | 0.2 | 4 |
| Comparative Example 4-5 | 99.5 | 2000 | 10 | 1500 | 1.0 | 0.2 | 4 |

2. Formation of Recording Layer

A coating solution with the following composition was coated on the grained surfaces of each support for a lithographic printing plate prepared in accordance with the aforementioned steps and dried to form recording layers.

| (Composition of coating solution) | |
|---|---|
| Capric acid | 0.03 g |
| Copolymer A (a copolymer 10 mol % or more containing one kind or more of a monomer having phenolic hydroxy group, a monomer having sulfonamide group and a monomer having active imino group as a copolymerization component) | 0.75 g |
| m, p-cresol novolak resin (m/p ratio = 6/4) | 0.25 g |
| p-toluenesulfonic acid | 0.003 g |
| Tetrahydrophthalic anhydride | 0.03 g |
| Cyanine dye | 0.017 g |
| Dye prepared by setting a counter ion of Victorian pure blue BOH as 1-naphthalenesulfonic acid anion | 0.017 g |
| Fluorine-containing nonionic surfactant, Megafac F-177, made by Dainippon Ink And Chemicals, Incorporated) | 0.05 g |
| γ-butyrolactone | 10 g |
| Methyl ethyl ketone | 10 g |
| 1-methoxy-2-propanol | 1 g |

3. Evaluation of Lithographic Printing Plate (1) Evenness of Pits

For each support for a lithographic printing plate before forming a recording layer, the surface shape was observed at a magnification of 2,000 with a scanning electron microscope and the evenness of honeycomb pits produced on the surface was evaluated. The results were shown in Table 4.

In addition, the evaluation was performed in six steps of ◎, ○, ○Δ, Δ, Δx and x from the best evenness of profile irregularities on the surface in order.

(2) Sensitivity

Full exposure was performed on the obtained presensitized plates at the quantity of plate surface energy of 100 mJ/cm$^2$ with Trend Setter 3244 made by Creo Inc. Thereafter, development treatment was performed by allowing the presensitized plate to pass through automatic processor Stablon 900D made by Fuji Photo Film Co., Ltd. with an aqueous solution (pH=12.7) containing 5.26 wt % of sodium silicate with mol ratio of $SiO_2/Na_2O$: 1.74 as a developer and FR-3 (1:7) made by Fuji Photo Film Co., Ltd. as a rinse charged to obtain a lithographic printing plate.

Observing the surface of a lithographic printing plate after development treatment was performed with a loupe, the quantity of a residual layer was evaluated in the six steps of ◎, ○, ○Δ, Δ, Δx and x in accordance with the following scale. The results were shown in Table 4.

The symbols in Table 6 indicate the following evaluations.

Symbol Evaluation

◎: No residual layer was left.

○: A residual layer was slightly left.

○Δ: A residual layer was slightly generated and there were several residual layers with the size of 100 μm or less within the visual field of a loupe.

Δ: A level that there was no problem at the time of printing although there was a residual layer.

Δx: A level that a scum was generated at the time of printing as there were a little residual layers.

x: A level that a scum was strongly generated as there were much of residual layers.

(3) Press Life

Exposure was similarly performed on the obtained presensitized plates at the quantity of plate surface energy of 140 mJ/cm$^2$ with Trend Setter 3224 made by Creo Inc. and development treatment was performed as in the evaluation of sensitivity.

For a lithographic printing plate after development treatment was performed, printing performance was evaluated. Printing was performed by using SOR-M made by Heidelberg AG as a printing press, a solution water where 10% of isopropanol was added to a EU-3 (1:100) made by Fuji Photo Film Co., Ltd. as a fountain solution and a mark five new ink made by Toyo Ink Co., Ltd. as an ink.

Press life was evaluated in the six steps of ◎, ○, ○Δ, Δ, Δx and x in accordance with the following scale, based on the number of printed matters until a scum begins to be generated in the non-image area of a printed matter. The results were shown in Table 4. The symbols in Table 4 indicate the following evaluations.

Symbol: Number of printed matters until a scum begins to be generated

◎: 50,000 sheets or more

○: 45,000 sheets or more and less than 50,000 sheets

○Δ: 40,000 sheets or more and less than 45,000 sheets

Δ: 35,000 sheets or more and less than 40,000 sheets

Δx: 30,000 sheets or more and less than 35,000 sheets x: Less than 30,000 sheets (4) Strength Tensile test was performed on a support for a lithographic printing plates before forming a recording layer, in accordance with JIS Z 2241. The strength was evaluated in the three steps of ◎, ○ and x in accordance with the following scale. The results were shown in Table 4. The symbols in Table 4 indicate the following evaluations.

Symbol: Tensile strength

◎: 150 to 180 MPa

○: 120 to 149 MPa x: 119 MPa or less

TABLE 4

| | Evenness of pits | Sensitivity | Press life | Strength |
|---|---|---|---|---|
| Example 4-1 | ◎ | ◎ | ◎ | ◎ |
| Example 4-2 | ○Δ | ○Δ | ○Δ | ◎ |
| Example 4-3 | ○Δ | ○ | ○ | ◎ |
| Example 4-4 | ○Δ | ○Δ | ○ | ◎ |
| Example 4-5 | ○ | ○Δ | ○ | ◎ |
| Example 4-6 | ○Δ | Δ | ○ | ◎ |
| Example 4-7 | Δ | Δ | ○Δ | ○ |
| Example 4-8 | ○Δ | ○Δ | ○ | ◎ |
| Example 4-9 | Δ | ○Δ | Δ | ◎ |
| Example 4-10 | Δ | Δ | Δ | ◎ |
| Example 4-11 | ○Δ | ○Δ | ○ | ◎ |
| Example 4-12 | Δ | Δ | Δ | ◎ |
| Example 4-13 | ◎ | ◎ | ◎ | ◎ |
| Example 4-14 | ○Δ | ○Δ | ○ | ◎ |
| Example 4-15 | ○ | Δ | ◎ | ◎ |
| Example 4-16 | ○ | ○ | ○ | ◎ |
| Example 4-17 | ○Δ | ○ | ○Δ | ◎ |
| Example 4-18 | ○ | ○ | Δ | ◎ |
| Comparative Example 4-1 | X | Δ | X | ◎ |
| Comparative Example 4-2 | ◎ | ○ | ○ | X |
| Comparative Example 4-3 | ΔX | Δ | ΔX | ◎ |
| Comparative Example 4-4 | X | ΔX | ΔX | ◎ |
| Comparative Example 4-5 | X | X | ΔX | ◎ |

Reference Example

<Preparation of Support for Lithographic Printing Plate>

Graining treatment was performed on an aluminum web in the same step and conditions as in Examples 4-1 to 4-18 in the fourth embodiment according to the present invention to prepare a support for a lithographic printing plate.

A recording layer a and recording layers c to j were formed on the grained surface obtained of the support for a lithographic printing plate.

A coating solution with the following composition was coated on a recording layer a and recording layers c to j and they were formed drying them. Recording layer j was prepared by forming a silver thin layer on the grained surface of the support for a lithographic printing plate in accordance with the steps as described in [0052] to [0056] (Example 1) of JP 11-139023 A.

Described below is the composition of the recording layer coating solution used to form recording layer a and recording layers c to j.

| (Recording layer a) | |
|---|---|
| Carbon black dispersion solution (containing 20 wt % of carbon black) | 10 g |
| Hexafluorophosphate of condensate of 4-diazidediphenylamine and formaldehyde | 0.5 g |
| Methacrylic acid/2-hydroxyethyl acrylate/benzyl acrylate/acrylonitrile copolymer (copolymerization ratio = 15:30:40:15, weight average molecular weight = 100,000) | 0.5 g |
| Malic acid | 0.05 g |
| Fluorine-containing surfactant (FC-430, made by 3M) | 0.05 g |
| 1-methoxy-2-propanol | 80 g |
| Ethyl lactate | 15 g |
| Water | 10 g |
| (Recording layer c) | |
| Capric acid | 0.03 g |
| m, p-cresol novolak resin (m/p ratio = 6/4) | 1 g |
| p-toluenesulfonic acid | 0.003 g |
| Tetrahydrophthalic anhydride | 0.03 g |
| Cyanine dye | 0.017 g |
| Dye prepared by setting a counter ion of Victorian pure blue BOH as 1-naphthalenesulfonic acid anion | 0.017 g |
| Fuluorine-containing surfactant (Megafac F-177, made by Dainippon Ink And Chemicals, Incorporated) | 0.05 g |
| γ-butyrolactone | 10 g |
| Methyl ethyl ketone | 10 g |
| 1-methoxy-2-propanol | 1 g |
| (recording layer d) | |
| a. Composition of photopolymerization layer coating solution | |
| Tetramethylolmethanetetra acrylate | 1.5 g |
| Linear organic highly polymerized compound (B1) | 2.0 g |
| Sensitizer (C1) (λmax × THF: 479 nm, ε = 6.9 × 10$^4$) | 0.15 g |
| Photoinitiator (D1) | 0.2 g |
| IRGACURE907 (E1) (made by Ciba-Geigy Ltd.) | 0.4 g |
| ε-phthalocyanine/B1 dispersed substance | 0.2 g |
| Fuluorine-containing surfactant (Megafac F-177, made by Dainippon Ink And Chemicals, Incorporated) | 0.03 g |
| Methyl ethyl ketone | 9 g |
| Propyleneglycolmonomethylether acetate | 7.5 g |
| Toluene | 11 g |
| b. Composition of oxygen blocking layer coating solution (coated after a photopolymerization coating solution was dried) | |
| 3 wt % of aqueous solution of polyvinyl alcohol (made by KURARAY CO., LTD., Trade name: PVA-105) of saponification of 98.5% | |

Molecular structures of Linear organic highly polymerized compound (B1), Sensitizer (C1), Photoinitiator (D1), and IRGACURE907 (E1) are below.

(B1)

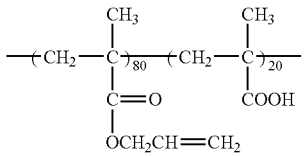

Mw 40,000

(C1)

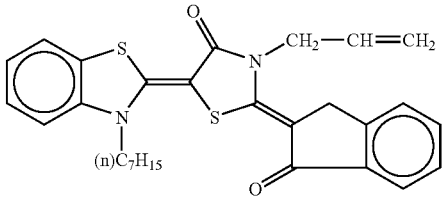

(D1)

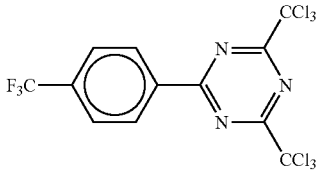

(E1)

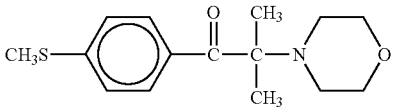

(Recording Layer e)

| a. Composition of polymerization layer coating solution | |
|---|---|
| Pentaerythritoltetraacrylate | 2.5 g |
| 20 wt % of propyleneglycolmonomethylether solution of allylmethacrylate/methacrylic acid copolymer (copolymerization ratio = 80:20) | 37.5 g |
| Pigment dispersion solution | 13.0 g |
| Methyl ethyl ketone | 74.0 g |
| b. Composition of photosensitive layer coating solution (coated after a polymerization layer coating solution was dried) | |
| 10 wt % of aqueous solution of polyvinyl alcohol (made by KURARAY CO., LTD., Trade name: PVA-405) of saponification of 79.5% | 10.5 g |
| 0.11 wt % of methanol solution of additive SH-1 | 0.41 g |
| 0.11% of solution of additive SH-1 | 0.41 g |
| Silver halide emulsion | 0.50 g |
| 5 wt % of aqueous water of surfactant SA-1 | 0.45 g |
| Water | 7.8 g |
| Reducing agent dispersion solution | 1.2 g |
| c. Composition of oxygen blocking layer (coated after a photosensitive layer was dried) | |
| 10 wt % of aqueous solution of polyvinyl alcohol (made by KURARAY CO., LTD., Trade name: PVA-105) of saponification of 98.5% | 200 g |
| Base precursor dispersion solution | 1.25 g |
| Aqueous surfactant solution | 4 g |

(Recording Layer f)

| a. Composition of resin layer coating solution | |
|---|---|
| Naphthoquinone-1,2-diazide-(2)-sulfonic acid ester of acetone-pyrogallol resin | 5.0 g |
| Cresol-formaldehyde resin | 10.0 g |
| Methyl ethyl ketone | 150 g |
| Cyclohexanone | 122 g |
| b. Photosensitive layer coating solution (coated after resin layer coating solution was dried) | |
| Composition of silver chlorobromide gelatin emulsion (Cl: 70 mol %, Br: 30 mol %, average particle diameter: 0.28 μm, gelatin quantity/emulsion of 1 kg: 55 g, silver halide content: 0.85 mol) | 1,000 g |
| 0.1% methanol solution of 1,3-diethyl-5-[2-(3-(sulfopropyl) benzooxazole-2-ylidene)ethylidene] thiohydantoin sodium salt | 50 mL |
| 0.5% aqueous alkali solution of 4-hydroxy-6-methyl-1,3,3a,7-tetrazaindene | 100 mL |
| 2% aqueous solution of 2,4-dichloro-6-hydroxy-s-triazine | 35 mL |

(Recording Layer g)

a. Physical Development Nuclear Layer

Silver sol prepared by Carey Lea process was coated so as to allow the coated quantity of silver to be 5 mg/m$^2$.

b. Silver Halide Layer (Coated on Physical Development Nuclear Layer)

Chlorobromide emulsion (silver content:gelatin (weight ratio)=1:1) made by 40 mol % of silver chloride and 60 mol % of bromide with average particle diameter of 0.3 μm was coated so as to allow the coated quantity to be 2.0 g/m$^2$.

(Recording Layer h)

| a. Composition of photoconductive layer coating solution | |
|---|---|
| Fastogen Blue 8120 (made by Dainippon Ink And Chemicals, Incorporated, metal-free phthalocyanine) | 1.0 part by weight |
| Copolymer of methyl methacrylate/methacrylic acid (copolymerization = 80/20) | 10 parts by weight |
| Tetrahydrofuran | 60 parts by weight |
| Cyclohexanone | 40 parts by weight |
| b. Composition of protective layer coating solution (coated after a photoconductive layer was dried) | |
| Polyvinylbutyral (made by DENKI KAGAKU KOGYO KABUSHIKI KAISHA, 2000-L) | 2 parts by weight |
| Stearic acid | 0.5 parts by weight |
| Ethanol | 97.5 parts by weight |

(Recording Layer i)

A high-molecular compound which generates sulfonic acid by the action of an acid and has a functional group at side chain with the following structural formula 1.0 g

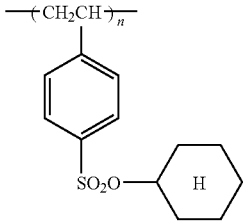

o-naphthoquinonediazide-4-sulfonyl chloride 0.1 g

Dye prepared by setting a counter ion of Victorian pure blue BOH as 1-naphthalenesulfonic acid anion 0.05 g Fuluorine-containing surfactant (Megafac F-177, made by Dainippon Ink And Chemicals, Incorporated) 0.05 g

| | |
|---|---|
| Methyl ethyl ketone | 10 g |
| γ-butyrolactone | 10 g |

For a presensitized plate provided with any one of recording layers a to i, sensitivity, press life and strength were evaluated as in Example 4-1 in the fourth embodiment according to the present invention and it was found that the plate was excellent in any of sensitivity, press life and strength when it is made into the lithographic printing plate.

According to the first to third embodiments of the invention, a method of preparing an aluminum support for a lithographic printing plate where a low-purity aluminum rolled plate (an aluminum plate containing much of alloy components or an aluminum plate with alloy components unadjusted) which has not been used as an aluminum support for a lithographic printing plate can be used, processing unevenness is not produced by graining treatment, even grain shape is formed and an optimum surface shape achieving both excellent press life and printing performance (scum resistance performance) can be obtained when a lithographic printing plate is prepared, a support for a lithographic printing plate obtained by the method and a presensitized plate using the support for a lithographic printing plate can be provided.

In addition, according to the forth embodiment of the invention, a presensitized plate which is excellent in water receptivity, water wettability in non-image area, press life, scum resistance of the printing plate and laser exposure suitability, and can be preferably used as a lithographic printing plate for the direct plate making system or a directly drawn lithographic printing plate, a support for the lithographic printing plate which is the base material of the presensitized plate, and a method of preparing thereof can be provided.

What is claimed is:

1. A method of preparing a support for a lithographic printing plate wherein at least one side of an aluminum plate having an aluminum content of 99 wt % or more is subjected to graining treatment to prepare the support for the lithographic printing plate having intermetallic compounds existent within the depth of 2 μm from the surface thereof at a density of 500 to 35,000 pcs/mm$^2$, and the aluminum plate is grained by performing electrochemical graining treatment in a hydrochloric acid solution, and the electrochemical graining treatment is started within 3 seconds after the aluminum plate is soaked in the hydrochloric acid solution.

2. The method of preparing an aluminum support for a lithographic printing plate according to claim 1, wherein after the electrochemical graining treatment of the aqueous hydrochloric acid solution, an alkali etching treatment is performed under the condition that the amount of etching of aluminum plate is 0.05 to 0.2 g/m$^2$.

3. A method of preparing an aluminum support for a lithographic printing plate according to claim 1, wherein the aluminum plate is subjected to electrochemical graining treatment in an aqueous hydrochloric acid solution prepared by adding aluminum chloride hexahydrate at a rate of 10 to 70 g/L to an aqueous solution containing 1 to 10 g/L of hydrochloric acid to have an aluminum ion concentration of 1 to 8 g/L, under the condition that the ratio Qc/Qa of quantity of electricity Qc in the cathodic state to quantity of electricity Qa in the anodic state in the aluminum plate to which Alternating current is applied is 0.9 to 1.0, and the aluminum plate is then subjected to anodizing treatment.

4. A method of preparing an aluminum support for a lithographic printing plate according to claim 2, wherein the electrochemical graining treatment is performed in an aqueous nitric acid solution under the condition that the ratio Qc/Qa of quantity of electricity Qc in the cathodic state to quantity of electricity Qa in the anodic state in the aluminum plate to which Alternating current is applied is 0.9 to 1.0, before the electrochemical graining treatment of the aqueous hydrochloric acid solution and after the electrochemical graining treatment of the aqueous hydrochloric acid solution, an alkali etching treatment is performed.

5. A method of preparing an aluminum support for a lithographic printing plate according to claim 1, wherein the quantity of electricity to cause anodic reaction in the aluminum plate is 25 to 100 C/dm$^2$ in the electrochemical graining treatment in the aqueous hydrochloric acid solution.

6. The method of preparing an aluminum support for a lithographic printing plate according to claim 4, wherein a rate Q1/Q2 is 1 or higher in condition that the electrolytic graining treatment is performed in the nitric acid with the quantity of electricity Q1 when the aluminum plate is anodic and the electrochemical graining treatment is performed in the hydrochloric acid solution with the quantity of electricity Q2 when the aluminum plate is anodic.

7. A lithographic printing plate comprising the aluminum support obtained by the method of claim 3, 4, 5, 1, 2 or 6 and a photosensitive layer comprising a photosensitive image forming material by infrared ray laser for a direct plate making.

* * * * *